US010897677B2

(12) United States Patent
Walraevens et al.

(10) Patent No.: US 10,897,677 B2
(45) Date of Patent: Jan. 19, 2021

(54) SHOCK AND IMPACT MANAGEMENT OF AN IMPLANTABLE DEVICE DURING NON USE

(71) Applicants: Joris Walraevens, Mechelen (BE); Charles Roger Aaron Leigh, Macquarie University (AU); Rishubh Verma, Mechelen (BE); Katrien Geeraerts, Mechelen (BE); Kristof I. Buytaert, Mechelen (BE); Kenneth Oplinger, Macquarie University (AU)

(72) Inventors: Joris Walraevens, Mechelen (BE); Charles Roger Aaron Leigh, Macquarie University (AU); Rishubh Verma, Mechelen (BE); Katrien Geeraerts, Mechelen (BE); Kristof I. Buytaert, Mechelen (BE); Kenneth Oplinger, Macquarie University (AU)

(73) Assignee: Cochlear Limited, Macquarie University (AU)

( * ) Notice: Subject to any disclaimer, the term of this patent is extended or adjusted under 35 U.S.C. 154(b) by 479 days.

(21) Appl. No.: 15/468,773

(22) Filed: Mar. 24, 2017

(65) Prior Publication Data

US 2018/0279061 A1 Sep. 27, 2018

(51) Int. Cl.
*H04R 25/00* (2006.01)
*H04R 17/00* (2006.01)

(52) U.S. Cl.
CPC ..... *H04R 25/606* (2013.01); *H04R 17/005* (2013.01); *H04R 2460/13* (2013.01)

(58) Field of Classification Search
CPC .. H04R 25/604; H04R 25/606; H04R 25/608; H04R 17/00; H04R 17/005; H04R 2460/13
See application file for complete search history.

(56) References Cited

U.S. PATENT DOCUMENTS

| | | | |
|---|---|---|---|
| 2,808,522 | A | 10/1957 | Dranetz |
| 4,498,461 | A | 2/1985 | Hakansson |
| 5,176,620 | A | 1/1993 | Gilman |
| 5,702,342 | A | 12/1997 | Metzler et al. |
| 5,772,575 | A | 6/1998 | Lesinski et al. |
| 5,800,336 | A | 9/1998 | Ball et al. |
| 5,815,872 | A | 10/1998 | Meginniss, III et al. |
| 6,005,955 | A | 12/1999 | Kroll et al. |
| 6,390,970 | B1 | 5/2002 | Müller |

(Continued)

FOREIGN PATENT DOCUMENTS

| | | | |
|---|---|---|---|
| EP | 1501074 | A2 | 1/2005 |
| WO | 9855049 | A1 | 12/1998 |

OTHER PUBLICATIONS

Nusil Technology, "MED-4901 Liquid Silicone Rubber," Life Sciences, May 16, 2014.

*Primary Examiner* — Brian Ensey
(74) *Attorney, Agent, or Firm* — Pilloff Passino & Cosenza LLP; Martin J. Cosenza

(57) ABSTRACT

An implantable component, such as by way of example, an implantable component of a transcutaneous bone conduction device, the implantable component comprising a piezoelectric transducer, wherein the implantable component is configured to temporarily prevent the piezoelectric transducer from moving inside the housing while the housing is implanted in the recipient.

34 Claims, 32 Drawing Sheets

(56) References Cited

U.S. PATENT DOCUMENTS 6,438,243 B1 8/2002 Ikeuchi et al.
6,447,295 B1 9/2002 Kumar et al.
6,473,651 B1 10/2002 Kuzma et al.
6,726,618 B2 4/2004 Miller
6,759,790 B1 7/2004 Bugel et al.
7,065,223 B2 6/2006 Westerkull
7,180,225 B2 * 2/2007 Sashida ..... B06B 1/0611 310/330
7,242,786 B2 * 7/2007 Åsnes ..... H04R 25/606 381/151
7,247,976 B2 7/2007 Sashida et al.
7,376,237 B2 * 5/2008 Westerkull ..... H02K 33/18 381/151
7,840,020 B1 11/2010 Miller et al.
8,761,416 B2 6/2014 Hakansson
9,271,092 B2 2/2016 Bjorn et al.
9,380,379 B1 * 6/2016 Fitch ..... H04R 11/00
9,554,222 B2 1/2017 Miller et al.
2003/0012390 A1 1/2003 Franks
2003/0055311 A1 3/2003 Neukermans et al.
2003/0124491 A1 7/2003 Honkura et al.
2004/0097785 A1 5/2004 Schmid et al.
2004/0148025 A1 7/2004 Schneider et al.
2005/0014108 A1 1/2005 Wohrle et al.
2005/0215852 A1 9/2005 Hatami
2005/0281432 A1 12/2005 Horigome
2006/0045298 A1 3/2006 Westerkull
2006/0058573 A1 3/2006 Neisz et al.
2006/0281963 A1 12/2006 Easter et al.
2007/0041595 A1 2/2007 Carazo et al.
2007/0053536 A1 * 3/2007 Westerkull ..... H04R 25/606 381/326
2007/0104344 A1 5/2007 Goldberg
2008/0075319 A1 3/2008 Kantor et al.
2008/0112584 A1 5/2008 Karamuk
2008/0188707 A1 8/2008 Bernard et al.
2009/0082817 A1 3/2009 Jinton et al.
2009/0115294 A1 5/2009 Kikushima
2009/0124849 A1 5/2009 Pergola
2009/0281366 A1 * 11/2009 Basinger ..... H04R 25/606 600/25
2010/0298626 A1 * 11/2010 Andersson ..... H04R 17/00 600/25
2012/0108887 A1 5/2012 Vermeiren
2013/0184629 A1 7/2013 Gurtner et al.
2013/0197298 A1 8/2013 Miller et al.
2014/0112503 A1 4/2014 Hebenstreit
2014/0163308 A1 6/2014 Miller et al.
2014/0233765 A1 * 8/2014 Andersson ..... H04R 25/606 381/151
2014/0303688 A1 10/2014 Kulah et al.
2015/0141740 A1 5/2015 Miller
2015/0156594 A1 6/2015 Bervoets

* cited by examiner

SHOCK AND IMPACT MANAGEMENT OF AN IMPLANTABLE DEVICE DURING NON USE

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses, commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problems.

SUMMARY

In accordance with one aspect, there is an implantable component, comprising a housing and a transducer (piezoelectric or electromagnetic transducer, etc.), wherein the implantable component is configured to temporarily prevent the piezoelectric transducer from moving inside the housing while the housing is implanted in the recipient.

In accordance with another aspect, there is a component of a bone conduction device, comprising a housing and a transducer-seismic mass assembly, wherein the component is configured to automatically temporarily shock-proof the assembly via energy transfer into or out of a material.

In accordance with another aspect, there is a component of a bone conduction device, comprising a housing and a piezoelectric transducer, wherein the implantable component includes a fluid located therein, wherein the component is configured to control the fluid to temporarily at least limit movement of the piezoelectric transducer relative to that which is the case in the absence of the fluid.

In accordance with another aspect, there is a method, comprising obtaining a component of a bone conduction device including a piezoelectric transducer located within a housing, preventing the transducer from fully flapping or limiting an amount of flap of the transducer relative to that which the transducer can flap without the limitation, and at least one of prior to or subsequent to the action of preventing the transducer from fully flapping or limiting an amount of flap of the transducer relative to that which the transducer can flap without the limitation, enabling the transducer to fully flap or enabling the transducer to flap more than the limited amount and operating the transducer such that the transducer bends upwards and/or downwards to produce vibrations that evoke a first hearing percept via bone conduction.

BRIEF DESCRIPTION OF THE DRAWINGS

Some embodiments are described below with reference to the attached drawings, in which.

DETAILED DESCRIPTION

Embodiments herein are described primarily in terms of a bone conduction device, such as an active transcutaneous bone conduction device and a passive transcutaneous bone conduction device. However, it is noted that the teachings detailed herein and/or variations thereof are also applicable to a middle ear implant or an inner ear implant. Accordingly, any disclosure herein of teachings utilized with an active transcutaneous bone conduction device also corresponds to a disclosure of utilizing those teachings with respect to a passive transcutaneous bone conduction device and a middle ear implant.

Figure 1:
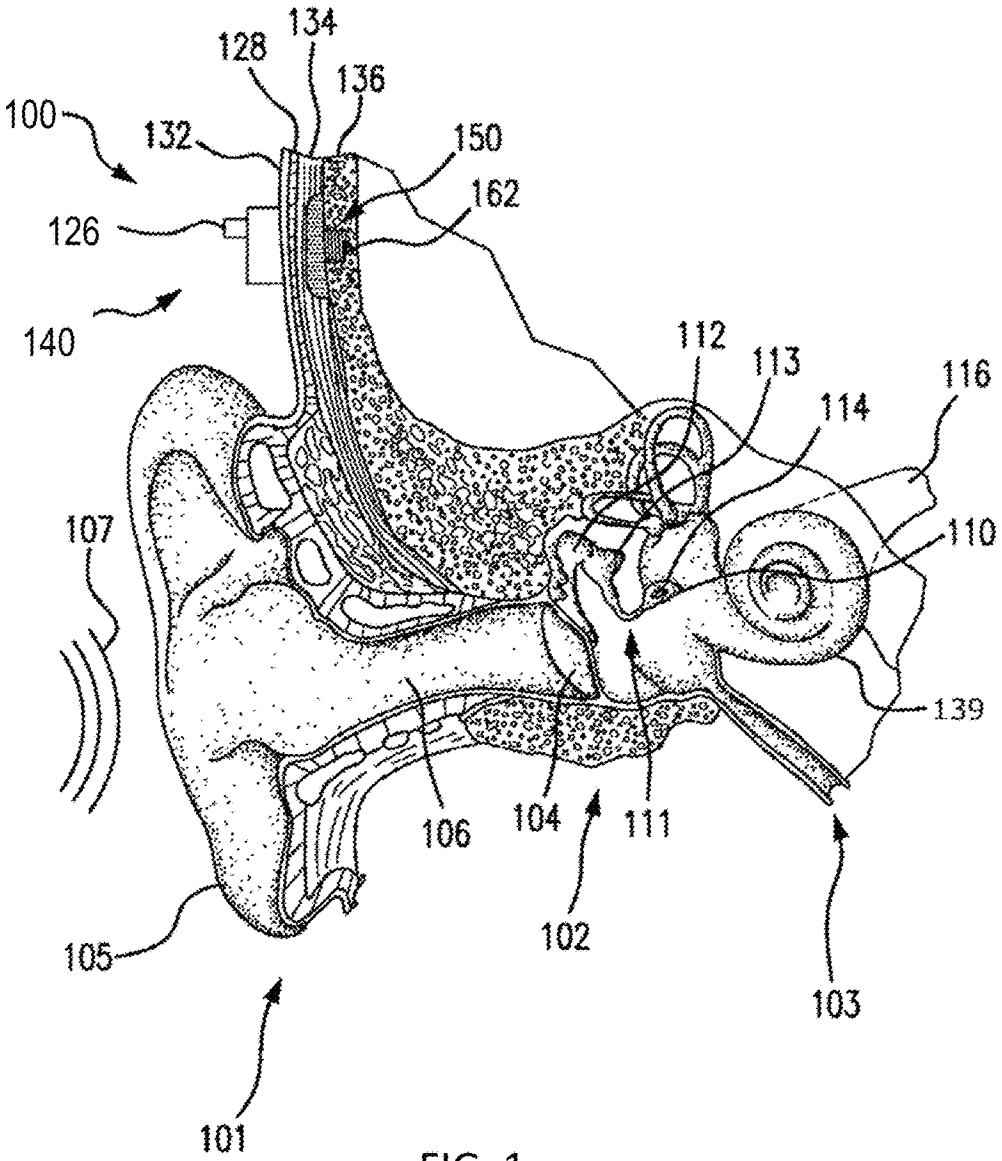
FIG. 1 is a perspective view of an exemplary bone conduction device in which at least some embodiments can be implemented.

FIG. 1 is a perspective view of a bone conduction device 100 in which embodiments may be implemented. As shown, the recipient has an outer ear 101, a middle ear 102, and an inner ear 103. Elements of outer ear 101, middle ear 102, and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102, and inner ear 103 of a recipient of device 100. Bone conduction device 100 comprises an external component 140 and implantable component 150. As shown, bone conduction device 100 is positioned behind outer ear 101 of the recipient and comprises a sound input element 126 to receive sound signals. Sound input element 126 may comprise, for example, a microphone. In an exemplary embodiment, sound input element 126 may be located, for example, on or in bone conduction device 100, or on a cable extending from bone conduction device 100.

More particularly, sound input device 126 (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

Alternatively, sound input element 126 may be subcutaneously implanted in the recipient, or positioned in the recipient's ear. Sound input element 126 may also be a component that receives an electronic signal indicative of sound, such as, for example, from an external audio device. For example, sound input element 126 may receive a sound signal in the form of an electrical signal from an MP3 player electronically connected to sound input element 126.

Bone conduction device 100 comprises a sound processor (not shown), an actuator (also not shown), and/or various other operational components. In operation, the sound processor converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1, bone conduction device 100 can be a passive transcutaneous bone conduction device. That is, no active components, such as the actuator, are implanted beneath the recipient's skin 132. In such an arrangement, the active actuator is located in external component 140, and implantable component 150 includes a magnetic plate, as will be discussed in greater detail below. The magnetic plate of the implantable component 150 vibrates in response to vibration transmitted through the skin, mechanically and/or via a magnetic field, that is generated by an external magnetic plate.

In another arrangement of FIG. 1, bone conduction device 100 can be an active transcutaneous bone conduction device where at least one active component, such as the actuator, is implanted beneath the recipient's skin 132 and is thus part of the implantable component 150. As described below, in such an arrangement, external component 140 may comprise a sound processor and transmitter, while implantable component 150 may comprise a signal receiver and/or various other electronic circuits/devices.

Figure 2:
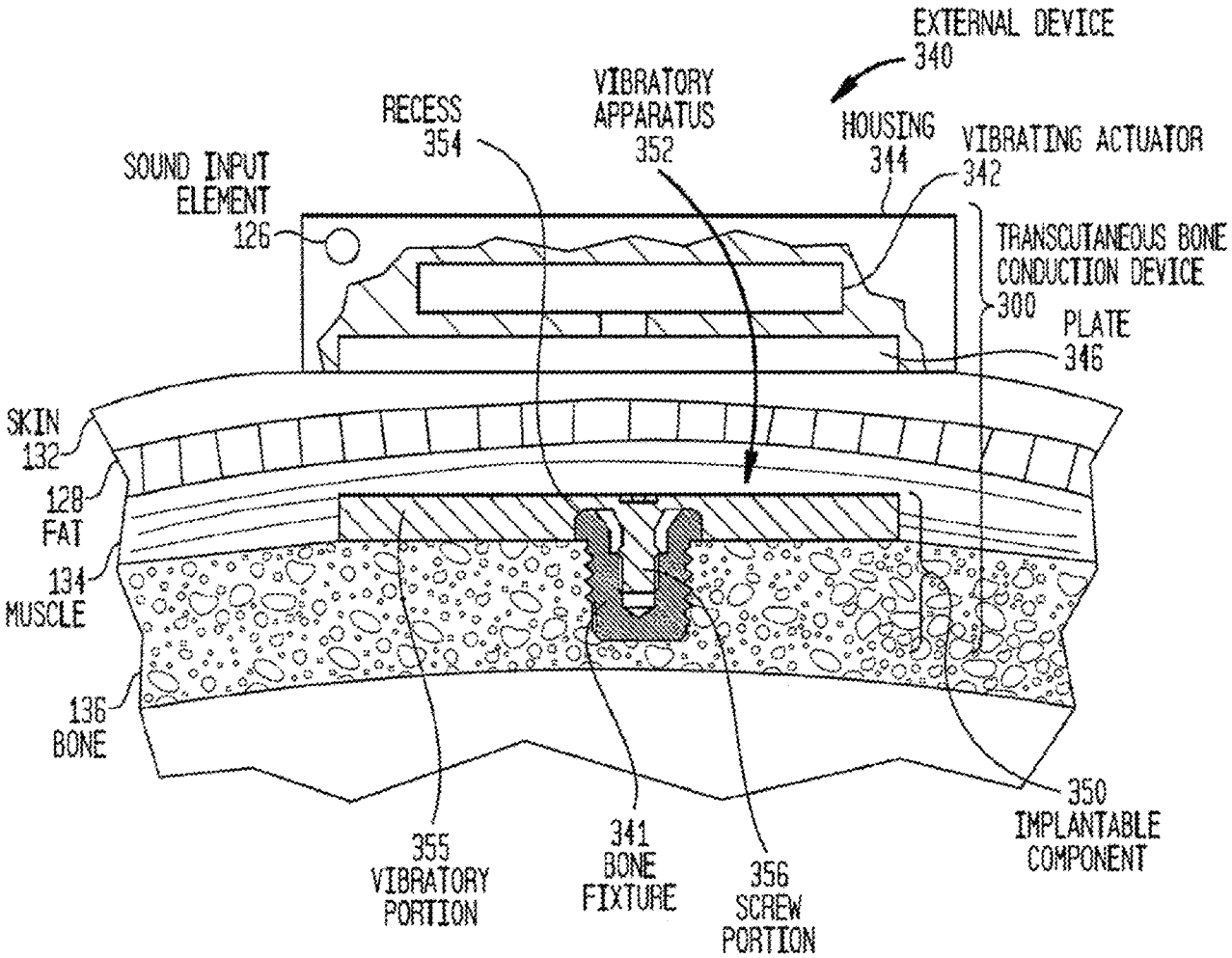
FIG. 2 is a schematic diagram conceptually illustrating a passive transcutaneous bone conduction device.

FIG. 2 depicts an exemplary transcutaneous bone conduction device 300 that includes an external device 340 (corresponding to, for example, element 140 of FIG. 1) and an implantable component 350 (corresponding to, for example, element 150 of FIG. 1). The transcutaneous bone conduction device 300 of FIG. 2 is a passive transcutaneous bone conduction device in that a vibrating actuator 342 (which can be an electromagnetic actuator or a piezoelectric actuator) is located in the external device 340. Vibrating actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating actuator 342 is a device that converts electrical signals into vibration. In operation, sound input element 126 converts sound into electrical signals. Specifically, the transcutaneous bone conduction device 300 provides these electrical signals to vibrating actuator 342, or to a sound processor (not shown) that processes the electrical signals, and then provides those processed signals to vibrating actuator 342. The vibrating actuator 342 converts the electrical signals (processed or unprocessed) into vibrations. Because vibrating actuator 342 is mechanically coupled to plate 346, the vibrations are transferred from the vibrating actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object, such as an abutment, with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 3:
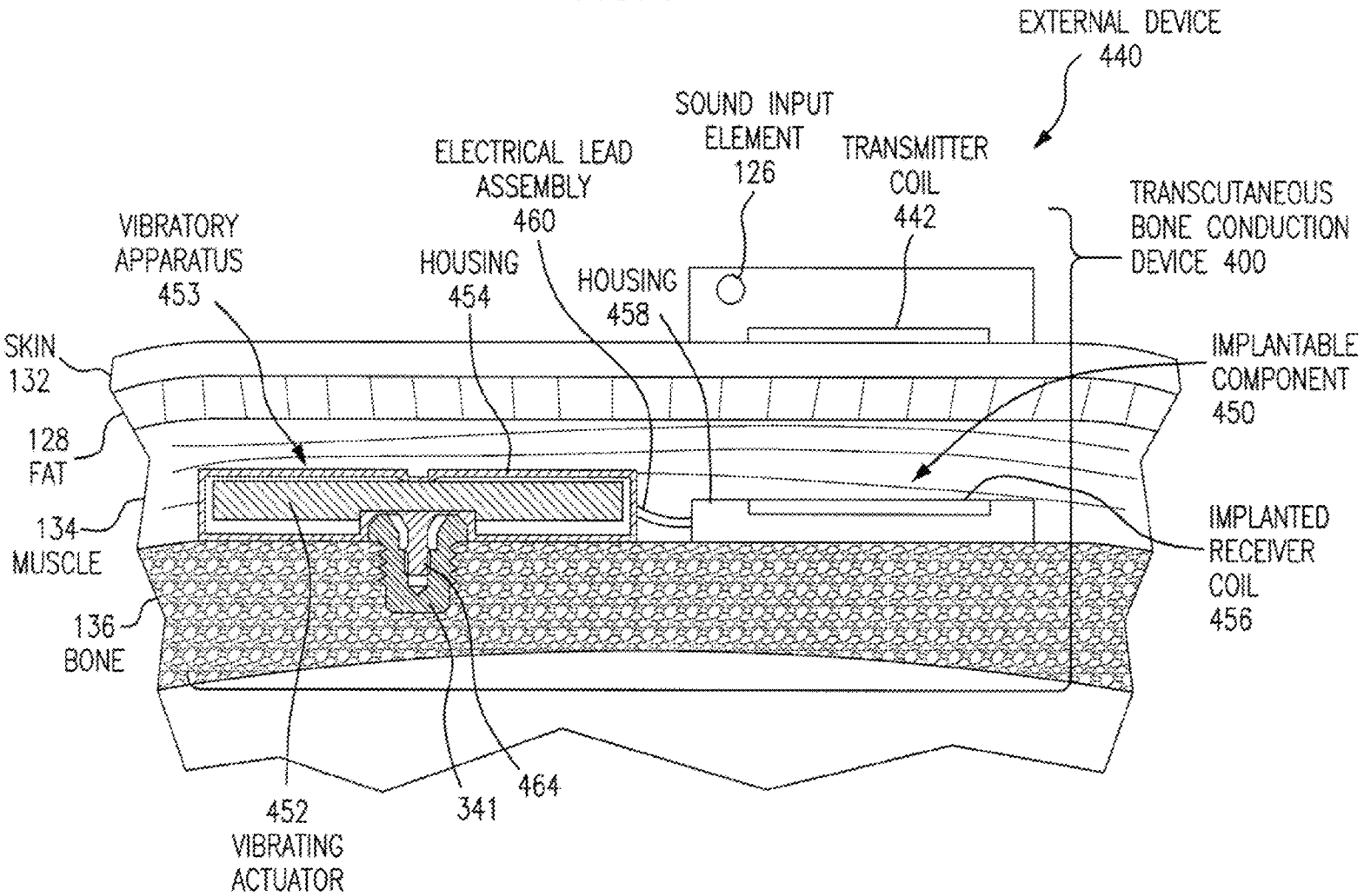
FIG. 3 is a schematic diagram conceptually illustrating an active transcutaneous bone conduction device in accordance with at least some exemplary embodiments.

FIG. 3 depicts an exemplary embodiment of a transcutaneous bone conduction device 400 according to another embodiment that includes an external device 440 (corresponding to, for example, element 140B of FIG. 1) and an implantable component 450 (corresponding to, for example, element 150 of FIG. 1). The transcutaneous bone conduction device 400 of FIG. 3 is an active transcutaneous bone conduction device in that the vibrating actuator 452 (which can be an electromagnetic actuator, or a piezoelectric actuator, etc) is located in the implantable component 450. Specifically, a vibratory element in the form of vibrating actuator 452 is located in housing 454 of the implantable component 450. In an exemplary embodiment, much like the vibrating actuator 342 described above with respect to transcutaneous bone conduction device 300, the vibrating actuator 452 is a device that converts electrical signals into vibration.

External component 440 includes a sound input element 126 that converts sound into electrical signals. Specifically, the transcutaneous bone conduction device 400 provides these electrical signals to vibrating actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. Components (not shown) in the housing 458, such as, for example, a signal generator or an implanted sound processor, then generate electrical signals to be delivered to vibrating actuator 452 via electrical lead assembly 460. The vibrating actuator 452 converts the electrical signals into vibrations.

The vibrating actuator 452 is mechanically coupled to the housing 454. Housing 454 and vibrating actuator 452 collectively form a vibratory apparatus 453. The housing 454 is substantially rigidly attached to bone fixture 341.

Figure 4:
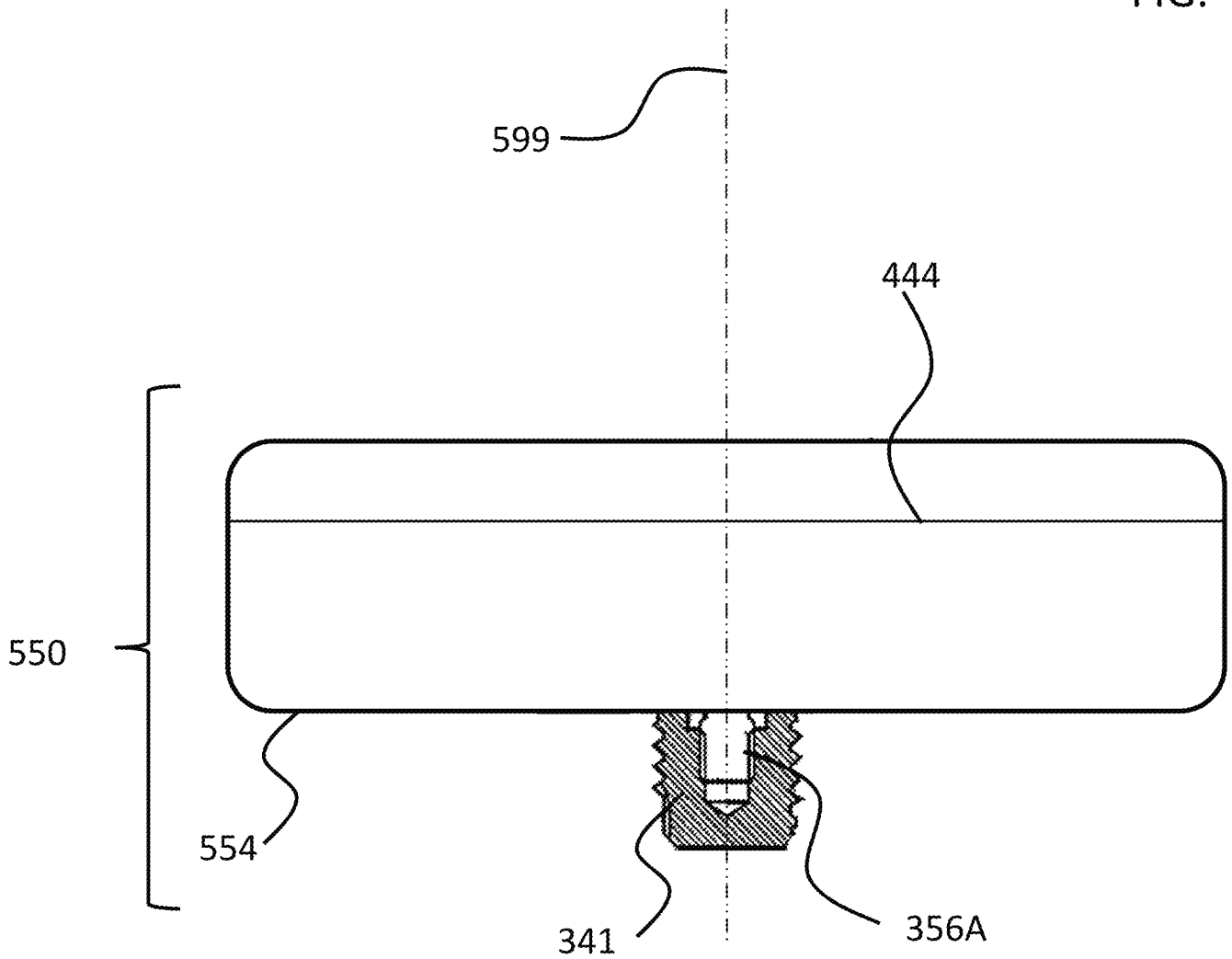
FIG. 4 is a schematic diagram of an outer portion of an implantable component of a bone conduction device.
Figure 5:
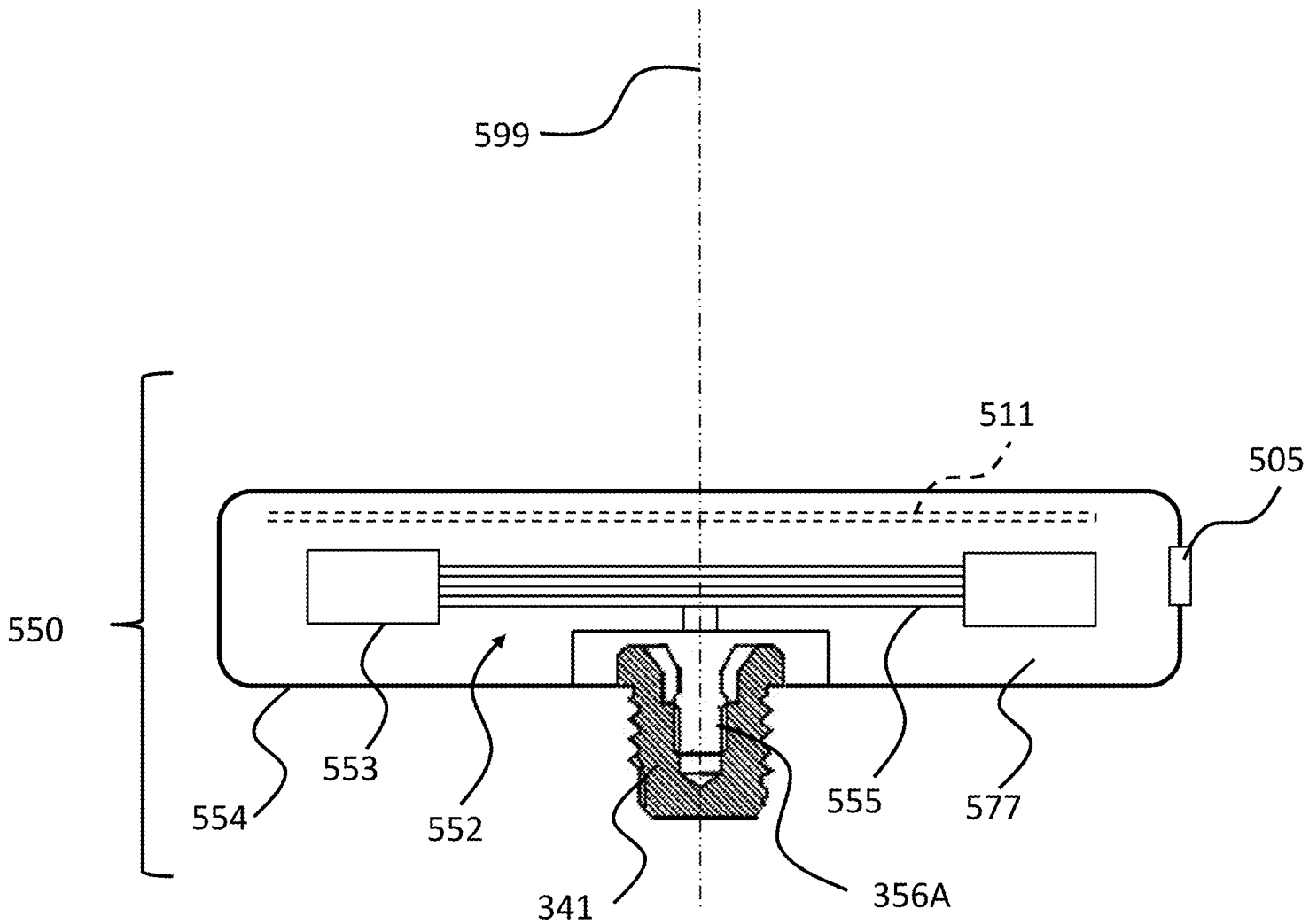
FIG. 5 is a schematic diagram of a cross-section of an exemplary implantable component of a bone conduction device.

FIGS. 4 and 5 depict another exemplary embodiment of an implantable component usable in an active transcutaneous bone conduction device, here, implantable component 550. FIG. 4 depicts a side view of the implantable component 550 which includes housing 554 which entails two housing bodies made of titanium in an exemplary embodiment, welded together at seam 444 to form a hermetically sealed housing. FIG. 5 depicts a cross-sectional view of the implantable component 550.

In an exemplary embodiment, the implantable component 550 is used in the embodiment of FIG. 3 in place of implantable component 450. As can be seen, implantable component 550 combines an actuator 552 (corresponding with respect to functionality to actuator 452 detailed above) and, optionally, an inductance coil 511 (corresponding to coil 456 detailed above). Briefly, it is noted that the vibrating actuator 552 includes a so-called counterweight/mass 553 that is supported by piezoelectric components 555. In the exemplary embodiment of FIG. 5, the piezoelectric components 555 flex upon the exposure of an electrical current thereto, thus moving the counterweight 553. In an exemplary embodiment, this movement creates vibrations that are ultimately transferred to the recipient to evoke a hearing percept. Note that in some other embodiments, consistent with the embodiment of FIG. 4, the coil is located outside of the housing 553, and is in communication therewith via a feedthrough or the like. Any disclosure herein associated with one corresponds to a disclosure associated with the other, unless otherwise noted.

As can be understood from the schematic of FIG. 5, in an exemplary embodiment, the housing 554 entirely and completely encompasses the vibratory apparatus 552, but includes feedthrough 505, so as to permit the electrical lead assembly 460 to communicate with the vibrating actuator 452 therein. It is briefly noted at this time that some and/or all of the components of the embodiment of FIG. 5 are at least generally rotationally symmetric about the longitudinal axis 559. In this regard, the screw 356A is circular about the longitudinal axis 559. Back lines have been omitted for purposes of clarity in some instances.

Figure 6:
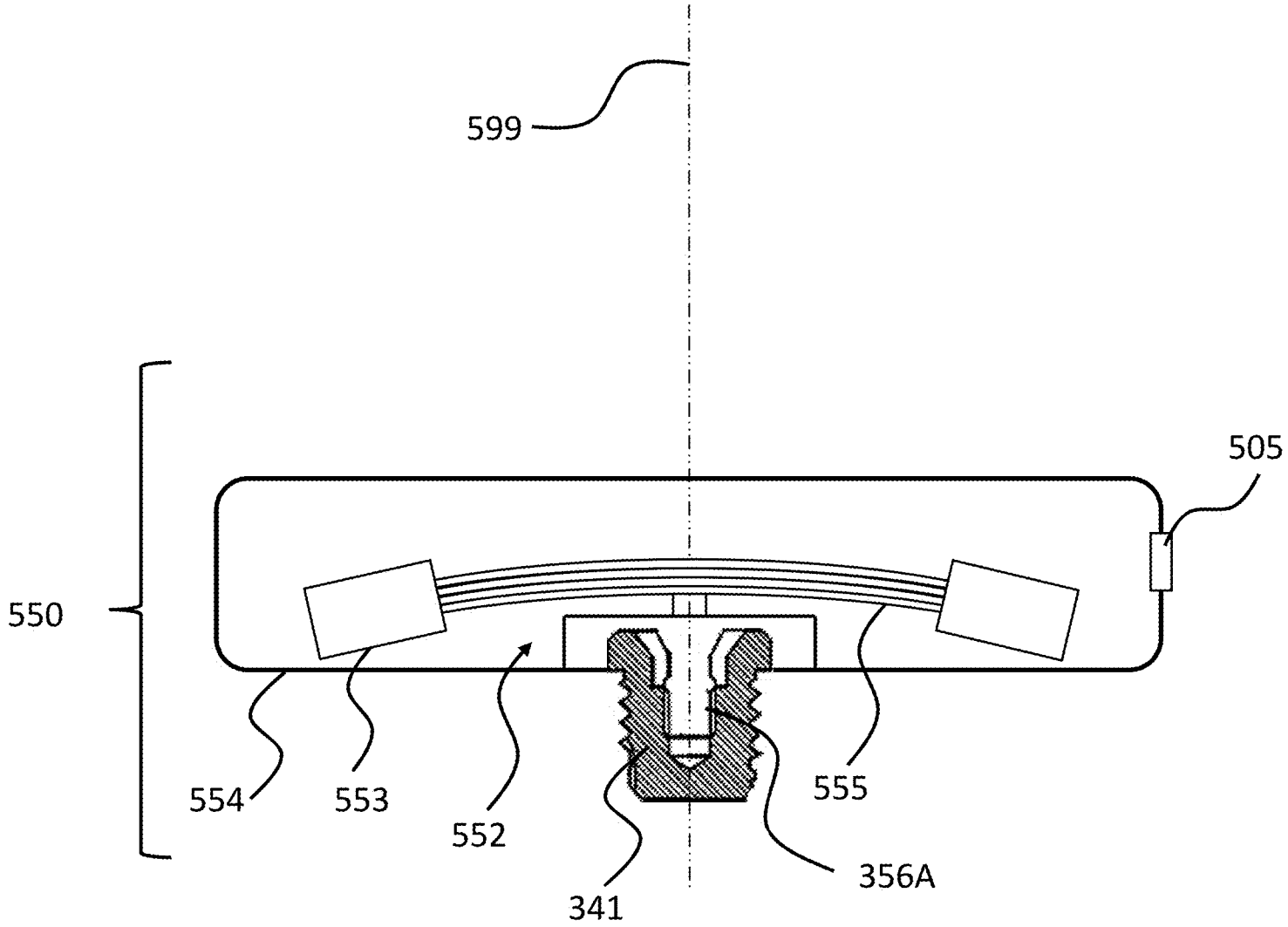
FIG. 6 is a schematic diagram of a cross-section of the exemplary implantable component of FIG. 5 in operation.

Still with reference to FIG. 5, as can be seen, there is a space 577 located between the housing 554 in general, and the inside wall thereof in particular, and the counterweight 553. This space has utilitarian value with respect to enabling the implantable component 550 to function as a transducer in that, in a scenario where the implantable component is an actuator, the piezoelectric material 555 can flex, which can enable the counterweight 553 to move within the housing 554 so as to generate vibrations to evoke a hearing percept. FIG. 6 depicts an exemplary scenario of movement of the piezoelectric material 555 when subjected to an electrical current along with the movement of the counterweight 553. As can be seen, space 577 provides for the movement of the actuator 552 within housing 554 so that the counterweight 553 does not come into contact with the inside wall of the housing 554. However, the inventors of the present application have identified a failure mode associated with such an implantable component 550. Specifically, in a scenario where prior to the attachment of the housing 554 and the components therein to the bone fixture 341, the housing and the components therein are subjected to an acceleration above certain amounts and/or a deceleration above certain amounts, the piezoelectric material 555 will be bent or otherwise deformed beyond its operational limits, which can, in some instances, have a deleterious effect on the piezoelectric material.

Figure 7:
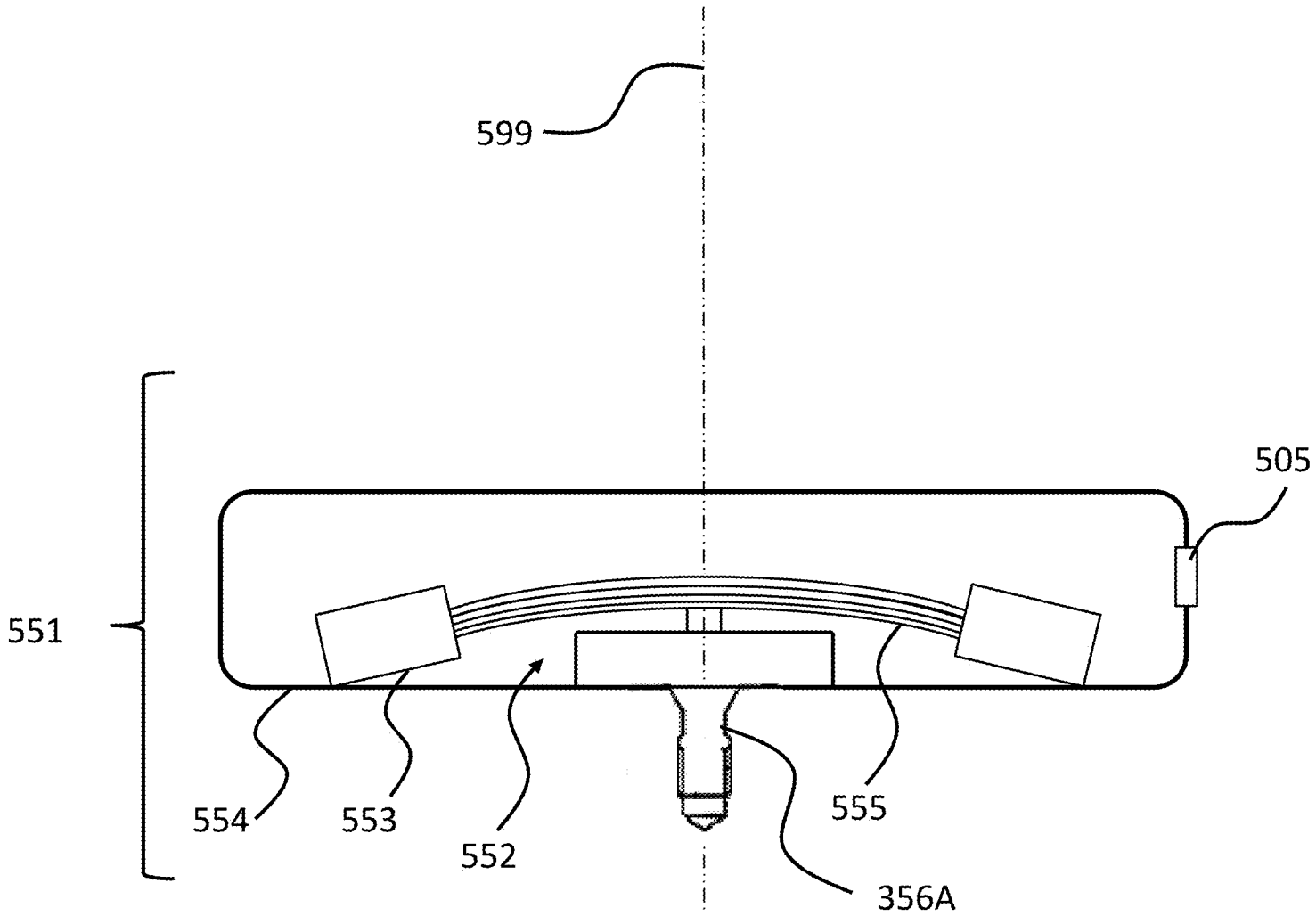
FIG. 7 is a schematic diagram of a cross-section of the exemplary implantable component of FIG. 5 in a failure mode.

FIG. 7 depicts an exemplary failure mode, where implantable subcomponent 551 (without bone fixture 541) prior to implantation into a recipient (and thus prior to attachment to the bone fixture 541) is dropped from a height of, for example, 30 cm, or from 1.2 meters, etc., onto a standard operating room floor or the like. The resulting deceleration causes the piezoelectric material 555, which is connected to the counterweight 553, to deform as seen in FIG. 7. This can break or otherwise plastically deform the piezoelectric material 555 (irrespective of whether the counterweight 553 contacts the housing walls, in some embodiments—indeed, in many embodiments, the piezoelectric material 555 will fail prior to the counterweights contacting the walls—thus, FIG. 7 is presented for purposes of conceptual illustration). The teachings detailed herein are directed towards avoiding such a scenario when associated with such decelerations and/or accelerations.

It is noted that while much of the disclosure herein is directed to a piezeoelectric transducer, the teachings herein can also be applicable to an electromagnetic transducer. Thus, any disclosure associated with one corresponds to a disclosure of such for the other, and vis-versa.

Still further, it is noted that in at least some exemplary embodiments of a transcutaneous bone conduction device utilizing a piezoelectric actuator, it may not necessarily be the case that FIG. 7 represents a scenario that results in, all the time, a failure mode. That is, in some embodiments, the scenario depicted in FIG. 7 does not result in a failure mode for all types of piezoelectric actuators. In at least some exemplary embodiments, it is the "bounce back" from the initial deflection and the momentum that carries the piezoelectric material past the at rest position in the other direction that causes a failure mode. That is, by way of example only and not by way of limitation, there can be, in some scenarios, a reaction such that after the piezoelectric material 555 is deformed as depicted in FIG. 7 (or, in some instances, approximately thereabouts, or, in some instances, more than that which usually results from activation of the transducer in even extreme operational scenarios), the piezoelectric material deforms oppositely towards its at rest position, but owing to the fact that it was deformed a substantial amount as depicted in FIG. 7 (or as just described), as the piezo material springs/bounces back to the "at rest" position, the counterweights 553 have momentum which causes the piezoelectric material to deform in the opposite direction, as depicted by way of example in FIG. 8. In fact, in some instances, even though the counterweights 553 specifically, or the piezoelectric actuator in general, do not contact the inside of the housing 554, as was the case in FIG. 7, this "flapping" can cause the piezoelectric material 555 to break or otherwise permanently deform in a manner that does not have utilitarian value. To be clear, this phenomenon can also be the case with respect to the scenario FIG. 7, except where the counterweight 553 did not contact the inside the housing 554. That is, in at least some exemplary embodiments, the flapping can cause permanent damage to the piezoelectric material 555 irrespective of whether or not the counterweights 553 or other components of the piezoelectric actuator contact the housing. In at least some exemplary embodiments of the teachings detailed herein and/or variations thereof, this permanent damage is prevented from occurring, or otherwise the likelihood of such permanent damage is reduced, some exemplary embodiments of achieving such prevention and/or reduction will now be described.

Figure 8:
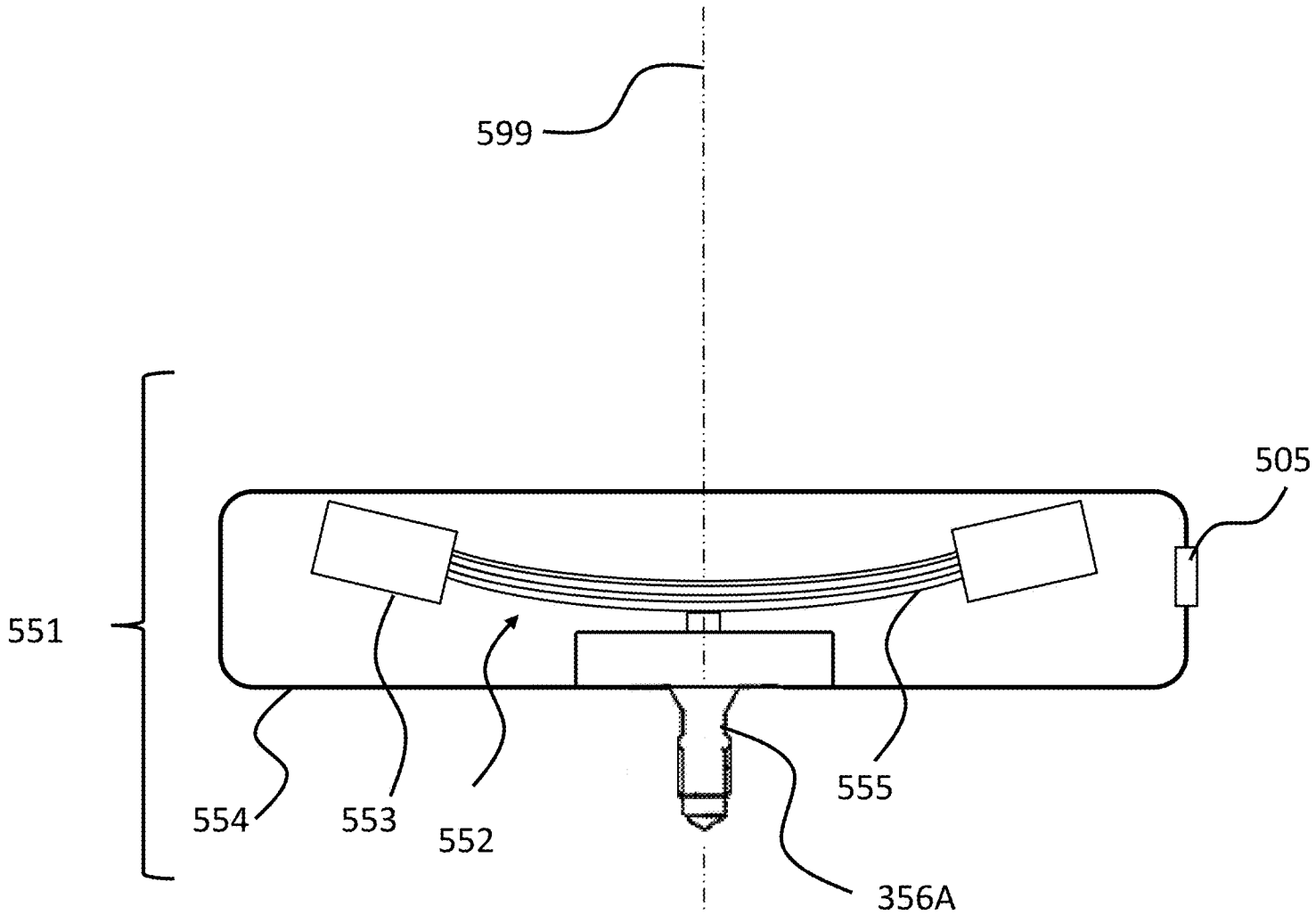
FIG. 8 is another schematic diagram of a cross-section of the exemplary implantable component of FIG. 5 in a failure mode.
Figure 9:
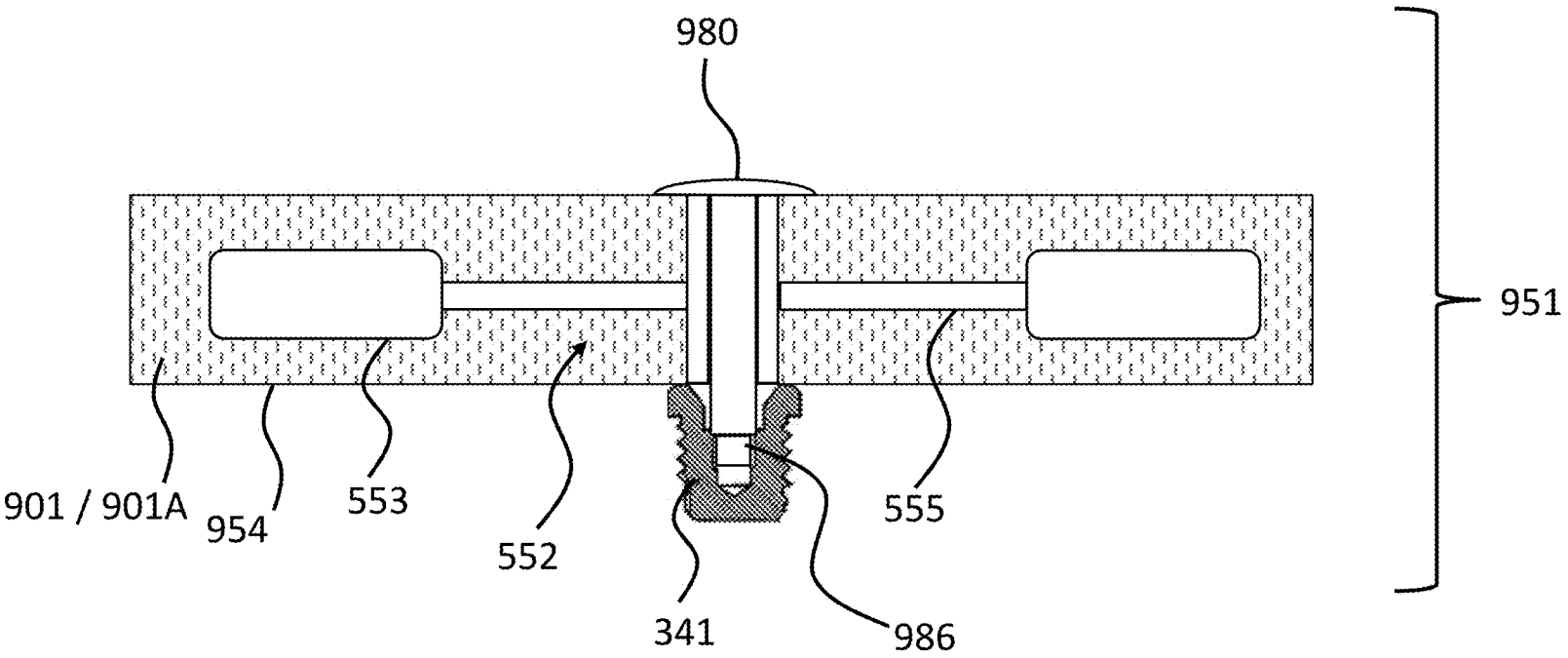
FIGS. 9-11 are schematic diagrams of a cross-section of an exemplary embodiment that prevents the failure mode conceptually represented in FIGS. 7 and/or 8.

FIG. 9 depicts an exemplary embodiment of an exemplary implantable subcomponent 951 having utilitarian value in that such can reduce the likelihood of the occurrence of (which includes eliminate the possibility of occurrence of) the failure mode associated with that depicted in FIG. 7 and/or FIG. 7 as modified and FIG. 8, and the variations detailed above. FIG. 9 depicts a cross-section through the geometric center of the subcomponent 951. Implantable subcomponent 951 includes a housing 954 that encases an actuator 552, which actuator includes a piezoelectric material 555 corresponding to that of FIG. 7, and a counterweight 553 that corresponds to the counterweight 553 of FIG. 7.

In the embodiment of FIG. 9, bolt 980 extends to the bone fixture 341 and is screwed therein during attachment of the housing 954 to the already implanted bone fixture 341 so as to establish the implantable component 951. In this regard, bolt 980 includes a male threaded end 986 that threads into female threads located within bone fixture 341. This operates as an effective jackscrew to pull the head of the bolt 980 downward towards the bone fixture 341, thus driving the housing 954 onto the fixture 341, thus securing the housing to the fixture 341. It is noted that in alternate embodiments, the bolt does not extend through he housing, but instead the threaded boss is attached to the outside of the housing, as seen in FIG. 4.

FIG. 9 also depicts that there exists a material 901/901A that at least substantially surrounds (which includes surrounds) the piezoelectric transducer 552. In an exemplary embodiment, the material 901A is a material that, when controlled or otherwise managed as herein by way of example only, results in the temporary prevention of the piezoelectric transducer from moving inside the housing while the housing is implanted in the recipient.

Figure 10:
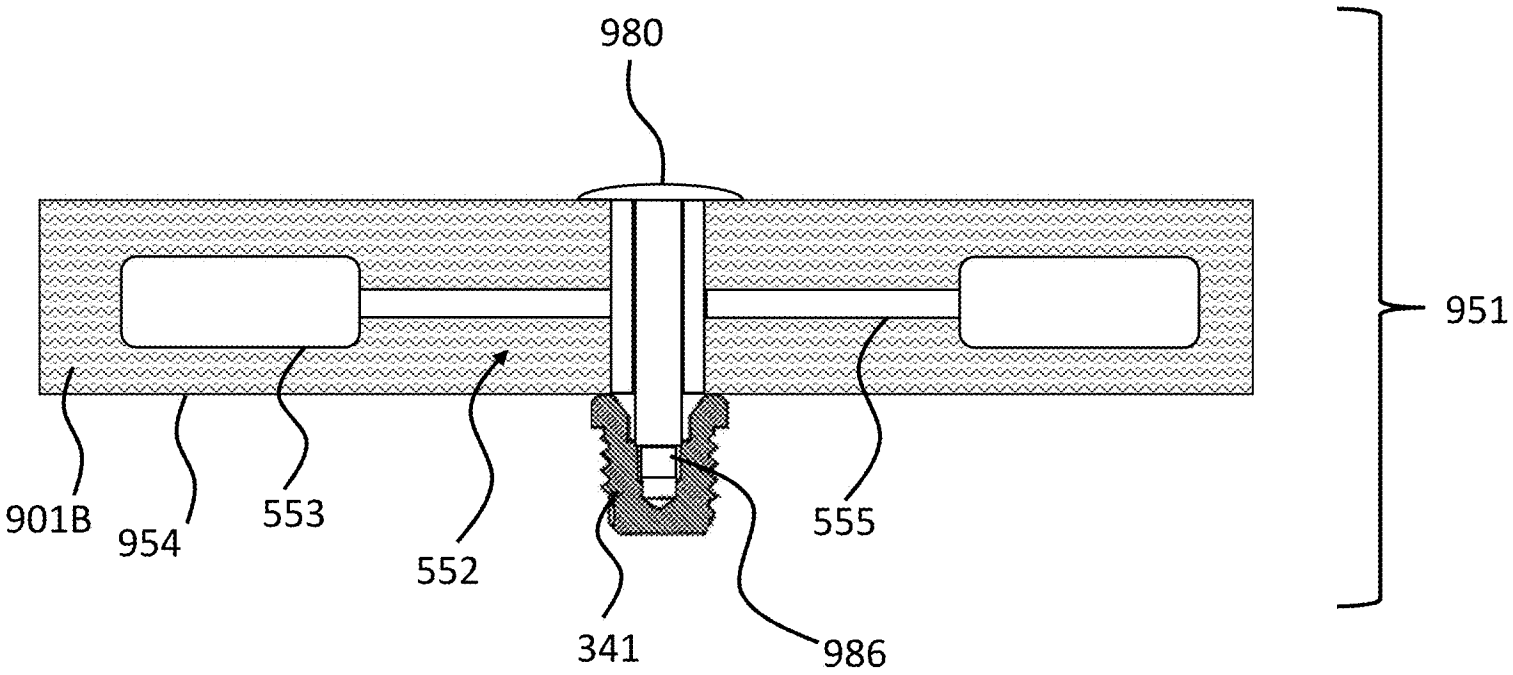

More specifically, in an exemplary embodiment, material 901A is a phase transitioning fluid which is solid in a first state (represented by the "A" of 901A) and is fluid in a second state (represented by the "B" of 901B of FIG. 10). Accordingly, in an exemplary embodiment, when the material 901 is in the first state, as represented in FIG. 9 by reference number 901A, the material is a solid, and thus prevents movement of the counterweights 553 and/or the piezoelectric material 555. When the material 901 is in the second state, as represented in FIG. 10 by reference number 901B, the material is a fluid, and thus permits movement of the counterweights 553 and where the piezoelectric material 555.

Accordingly, in an exemplary embodiment, there is an implantable component, such as implantable subcomponent 951 of FIG. 9, comprising a housing, such as housing 954, and a piezoelectric transducer, such as piezoelectric transducer 552, wherein the implantable component is configured to temporarily prevent the piezoelectric transducer from moving inside the housing while the housing is implanted in the recipient. Still further, in an exemplary embodiment, a phase transitioning material (material 901) is located in the housing 954, and the implantable component 951 is configured such that when the phase transitioning material is in a first phase, the piezoelectric transducer is prevented from moving inside the housing, and such that when the phase transitioning material is in a second phase, the piezoelectric transducer is enabled to move inside the housing.

In an exemplary embodiment, an electrical charge is provided to the material 901 that causes the material to transition from phase 901A to 901B, where the absence of this electrical charge causes the material to transition from phase 901B to phase 901A. Some additional details of this phenomenon will be described in greater detail below.

In an exemplary embodiment, the phase transitioning material can include electrically conductive components and/or metal particles, etc.

In an exemplary embodiment, when the material 901 corresponds to the state of 901B, in the fluid state, the material has a viscosity that substantially enables movement of the piezoelectric transducer so as to provide effective operation to evoke a bone conduction hearing percept. That is, in an exemplary embodiment, the fluid does not substantially or otherwise effectively impede the operation of the piezoelectric transducer. In an exemplary embodiment, a magnitude of the vibrational energy output of the implantable component with the fluid therein in the fluid state is at least about 99, 98, 97, 96, 95, 94, 93, 92, 91, 90, 89, 88, 87, 86, 85, 80, 75, 70, 65 or 60 percent that which would otherwise be the case in the absence of the fluid, all other things being equal.

In an exemplary embodiment, the configuration depicted in FIG. 9 (and at least some embodiments of any embodiment detailed herein), or, in some instances, any of the other embodiments detailed herein, prevents the piezoelectric material 555 from bending more than that which would be the case during the most extreme operation of the subcomponent to evoke a hearing percept that the subcomponent 951 was designed to accommodate. In an exemplary embodiment, with respect to angular movement of the counterweight 553 relative to that which is the case at rest, the arrangement of FIG. 9 prevents the counterweights 553 from moving, if any amount (some embodiments do not allow the counterweights to move at all, while others do) more than 1500%, 1250%, 1000%, 750%, 500%, 250%, 225%, 200%, 175%, 150%, 140%, 130%, 125%, 120%, 115%, 110%, 105%, 100%, 95%, 90%, 85%, 80%, 75%, 70%, 65%, 60%, 55%, 50%, 45%, 40%, 35%, 30%, 25%, 20%, 15%, 10%, 9%, 8%, 7%, 6%, 5%, 4%, 3%, 2%, 1%, 0.5%, 0.25%, 0.125%, 0.1%, 0.05%, 0.025%, 0.01%, or any value or range of values therebetween in 0.01% increments (e.g., 75.33% to 33.31%, 003%, etc.) beyond that which results from the subassembly 951 vibrating in response to a pure sine wave at 1000 Hz at 80 dB (as measured at the microphone of the external component when used therewith), such prevention of bending can be in one or both directions, and such prevention of bending can be measured from the at rest position to the maximum upswing or downswing, or the combined upswing and downswing (a full flap).

In an exemplary embodiment of FIG. 9 (and, in some exemplary embodiments of any embodiment detailed herein or variations thereof), the material, when in the state of 901A is such that the material limits movement of the counterweight 553 but still allows some movement of the counterweight 553. Thus, if the subcomponent 951 was subjected to a deceleration and/or acceleration corresponding to that which would otherwise result in the scenario depicted in FIG. 7 and/or that which results in the flapping, the counter mass 553 in general would be dampened by the material 901 when in the 901A state, thus preventing the counter mass 553 from moving a large amount/an amount that would cause the piezoelectric material 555 to break or otherwise plastically deform and/or preventing the counterweight from flapping, or at least limiting the amount of flapping that occurs, thus preventing the aforementioned failure modes. Hereinafter, the configuration utilizing apparatuses to prevent the counterweights and/or the piezoelectric material from moving when subjected to an acceleration and/or deceleration is sometimes referred to herein for purposes of linguistic economy as a shock-proof assembly.

With respect to the embodiment of FIG. 9, as is depicted therein, the interior of the housing is at least substantially filled with the phase transitioning material and other portions of the implantable component that are solid. In an exemplary embodiment, with respect to the interior of the housing, the phase transitioning material and other portions of the implantable component that are solid take up at least 50%, 55%, 60%, 65%, 70%, 75%, 80%, 81%, 82%, 83%, 84%, 85%, 86%, 87%, 88%, 89%, 90%, 91%, 92%, 93%, 94%, 95%, 96%, 97%, 98%, 99%, or 100% of the volume of the interior, or about any value or range of values therebetween in 0.1% increments (e.g., 88.4%, 93.2%, 80.7% to 100%, etc.). With respect to the embodiment of FIG. 9, as is depicted therein, at least about 50%, 55%, 60%, 65%, 70%, 75%, 80%, 81%, 82%, 83%, 84%, 85%, 86%, 87%, 88%, 89%, 90%, 91%, 92%, 93%, 94%, 95%, 96%, or 97% of the volume of the interior of the housing is taken up by the phase transitioning material, or about any value or range of values therebetween in 0.1% increments (e.g., 68.4%, 73.2%, 70.7% to 90.4%, etc.). In an exemplary embodiment, the housing has an interior volume of 3, 2.75, 2.5, 2.25, 2.0, 1.75, 1.5, 1.25, 1, 0.75, or 0.5 inches$^3$ or any value or range of values therebetween in 0.1 inches$^3$.

Figure 11:
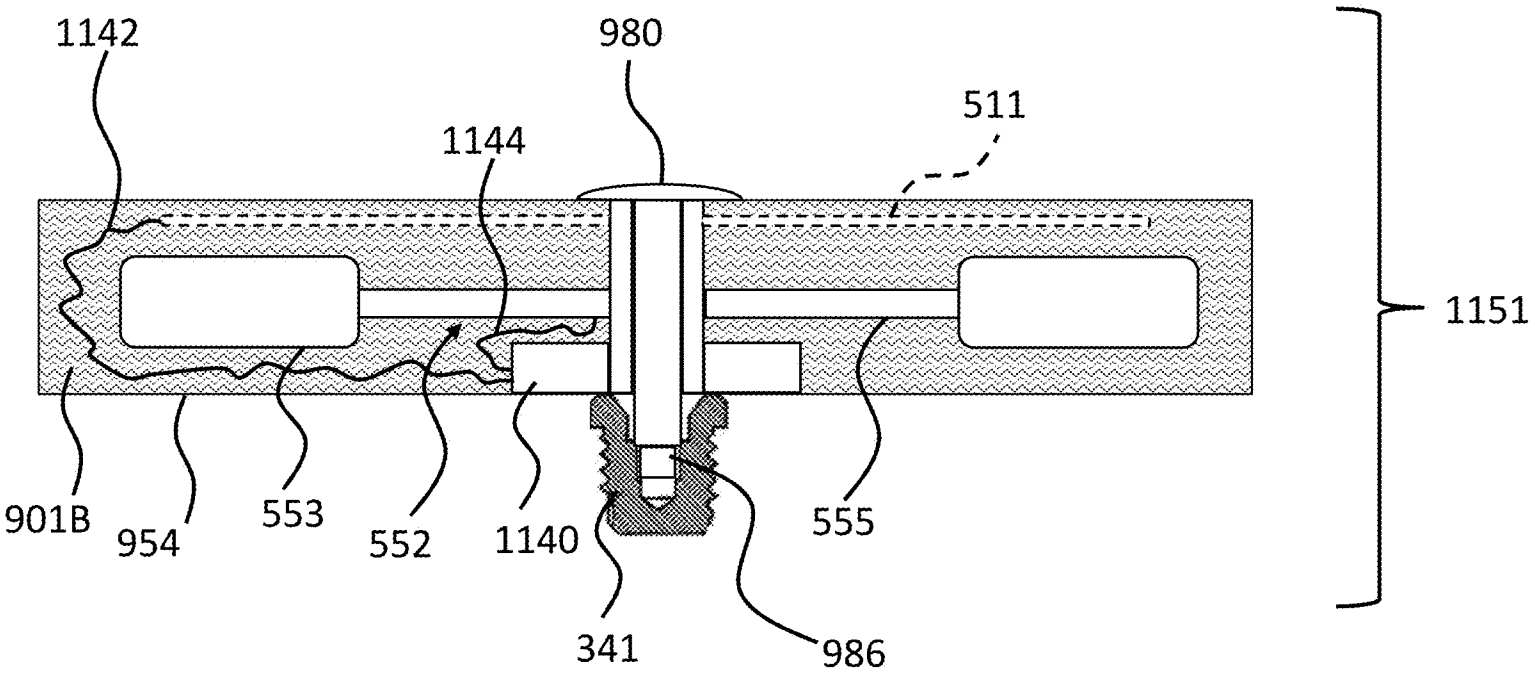

FIG. 11. presents an exemplary embodiment of an implantable subcomponent 1151 which corresponds to the implantable subcomponent 951, but with additional features. Particularly, as can be seen, this embodiment includes the RF coil 951 which is connected to a unit 1140 via a lead 1142. In an exemplary embodiment, the unit includes a doughnut-shaped housing that has a hole through which the bolt 980 and the housing walls establishing the through hole in the housing extend. That said, in an exemplary embodiment, the unit 1140 is located only on one side. Unit 1140 includes electronics (amplifier(s), resistors, capacitors, transformers, custom chips, etc.) that boost the signal from RF coil 511 (whether such be in the housing 954 or located remotely as in the embodiment of FIG. 4) that is received through lead 1142 (which, in an alternate embodiment, can extend from a feedthrough, such as the embodiment where the coil 511 is located outside housing 954), which boosted signal is provided to the piezoelectric material 555 via electrical lead 1144 in a controlled manner so as to cause the actuator to actuate, and thus output vibrations to evoke a hearing percept via bone conduction. In an exemplary embodiment, unit 1140 further includes a microprocessor that analyzes the received signal via 1142 and processes that signal according to a control algorithm such that the output from the unit 1140 causes the piezoelectric material 555 to deform in a manner that outputs a desired vibration.

In an exemplary embodiment, the control unit/electronics of the implanted component of the active transcutaneous bone conduction device include capacitor(s), resistor(s) diode(s), tuning capacitor(s), transformer(s), memory chip(s) inductor(s) for charge recovery and/or control chip(s)/special program chip(s) that control operation of the implanted transducer.

It is also noted that in an exemplary embodiment, there is no unit 1140 per se, and instead, lead 1142 is connected directly to the piezoelectric material 555.

Note that electronics can include the coil 511, or can exclude the coil 511, such as in the embodiment where the coil is located outside the housing 554.

In an exemplary embodiment of the subcomponent 1151, it can thus be seen that the subcomponent includes electronics in the housing. In an exemplary embodiment, the implantable component is configured such that when power is applied to the electronics, the piezoelectric transducer is enabled to move inside the housing, and such that when power is not applied to the electronics, the piezoelectric transducer is prevented from moving inside the housing. In this regard, by way of example only and not by way of limitation, when the external component is providing a signal via inductance transcutaneous communication to the coil 511, the coil 511 provides output via lead 1142 to the unit 1144 (again, either directly, or via a feedthrough), or, in some alternate embodiments, directly to the piezoelectric material, the material 901 transitions to the second state 901B, and thus the transducer is free to move in a manner so as to effectively produce vibrations to effectively evoke a hearing percept. Conversely, in an exemplary embodiment, the component is configured such that when power is not applied to the electronics, the piezoelectric transducer is prevented from moving, or is otherwise restrained from movement inside the housing. That is, in an exemplary embodiment, when there is no power to the electronics, the material 901 is in the first state in 901A.

It is briefly noted that in at least some exemplary embodiments, even though the subcomponent 1151 is not outputting vibrations (e.g., because there is no ambient sound that warrants vibration to evoke a bone conduction hearing percept (the recipient is in a silent environment), if the external component is in transcutaneous RF signal communication with the implanted component, and the external component is activated and waning to capture sound when such exists, and thus transduce the sound into the RF signal to be transcutaneously transmitted to the implanted component, the electronics of the subcomponent 1151 can be in a state in which they are receiving power. This is analogous to turning an electric guitar on and waiting to strum the strings. Thus, in such a scenario, even though the transducer is not vibrating, the piezoelectric transducer is enabled to move inside the housing. By way of example only and not by way of limitation, the material 901 would be in state 901B.

To be clear, in at least some exemplary embodiments, there is an actuator housing that is, for all intents and purposes, filled, other than the other solid components therein, with a phase transitioning fluid which is solid when no RF power is applied to the electronics in the housing, or otherwise when no RF power is applied to the coil that is implanted in the recipient that is in signal communication directly or indirectly with the actuator 552. Such can have utilitarian value with respect to scenarios where the subcomponent 1151 is being transported, is being stored for future use, or when the recipient of the subcomponent 1151 is in a situation where an impact to the subcomponent 1151 is more likely than that which otherwise would be the case. Because the counterweight 553 and/or the piezoelectric material 555 cannot move, or at least otherwise is prevented from moving in a manner that would cause damage to the piezoelectric material 555, the subcomponent 1151 is for all intents and purposes shockproof. It is thus safer to transport and otherwise protected against impact. In at least some exemplary embodiments, when the coil 511 is not receiving a signal from the external component, or otherwise when there is no RF signal that is being received, there is no power to the electronics therein, and thus the condition noted above is triggered. That said, in an alternate embodiment, the trigger can be the absence of a signal being received by the coil 511.

While the embodiments detailed above have been described in terms of a scenario where the electronics are on but the actuator is not vibrating because there is no sound, and thus the actuator is enabled to move (e.g., material 901 is in state 901B), in some alternate embodiments, even though the electronics are receiving power or otherwise the coil 511 is receiving an inductance signal from the external component (or some other component), if the electronics are not being utilized to cause the actuator to vibrate to output a bone conduction vibration to evoke a bone conduction hearing percept (e.g., there is no sound that is captured by the microphone/the sound is not sufficiently loud to evoke a hearing percept based on the settings of the prosthesis), the transducer 552 and still be in a condition where it is prevented from moving or otherwise limited from moving in a manner that could cause damage (e.g., prevented from flapping). Accordingly, in an exemplary embodiment, the subcomponent 1151 is configured such that when the coil 511 receives a signal that would cause the actuator 552 to actuate and thus vibrate to evoke a bone conduction hearing percept and/or when the electronics output a signal to the piezoelectric material 555 two cause the actuator 5522 actuate and thus evoke a bone conduction hearing percept, the transducer 552 is enabled to move whereas prior thereto, it was not enable to move or otherwise restrained from moving in accordance with the teachings detailed herein. That is, by way of exemplary scenario, during a first temporal period where an RF signal was being received from the external component by the coil 511 and/or when the electronics were powered, but such signal was not being utilized to evoke a bone conduction hearing percept using the subcomponent 1151, the material 901 is in the state of 901A, and during a second temporal period where an RF signal was being received from the external component and/or when the electronics were powered, and such signal was being utilized to evoke a bone conduction hearing percept, the material 901 is in the state of 901B. In an exemplary embodiment, a microprocessor located in the housing that is programmed utilizing firmware and/or software to evaluate the received signal can evaluate such to determine whether or not the signal is an "on/waiting" signal/a stand-by signal, or a signal that is meant to cause the transducer to vibrate and thus evoke a hearing percept. Upon an evaluation that the signal is a signal meant to cause the transducer to vibrate, by way of example, an electrical signal can be provided to the material 901 to transition the material from 901A to 901B, and thus permit the transducer 552 to operate.

To be clear, in an exemplary embodiment, the engagement and/or disengagement of the shock proofing as detailed herein can be initiated due to the presence or absence of the standby signal and/or due to the presence or absence of sound that would otherwise cause the transducer to vibrate to evoke a hearing percept.

Any device, system, and/or method that will enable the material 901 to be controlled such that the piezoelectric transducer 552 is variously restrained and unrestrained so as to shockproof and unshockproof the transducer can be utilized at least some embodiments.

Figure 12:
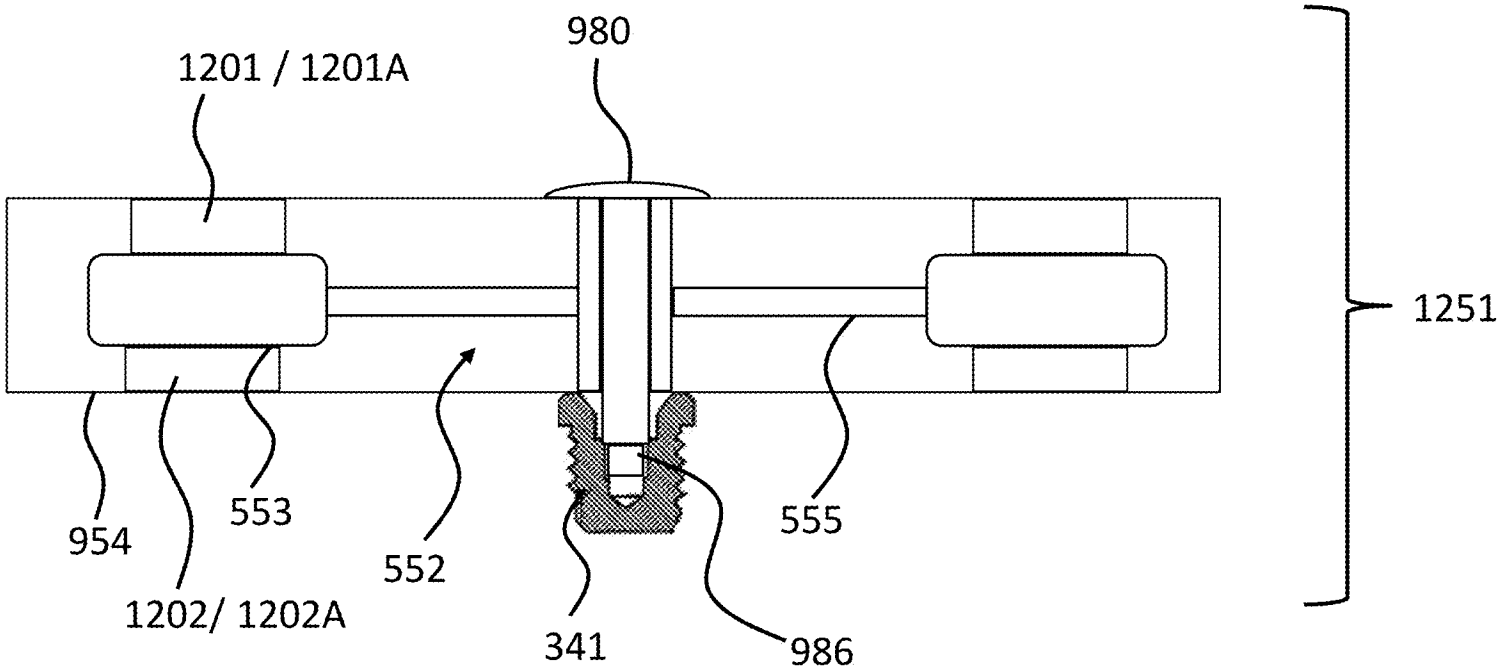
FIGS. 12-15 are schematic diagrams of a cross-section of an exemplary embodiment that prevents the failure mode conceptually represented in FIGS. 7 and/or 8.
Figure 14:
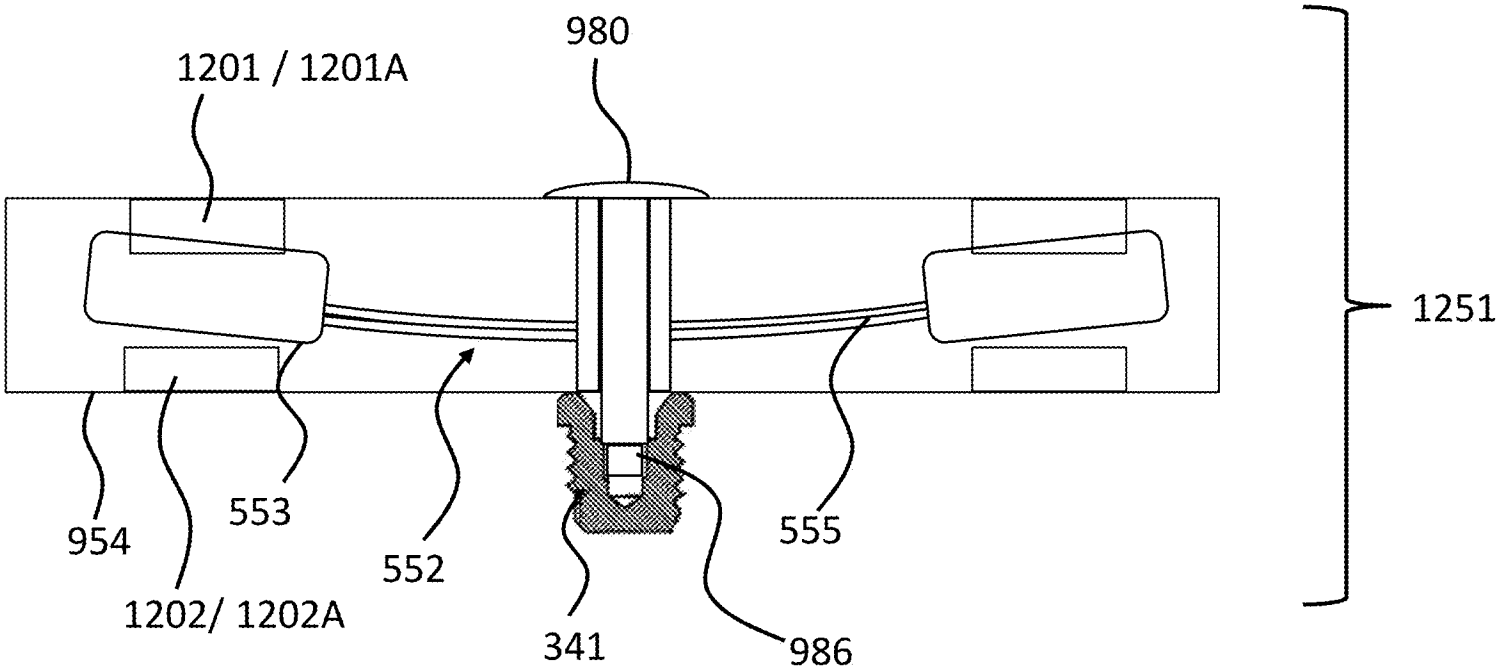
Figure 15:
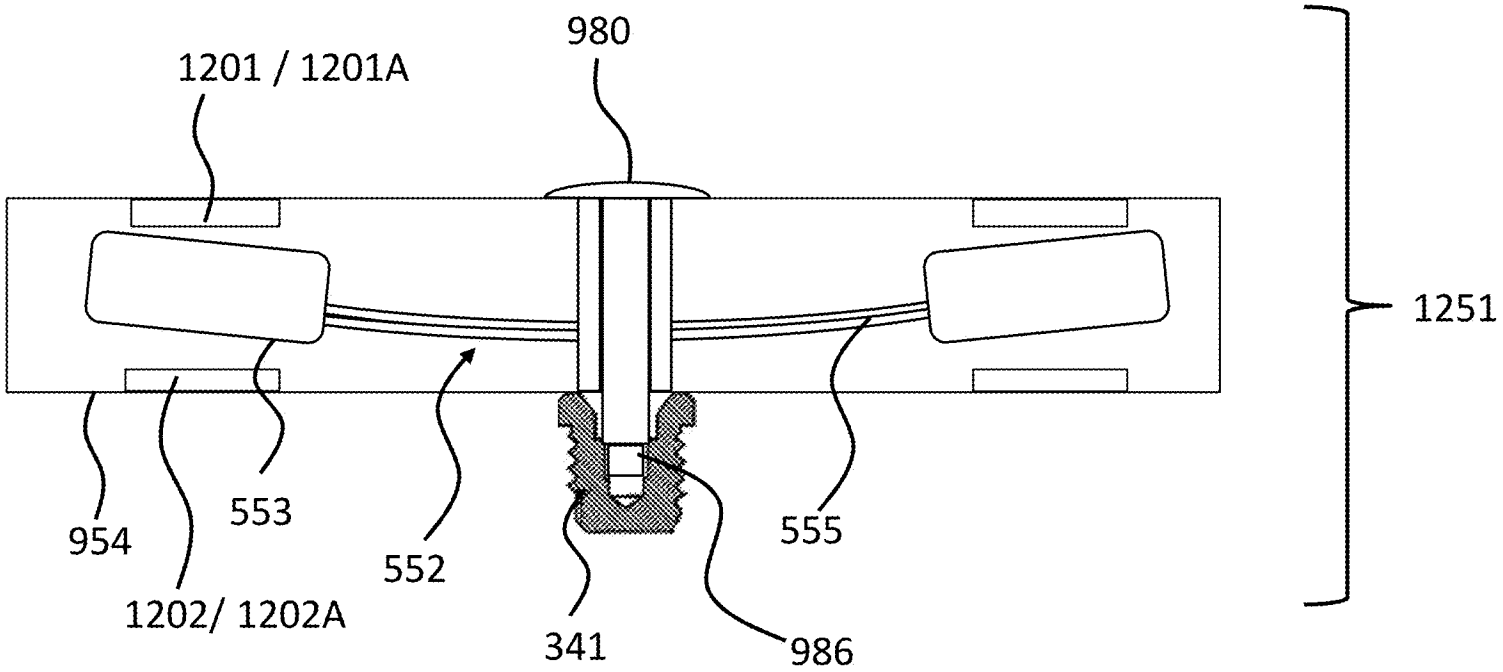

FIG. 12 depicts an alternate embodiment of an exemplary embodiment of an implantable component, subcomponent 1251. In this exemplary embodiment, a piezoelectric apparatus separate from the piezoelectric transducer 552 is located in the housing 954. Here, subcomponent 1251 (the implantable component) is configured such that the piezoelectric apparatus prevents the piezoelectric transducer from moving when in an expanded state and enables the piezoelectric transducer to move when in a contracted state. In this regard, as can be seen in FIG. 12, the piezoelectric apparatus includes piezoelectric material 1201 and 1202 in states 1201A and 1202A, as can be seen. These states correspond to an expanded state as can be seen, in the expanded state, the material 1201 and 1202 "clamp" or otherwise trap the counterweight 553 from the top and the bottom, thus preventing the counterweight from moving upwards or downwards. In an exemplary embodiment, the piezoelectric material and the counterweight is sized and dimensioned such that the piezoelectric material cannot fully expand to its fully expanded state, and thus there is always a pressure on the mass 553 when the piezoelectric material is in the expanded state. In an exemplary embodiment, the piezoelectric apparatus is positioned such that in the expanded state, the piezoelectric apparatus extends into an actuation area of the piezoelectric transducer, and such that in the contracted state, the piezoelectric apparatus is outside the actuation area. FIGS. 14 and 15 depict such an exemplary embodiment where the transducer has actuated to the top-most position designed for an operation to evoke a hearing percept via bone conduction (e.g., the amount that the actuator moves when exposed to the loudest sound to which the bone conduction device is configured to evoke a hearing percept for at the loudest perceived volume at the frequency that causes the transducer to move the most).

Briefly, in some embodiments, the geometric center of the transducer 552 is not located at the geometric center of the housing 954, but instead, is located closer to the bottom than the top. That said, in some alternate embodiments, the transducer 552 is located closer to the top and the bottom, while in some alternate embodiments, the transducer can be located at the geometric center. Any arrangement or placement of the transducer 552 that can enable a bone conduction hearing percept can be utilized in at least some exemplary embodiments. In any event, with respect to the embodiment of FIG. 12, it can be seen that elements 1201 are longer (taller) than elements 1202 owing to the fact that a greater distance is spanned by the elements 1201. That said, in an alternate embodiment, supports can be provided in the housing to move the elements 1201 downward such that elements 1201 and 1202 are identical with respect to the length direction. Still further, in an exemplary embodiment, identical length elements 1201 and 1202 can be utilized, where, when fully extended, element 1202 pushes the transducer-seismic mass assembly upwards until the element 1201 clamps down on to the transducer-sized mass assembly. In this exemplary embodiment, while the piezoelectric material 555 is bent, because the counterweight 553 is clamped by the elements 1201 and 1202, the transducer-seismic mass assembly is still shock proofed.

In an exemplary embodiment, the piezoelectric material can be a material such that when an electrical charge is applied thereto, the material contracts. Thus, in the embodiment of FIG. 12, when the material is in the states 1201A and 1202A, there is no electrical current being applied to the piezoelectric material, and thus the material expands. That said, in an alternate embodiment, the reverse can be the case.

Figure 13:
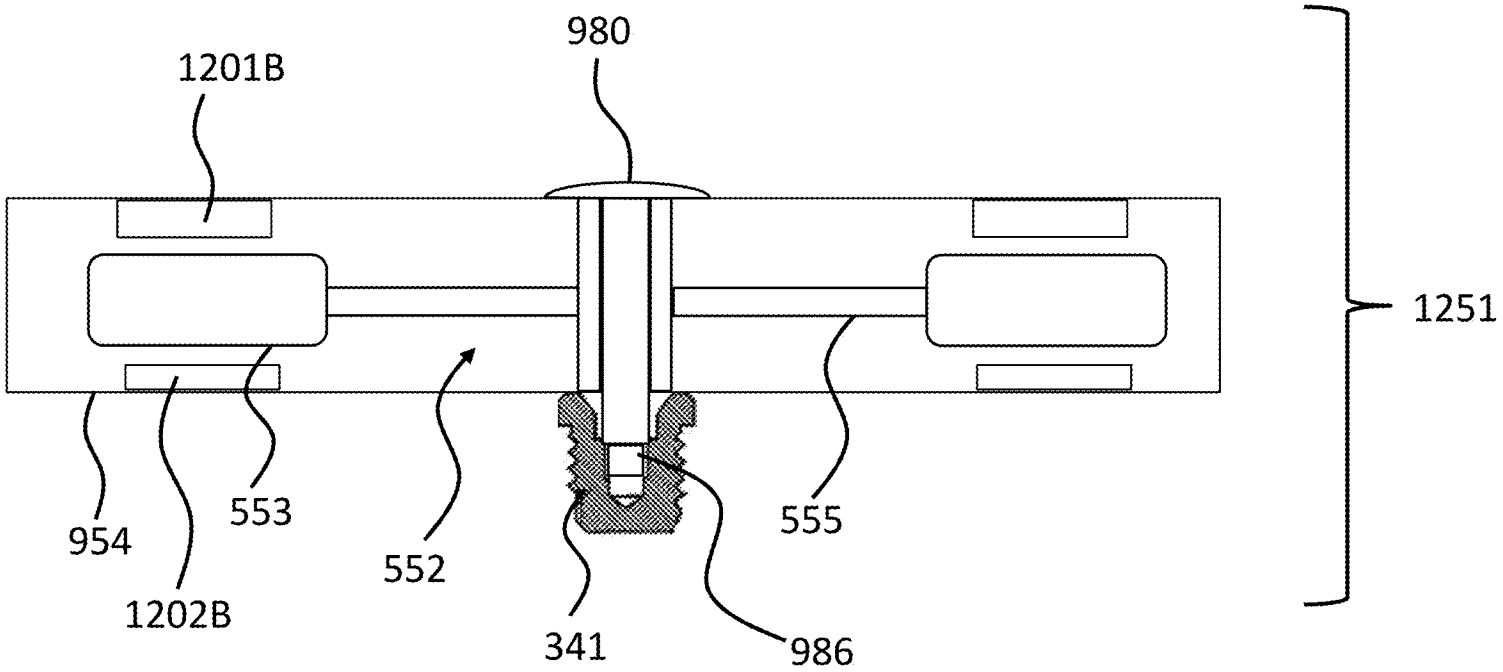

FIG. 13 depicts the exemplary scenario where the piezoelectric material 1201 and 1202 of the piezoelectric apparatus is in the contracted states (1201B and 1202B, respectively). As can be seen, this creates a space between the piezoelectric material 1201B and 1202B and the mass 553, thus permitting the mass to move upwards and downwards, which thus permits the transducer 552 to vibrate to evoke a bone conduction hearing percept. In this embodiment, where the piezoelectric material is a piezoelectric material that contracts when electrical signal is provided thereto, an electrical signal is being applied to the piezoelectric apparatus so as to contract the piezoelectric material. That said, in the alternate embodiment where the piezoelectric material expands when a current is applied thereto, in the embodiment depicted in FIG. 13, no electrical signal would be provided to the material (or a reduced signal would be applied, and vice versa with respect to a signal that expands when no electrical signal is applied thereto).

In view of the above, it can be seen that in some exemplary embodiments, there is a component (e.g., 951, 1251, etc.) of a bone conduction device, comprising a housing, such as housing 954, and a transducer-seismic mass assembly (e.g., the combination of the piezoelectric material 555 and the counterweights 553), wherein the component is configured to temporarily shock-proof the assembly. As will be briefly described in greater detail below, in an exemplary embodiment, the component is configured to automatically temporarily shockproof the assembly, including automatically doing so when the component is in an inactive state (and also automatically unshockproof the assembly, including automatically doing so when the component is in an active state).

As detailed above, some exemplary embodiments of shock-proofing entail preventing the transducer-seismic mass assembly from moving. Also as detailed above, some exemplary embodiments of shock-proofing entail limiting the movement of the transducer-seismic mass assembly. With regard to the latter, in at least some exemplary embodiments, a modicum of movement of the transducer-seismic mass assembly, even when subjected to very high acceleration and/or deceleration, will not permanently deleteriously impact the piezoelectric material 555. Thus, in at least some exemplary embodiments, it is not necessary to completely prevent the transducer-seismic mass assembly from moving.

As noted above, the transducer-seismic mass assembly 552 is configured to move upward and downward to generate vibrations (and thus evoke a bone conduction hearing percept). Further, in at least some embodiments, the implanted component is configured to temporarily at least limit movement (including preventing movement) of the transducer-seismic mass assembly 552 in at least one of the upward or downward directions (so far, limiting movement in both directions have been described), thereby temporarily shock-proofing the assembly.

Figure 16:
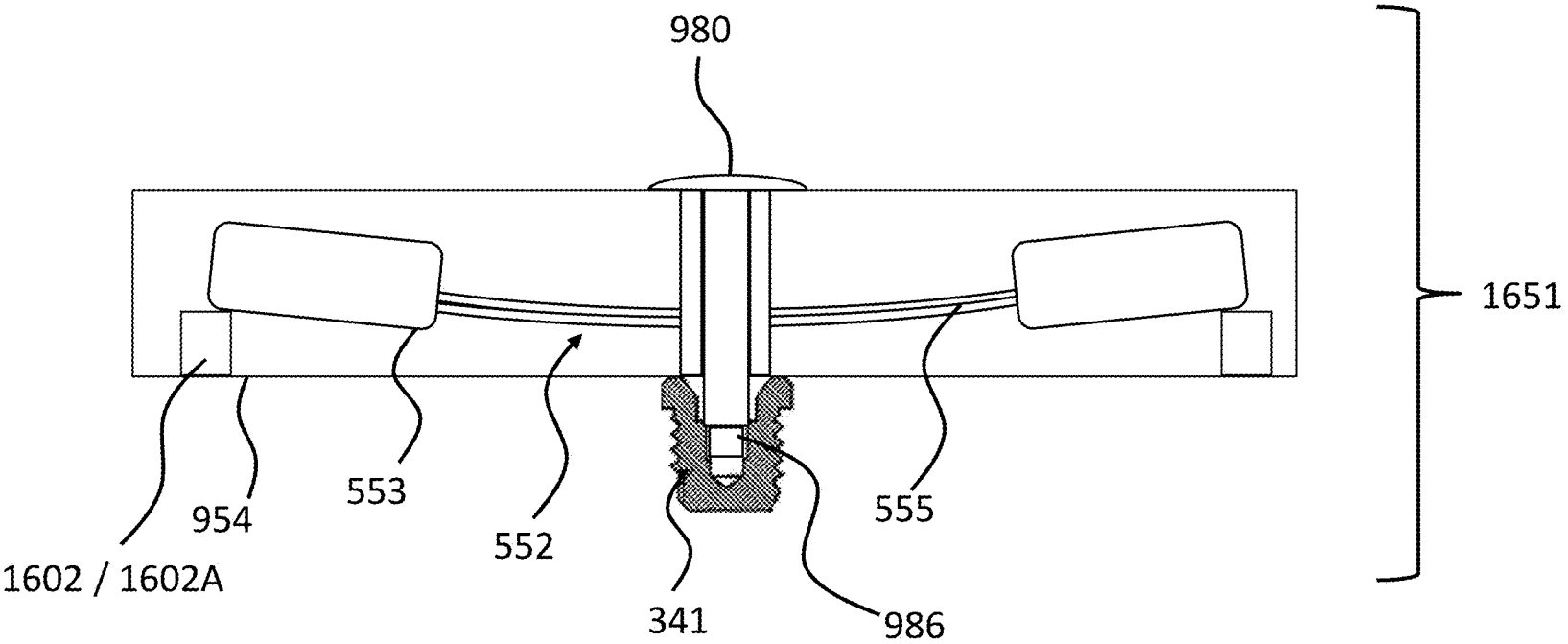
FIGS. 16-19 are various exemplary schematic diagrams of various cross-sections of various exemplary embodiments that prevent the failure mode conceptually represented in FIGS. 7 and 8.

FIG. 16 presents an alternate embodiment, where the piezoelectric stacks are only located on the bottom, and not on the top. In this regard, as can be seen, piezoelectric stack 1602 is located underneath the transducer-seismic mass assembly. FIG. 16 depicts piezoelectric stack 1602 in the extended state (1602A). As can be seen, the piezoelectric stack 1602A pushes the counterweight 553 of the transducer-seismic mass assembly upwards. In an exemplary embodiment, this movement is such that the piezoelectric material 555 is "prestressed" when in this position, and, therefore, the application of an acceleration/deceleration which would move the counterweight 553 upward more will be significantly higher than that which would be the case with respect to the piezoelectric transducer being located at the "at rest" position. With respect to at least embodiments where the "flapping" is the failure mode that causes the piezoelectric material 555 to fail, because there is no flapping, or otherwise the flapping is significantly reduced relative to that which would otherwise occur, the piezoelectric material 555 will not fail or otherwise the likelihood of failure is reduced, all other things being equal. Of course, acceleration/deceleration that would cause the counterweights 553 to move downward is accounted for because the counterweights 553 cannot move downward owing to the elements 1602 in the extended state (1602A).

Figure 17:
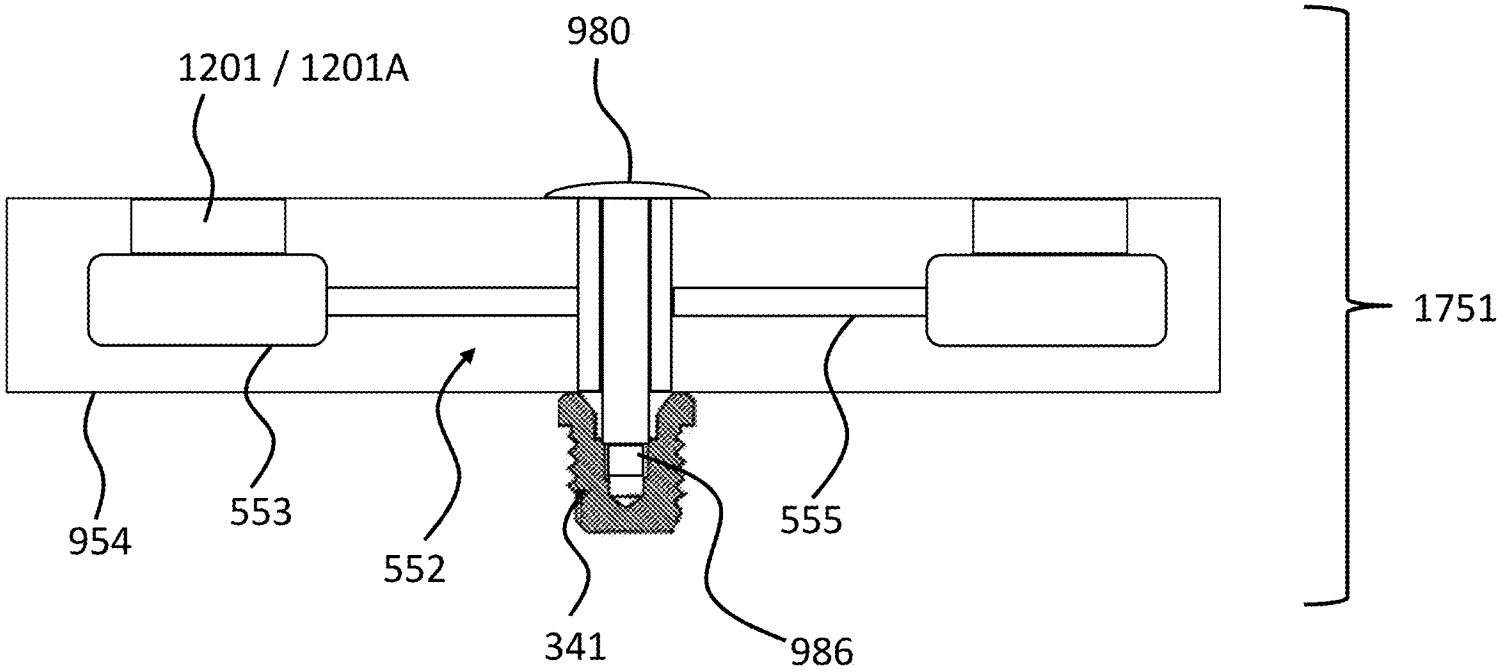

Also, with respect to flapping, it is noted that in at least some embodiments, the teachings herein are utilized to prevent a "full flap," and in some embodiments, only permit a "half flap." That is, in some exemplary embodiments, it is sufficient to prevent the piezoelectric material from bending one of downward or upward from the at-rest position. In this regard, by way of example only and not by way of limitation, FIG. 17 presents an exemplary subcomponent 1751, which includes only elements 1201, as can be seen, which are in their extended state (1201A). In the embodiment of FIG. 17 the piezoelectric transducer 552 will be able to half flap, but no more. That is, in an exemplary embodiment, a deceleration of the component 1751 with respect to a scenario where the component 1751 is traveling downward at the time of the deceleration will permit the transducer-seismic mass assembly to bend downwards and then recoil back up words, but then strike the elements 1201A, and thus only "half flap." In an exemplary embodiment, this is sufficient to shockproof the assembly. In some embodiments, when the elements 1201 are in their most extended state, the transducer-seismic mass assembly will be permitted to more than half flap but not fully flap. That is, in an exemplary embodiment, in the most extended state of the elements 1201 (state 1201A), there is still a space between the bottom surface of the elements 1201 and the top surface of the counterweight 553. This space is limited to that which will still enable shock-proofing by way of preventing a full flap. Note also that in an exemplary embodiment, this can also be the case with respect to the embodiments of FIG. 12 above, which includes elements 1201 and 1202—there can be spaces on top and on the bottom between the elements 1201 and 1202 and the respective counterweights. In such an embodiment, the magnitude of a flap would be reduced, but a full flap could exist (at least in the embodiment where the spaces between the counterweights 553 and the elements 1201 and 1202 are the same). In an exemplary embodiment, by reducing the magnitude of the full flap, shock-proofing can still be enabled even though there is a full flap.

Accordingly, in an exemplary embodiment, the shock-proofing can correspond to a device, system, and/or method of preventing a full flap of the piezoelectric transducer. In an exemplary embodiment, where a half flap constitutes movement only downward or upward, and more than a half flap (more than a 50% flap) constitutes full movement in one direction and partial/limited movement in the opposite direction (e.g., there are no elements that prevent movement in the downward direction, and in the fully extended state, the elements still allow for space between the elements and the counterweight with respect to the upward direction, and thus the transducer-seismic mass assembly can flap in an unrestricted manner in the downward direction, and can flap in the upward direction, but only a limited amount), the shock-proofing is configured to prevent the piezoelectric transducer from attaining a 100% flap, and, in some embodiments, the shock-proofing is configured to prevent the piezoelectric transducer from attaining a value of ABC flap, where ABC equals 90%, 85%, 80%, 75%, 70%, 69%, 68%, 67%, 66%, 65%, 64%, 63%, 62%, 61%, 60%, 59%, 58%, 57%, 56%, 55%, 54.5%, 54%, 53.5%, 53%, 52.5%, 52%, 51.5%, 51%, 50.5%, 50%, 49.5%, 49%, 48.5%, 48%, 47.5%, 47%, 46.5%, 46%, 45.5%, 45%, 44%, 43%, 42%, 41%, 40%, 39%, 38%, 37%, 36%, 35%, 34%, 33%, 32%, 31%, 30%, 25%, 20%, 15%, 14%, 13%, 12%, 11%, 10%, 9%, 8%, 7%, 6%, 5%, 4%, 3%, 2%, 1%, or any value or range of values therebetween in 0.1% increments.

In an exemplary embodiment, for a given acceleration and/or deceleration, all other things being equal, such given acceleration/deceleration results in a full flap that has a magnitude of MNO in the absence of the shock-proofing detailed herein, the shock-proofing limits the magnitude of a full flap to only 90%, 85%, 80%, 75%, 70%, 69%, 68%, 67%, 66%, 65%, 64%, 63%, 62%, 61%, 60%, 59%, 58%, 57%, 56%, 55%, 54.5%, 54%, 53.5%, 53%, 52.5%, 52%, 51.5%, 51%, 50.5%, 50%, 49.5%, 49%, 48.5%, 48%, 47.5%, 47%, 46.5%, 46%, 45.5%, 45%, 44%, 43%, 42%, 41%, 40%, 39%, 38%, 37%, 36%, 35%, 34%, 33%, 32%, 31%, 30%, 25%, 20%, 15%, 14%, 13%, 12%, 11%, 10%, 9%, 8%, 7%, 6%, 5%, 4%, 3%, 2%, 1% of MNO, or any value or range of values therebetween in 0.1% increments of a full flap for that given acceleration/deceleration.

It is also noted that in an exemplary embodiment, the flapping in both directions can be limited, but by different amount in each direction. By way of example only and not by way of limitation, the amount of flapping in the upward direction can be limited to 80% of that which would otherwise be the case in the absence of the shock-proofing, and the amount of flapping in the downward direction can be limited to 60% of that which would otherwise be the case in the absence of the shock-proofing. Accordingly, in an exemplary embodiment, with respect to an upward flap portion and a downward flap portion, embodiments detailed herein can limit the amount of upward flap portion to the ABC values detailed above, and/or can limit the downward flap portion to the ABC values detailed above.

In view of the fact that at least some of the teachings detailed herein can be utilized to shockproof an implanted component implanted in the recipient, in at least some exemplary embodiments, it is to be understood that the implantable component is configured to temporarily shock-proof the assembly while implanted inside a recipient. That said, in some alternate embodiments, the temporary shock-proofing is only utilized prior to implantation of the component into the recipient, and/or can only be enabled while the component is outside of a recipient or otherwise prior to the time that the component is attached to the recipient. Still further, in an exemplary embodiment, the shock-proofing detailed herein can be such that the shock-proofing only occurs one way. That is, once the component is taken out of the shockproof mode, it cannot be later placed into the shockproof mode.

Note also that while the embodiments detailed herein have generally focused on an implantable component of an active transcutaneous bone conduction device, in some alternate embodiments, the teachings detailed herein are also applicable to the external component of a passive transcutaneous bone conduction device as well, as well as the removable component of a percutaneous bone conduction device. Indeed, in at least some exemplary embodiments, the teachings detailed herein are applicable to any piezoelectric transducer that could otherwise experience the failure mode detailed herein.

Consistent with the embodiments detailed above, in at least some exemplary embodiments, the shock-proofing is achieved at least in part because the implantable component includes a material that reacts to at least one of the presence or absence of an electrical current, and, if an electrical current is present, the material is in a first state (e.g., the material 901 is in the solid state, the material 1201 is in the expanded state, etc.), and if the electrical current is absent, the material is in a second state (e.g., the material 901 is in the fluid state, the material 1201 is in the retracted state, etc.). In at least some exemplary embodiments, the component is configured such that one of the transducer-seismic mass assembly is shock-proofed when the material is in the first state, or the transducer-seismic mass assembly is shock-proofed when the material is in the second state. Also, consistent with the teachings detailed above, in some embodiments, the material is a phase transitioning material, the first state is a solid phase, the second state is a fluid phase and the transducer-seismic mass assembly is shock-proofed when the material is in the first state. Still further, in some embodiments, the material is a piezoelectric material, the first state is one of an expanded state or a contracted state and the second state is the other of the expanded state or the contracted state.

It is noted that the embodiments of FIGS. 9-10 on the one hand, and 12-13 on the other are not mutually exclusive (as will be noted below, any embodiment and/or any feature of any embodiment can be combined with any one or more other features of any other embodiments, provided that such is enabled by the art). That is, in an exemplary embodiment, the implantable component includes in the housing a phase-transitioning material as disclosed herein (as modified to enable the combination) and the implantable component also includes in the housing the piezoelectric apparatus that is delta to the piezoelectric material of the transducer-seismic mass assembly. This can provide a safety factor in case one or the other systems fail, along with a combined increased resistance to movement or further movement owing to the fact that there are two substances that are present.

In an exemplary embodiment, the shock-proof resulting from the configurations detailed herein, when engaged/when in shocked-proof configuration, prevents tips of the counterweight 553 (the portions furthest from the longitudinal axis of the implantable subcomponent) from moving more than 0.001 degrees, 0.002, 0.003, 0.004, 0.005, 0.006, 0.007, 0.008. 0.009, 0.01, 0.011, 0.012, 0.013, 0.014, 0.015, 0.016, 0.017, 0.018, 0.019, 0.20, 0.021, 0.022, 0.023, 0.024, 0.025, 0.026, 0.027, 0.028, 0.029, 0.030, 0.035, 0.04, 0.045, 0.05, 0.055, 0.06, 0.065, 0.07, 0.08, 0.09, 0.1, 0.11, 0.12, 0.13, 0.14, 0.15, 0.175, 0.2, 0.25, 0.3, 0.35, 0.4, 0.45, or 0.5 degrees, or any value or range of values therebetween in 0.001° increments from the at rest position (in one or both directions—as will be detailed below, in some embodiments, the transducer is not restrained on one direction of movement, but limited from moving in another direction (such as by no more than the aforementioned amounts)). Of course, in some embodiments, the teachings detailed herein prevent the counterweights from moving entirely, or at least the tips thereof from moving entirely.

In an exemplary embodiment, during normal operation (or, in some alternate embodiments, during operation with the sine wave detailed herein), the counterweight 553 moves at most 1, 2, 3, 4, 5, 6, or 7 micrometers, with a 2 cm arm distance. In an exemplary embodiment, the movements are scaled linearly with increasing arm distance, and thus the above and below noted movement prevention values are scaled linearly as well.

In some embodiments, the configurations detailed herein prevent the counterweight 553 from moving more than but 10 micrometers with respect to an oscillatory movement of the actuator, although in other exemplary embodiments, the configurations herein prevent the counterweight 553 from moving by an amount less 5 micrometers while in other embodiments, the configurations prevent the counterweights 553 from moving more than 1 or 2 or 3 or 4 micrometers. In an exemplary embodiment, the shock-proof apparatuses detailed herein, when engaged, prevent tips of the counterweight 553 (the portions furthest from the longitudinal axis of the implantable subcomponent) from moving more than 50 nm, 60 nm, 70 nm, 80 nm, 90 nm, 100 nm, 110 nm, 120 nm, 130 nm, 150 nm, 200 nm, 250 nm, 300 nm, 350 nm, 400 nm, 450 nm, 500 nm, 550 nm, 600 nm, 650 nm, 700 nm, 750 nm, 800 nm, 850 nm, 900 nm, 950 nm, 1 micrometer, 1.2, 1.3, 1.4, 1.5, 1.6, 1.7, 1.8, 1.9 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, or 100 micrometers from the static at rest position, or any value or range of values therebetween in 10 nm increments (in one or both directions—as will be detailed below, in some embodiments, the transducer is not restrained on one direction of movement, but limited from moving in another direction (such as by no more than the aforementioned amounts)).

It is noted that material 901 is a fluid in one state/phase (phase 901B). Thus, in an exemplary embodiment, there is a component of a bone conduction device (subcomponent 951, for example), comprising a housing and a piezoelectric transducer (the embodiments of FIGS. 9 and 10). As detailed above, the implantable component (subcomponent 951) includes a fluid located therein (material 901 when in state 901B), and the component is configured to control the fluid to temporarily at least limit movement of the piezoelectric transducer relative to that which is the case in the absence of the fluid. That is, the limitation of movement is relative to that, all other things being equal, which would exist if the embodiments of FIGS. 9 and 10 existed without the fluid. In an exemplary embodiment, the amount of limitation of movement results in a reduction of the movement of the piezoelectric transducer at a given location (e.g., the point that moves the most during normal operation, or any other consistent, apples to apples, point) at least 50, 60, 70, 80, 90, 100, 125, 150, 175, 200, 250, 300, 350, 400, 450, 500, 550, 600, 650, 700, 750, 800, 900, 1000, 1250, 1500, 1750, 2000, 2500, 3000, 3500, 4000, 4500, 5000, 6000, 7000, 8000, 9000, 10000, 12500, 15000, 17500, 20000, 25000, 30000, 40000, 50000, 60000, 70000, 80000, 90000, or 1000000 percent, or any value or range of values therebetween in 1% increments, for a given acceleration and/or deceleration, all other things being equal.

As noted above, the fluid within the housing that is utilized to at least limit movement of the piezoelectric transducer can be a phase transitioning fluid that transitions from a fluid to a solid when the fluid is controlled to temporarily at least limit of the piezoelectric transducer. It is noted that even in the solid phase, in at least some exemplary embodiments, permit some movement of the transducer-seismic mass assembly, and thus the piezoelectric transducer, although such will limit the amount of movement. With respect to the solid phase, in at least some exemplary embodiments, the solid can be a solid that can be at least partially initially compressed, thus permitting the piezoelectric transducer to move. However, in at least some exemplary embodiments, the solid phase is such that the confession only occurs during an initial period of compression, and further movement of, for example, the counterweight 553 into the solid is resisted. That is, as the solid is further compressed, it resists further compression, thus ultimately preventing the piezoelectric transducer from moving any further. By way of example only and not by way of limitation, in an exemplary embodiment, the resistance to compression can increase geometrically, exponentially or logarithmically. That said, in some exemplary embodiments, the resistance to compression can increase linearly. Any configuration that will permit some movement of the piezoelectric transducer but limit full movement of the piezoelectric transducer relative to that which be the case in the absence of the shock-proofing features detailed herein can be utilized at least some exemplary embodiments.

Note further that while the embodiments detailed above have been directed towards the utilization of a material such as material 901 that is in direct contact with transducer-seismic mass assembly, and, in at least some exemplary embodiments, such is the case at all times, in some alternate embodiments, the shock-proofing apparatuses only sometimes in contact with the transducer-seismic mass assembly. As will be described in greater detail below, in an exemplary embodiments where the fluid is controlled to achieve the shock-proofing, bladders are alternately filled and unfilled in a manner analogous to the embodiment of FIGS. 12 and 13 so as to respectively place the component into and out of the shock-proof mode. Indeed, by way of conceptual explanation only, instead of being considered piezoelectric components, elements 1201 and 1202 instead be treated as bladders that, when the fluid is controlled, are respectively filled (1201A and 1202A) and partially drained (1201B and 1202B). Again, some additional details of this will be described in greater detail below. However, it is briefly noted that in some embodiments, the implantable component is configured to transfer the fluid from a first portion of the component to a second portion of the component, thereby temporarily at least limiting movement of the piezoelectric transducer. In this regard, there can be pumps that pump the fluid into and out of the representative bladders of FIGS. 12 and 13.

The bladders can be considered a species of the functional genus balloon apparatus, and thus, in an exemplary embodiment, a balloon apparatus is located in the housing, and the implant is configured to vary an amount of the fluid located in the balloon apparatus, thereby at least partially inflating and partially deflating a balloon of the balloon apparatus, wherein the volume of the balloon is greater when the balloon is at least partially inflated wherein the movement of the piezoelectric transducer is limited when the balloon apparatus is at least partially inflated.

Briefly, it is noted that in at least some exemplary embodiments, the fluid detailed herein is a magnetorestrictive fluid.

While the embodiments of FIGS. 9 and 10 have generally focused on a phase transitioning fluid that transitions from a fluid to a solid, in some alternate embodiments, the fluid is always a fluid, but the viscosity changes from a first state to a second state. In this regard, in an exemplary embodiment, material 901 is a fluid that has a variable viscosity, wherein the transducer-seismic mass assembly is exposed to the fluid. In an exemplary embodiment, the fluid can be controlled so as to adjust the viscosity of the fluid. By way of example only and not by way of limitation, when the fluid is in state 901A, the viscosity is high, thus at least limiting the ability of the transducer-seismic mass assembly to move. Still further by way of example only and not by way of limitation, when the fluid is in state 901B, the viscosity is low, thus permitting the transducer-seismic mass assembly to move much more freely, and, in at least some exemplary embodiments, permitting the transducer-seismic mass assembly to move in a manner that can enable vibrations to be produced thereby so as to evoke a bone conduction hearing percept.

In an exemplary embodiment, the viscosity of the fluid can be controlled or otherwise changed through the application and/or the removal of an electric current thereto. By way of example only and not by way of limitation, the fluid can be a fluid that increases viscosity significantly when exposed to an electrical current. Conversely, by way of example only and not by way of limitation, the fluid can be a fluid that decreases viscosity significantly when exposed to an electrical current. The principles of control of the electrical current that is applied to the fluid can correspond to those with respect to the piezoelectric material 1201 and 1202 detailed above, and can also correspond to other regimes as well. Any control regime that will enable viscosity of the fluid to increase and/or decrease in a controlled manner can be utilized in at least some exemplary embodiments.

Note further, in an exemplary embodiment, movement of the transducer-seismic mass assembly in a vibratory manner reduces the viscosity of the fluid to a first value, lack of movement of the transducer-seismic mass assembly in the vibratory manner increases the viscosity of the fluid to a second value, and the transducer-seismic mass assembly is shock-proofed when the fluid has the viscosity of the second value. In this regard, in an exemplary embodiment, the implantable component can be configured such that upon initially receiving a signal from the external component, or otherwise upon activation (it is noted that any disclosure herein of the receipt of a transcutaneous signal which activates or deactivates the shock-proofing detailed herein also corresponds to a disclosure of the turning on of a passive transcutaneous bone conduction device and a percutaneous bone conduction device, and, any disclosure herein of the activation of or otherwise the action of providing power to the electronics of the implantable component also corresponds to such with respect to the electronics of the passive transcutaneous bone conduction device and a percutaneous bone conduction device, where such electronics can be activated by the on switch or one signal as opposed to the RF signal for the active transcutaneous bone conduction device), the transducer begins to move, albeit relatively very slowly at first, because the fluid is in the high viscosity state. The movement will quicken or otherwise increase in magnitude as the viscosity decreases owing to the fact that the fluid is a fluid that decreases viscosity when subjected to a body moving therethrough (in this case, the transducer-seismic mass assembly). As the transducer moves more and more, the viscosity decreases more and more, until the viscosity has decreased to a point where effective bone conduction hearing percept evocation can be achieved. At this point (and, in at least some embodiments, before this point), the implantable component is no longer in the shock-proofed state, as opposed to the case which existed when the viscosity of the fluid was relatively high/prior to movement of the transducer-seismic mass assembly). Thus, the transducer-seismic mass assembly can be utilized to control viscosity of the fluid, and thus alternately place take the implantable component out of and place the implantable component into the shock-proofing regime. It is noted that in some embodiments, the bone conduction device is configured such that the transducer can move irrespective of whether or not there is a sound present. This can have utilitarian value with respect to the initial movements that are required to reduce the viscosity of the fluid to enable effective bone conduction hearing evocation. In this regard, in an exemplary embodiment, the movements can be controlled such that the movements occur only at relatively low frequencies that do not evoke a hearing percept/do not evoke a distracting hearing percept and/or otherwise occur with such a low magnitude that a hearing percept is not involved, or even if such is a vote, such is not distracting. It is further noted that with respect to periods of silence, the bone conduction device can periodically actuate the actuator so as to maintain the low viscosity.

While the embodiments detailed above vis-à-vis utilizing movement of the transducer-seismic mass assembly have been described to change the viscosity of the fluid while the fluid remains a fluid, in some alternate embodiments, the movement of the transducer-sized mass assembly can be utilized to transition the solid to a fluid, and vice versa, under the same principle, providing that such a fluid can be obtained that can enable the teachings detailed herein and/or variations thereof. By way of brief example, in an exemplary embodiment, material 901 is in the state 901A, which corresponds to a solid, and, without being bound by theory, the energizement of the piezoelectric transducer will cause a force to be applied to the solid material, which force will ultimately be an alternating force owing to the operation of the piezoelectric transducer. This alternating force can, in some embodiments, induce a state change in the solid to transform the material into a fluid, or at least begin the inducement of a state change, where further movement further changes the state from the solid to the liquid. It is noted that in at least some exemplary embodiments, it is the movement of the transducer-seismic mass assembly that results in the change of state from the solid to the fluid. Any utilization of the transducer that can enable the solid to be transitioned to a fluid and vice versa, as well as that which can enable the fluid to increase or decrease with respect to viscosity, can be utilized at least some exemplary embodiments.

In an exemplary embodiment, the fluid is an electrorheological fluid. In an exemplary embodiment, the fluid comprises a suspension of fine non-conducting but electrically active particles (e.g., up to 50 micrometers diameter) in an electrically insulating fluid, and the apparent viscosity of these fluids changes reversibly by an order of up to 100,000 in response to an electric field. In an exemplary embodiment the fluid and the implant is configured such that the fluid can go from the consistency of a liquid to that of a gel, and back. In some embodiments, the response time of the transition can be on the order of milliseconds.

It is noted that in some embodiments, the electromagnetic fields generated by the external component inductance coil can be sufficient to transition the fluid. Such can have utilitarian value with respect to embodiments where the coil is located with the housing in which the transducer is located. That said, with respect to embodiments where the coil is remote from the housing in which the transducer is located, in an exemplary embodiment, the external component can be temporarily placed onto the skin at the location over the housing that contains the transducer, and the inductance coil from the external component can be utilized to generate a magnetic field that impacts the fluid.

In an exemplary embodiment, the fluid is a magnetorheological fluid. In an exemplary embodiment, the fluid is a so-called smart fluid in a carrier fluid, such as by way of example, a biocompatible oil. When subjected to a magnetic field, the fluid increases its apparent viscosity, to the point of becoming a viscoelastic solid. In some embodiments, the yield stress of the fluid when in its active ("on") state can be controlled very accurately by varying the magnetic field intensity. In some embodiments, the fluid's ability to transmit force can be controlled with a magnetic field.

It is noted that in at least some exemplary embodiments, an electromagnetic field generator can be located within the housing, so as to generate a magnetic field that transitions the fluid as detailed above. In an exemplary embodiment, in at least some examples, the magnetic field can be generated by the external component that is placed over the housing, which magnet holds the external component to a magnet located in the housing. In an exemplary embodiment, the magnetic field generator can be located in the external component.

In an exemplary embodiment, the electromagnetic field generator can be a magnet alone and/or in combination with coils of the like, which generates the electromagnetic field in the absence of another component, such as the external device or vice versa, or which generates the electromagnetic field in the absence of a signal from the external component, or vice versa, etc.

Indeed, in an exemplary embodiment, any utilization of the movement of the transducer that can cause a transition of the component from the shockproof state to the non-shockproof state can be utilized at least some exemplary embodiments. In this regard, by way of example only and not by way of limitation, with respect to the features detailed herein that utilize the fluid bladders, such can be bladders that initially are tall and thin, and are such in their normal, steady state configuration, but upon the repeated movements of the actuator, the bladders are pushed downward and made short and fat, thus providing space for the full movements of the piezoelectric transducer so as to evoke a hearing percept.

Note also that in at least some exemplary embodiments, the piezoelectric transducer can be controlled so as to have a "swing" which is greater than that which occurs during normal operation or even the most extreme operation of the piezoelectric transducer to evoke a hearing percept. In this regard, the transducer can be placed into an initial mode where the swing is, for example, 50% greater than that which would otherwise exist in the most extreme case, to "beat down" the bladders to a point sufficiently below the location that would correspond to the greatest "swing" during the most extreme operation of the bone conduction device, or at least during the normal operation of the bone conduction device. After beating down the bladders to this point, the transducer can transition to a normal mode of operation. However, maintenance beatings can be applied periodically to maintain sufficient distance between the tops and the bottoms of the bladders and the transducer-seismic mass assembly.

That said, in at least some exemplary embodiments, the bladders can be such that the normal operation of the piezoelectric transducer pushes or otherwise causes the bladders to deform to a location beyond the greatest "swing" of the piezoelectric transducer. Because the bladders will have deformed to the location beyond the greatest swing of the piezoelectric transducer, there will be a point where the bladders no longer receive the force from the piezoelectric transducer, and thus, over time, will creep back to their at rest position, but, upon entering the swing of the piezoelectric transducer, and thus being struck by the counterweight, the energy imparted into the bladders will thus call the bladders to reverse course and deform away from the piezoelectric transducer again.

Alternatively, and/or in addition to the embodiments detailed above, in an exemplary embodiment, the implantable component (and again, any disclosure herein with regard to the features of the implantable component also corresponds to a disclosure of the features of the external component on a passive transcutaneous bone conduction device and/or a removable component of a percutaneous bone conduction device, providing that the art enables such, unless otherwise noted) the implantable component is configured to impart thermal energy into the fluid so as to one of temporarily at least limit movement of the piezoelectric transducer relative to that which is the case in the absence of the fluid or stop and/or reduce the temporary at least limiting of the movement of the piezoelectric transducer relative to that which is the case in the absence of the fluid. In an exemplary embodiment, a resistance heating device is present in the housing, which is activated when it is deemed that there is utilitarian value with respect to shock-proofing the assembly. As the resistance heating device heats the fluid, the viscosity of the fluid increases and thus the resistance to movement of the piezoelectric transducer imparted by the fluid increases. That said, with respect to the latter feature where the temporarily at least one of limiting the movement of the piezoelectric transducer relative to that which is the case in the absence of the fluid is stopped and/or reduced, the resistance heater can be utilized to heat the fluid (a different kind of fluid from the former), and thus decrease the viscosity. Also, in an exemplary embodiment, the heat generated by the electronics components can impart the thermal energy into the fluid. Accordingly, when the bone conduction device is on (e.g., when the implantable component is receiving an RF signal, when the external component of the passive transcutaneous bone conduction device or the percutaneous bone conduction device has been turned on, etc.), the electronics components in the housing will generate heats, and this heat can be utilized to heat the fluid. In an exemplary embodiment, the component utilizes the movement of the piezoelectric transducer to impart the thermal energy into the fluid via friction from the movement of the piezoelectric. Any device, system, and/or method that can enable the transfer of heat into the fluid can be utilized in at least some exemplary embodiments.

It is also noted that the transfer of thermal energy can be utilized to transition the fluid to a solid and/or vice versa. Accordingly, any disclosure herein of the utilization of thermal energy transfer to increase or decrease the viscosity of the fluid also corresponds to a disclosure of the utilization of thermal energy to change the fluid to a solid and/or vice versa.

Figure 18:
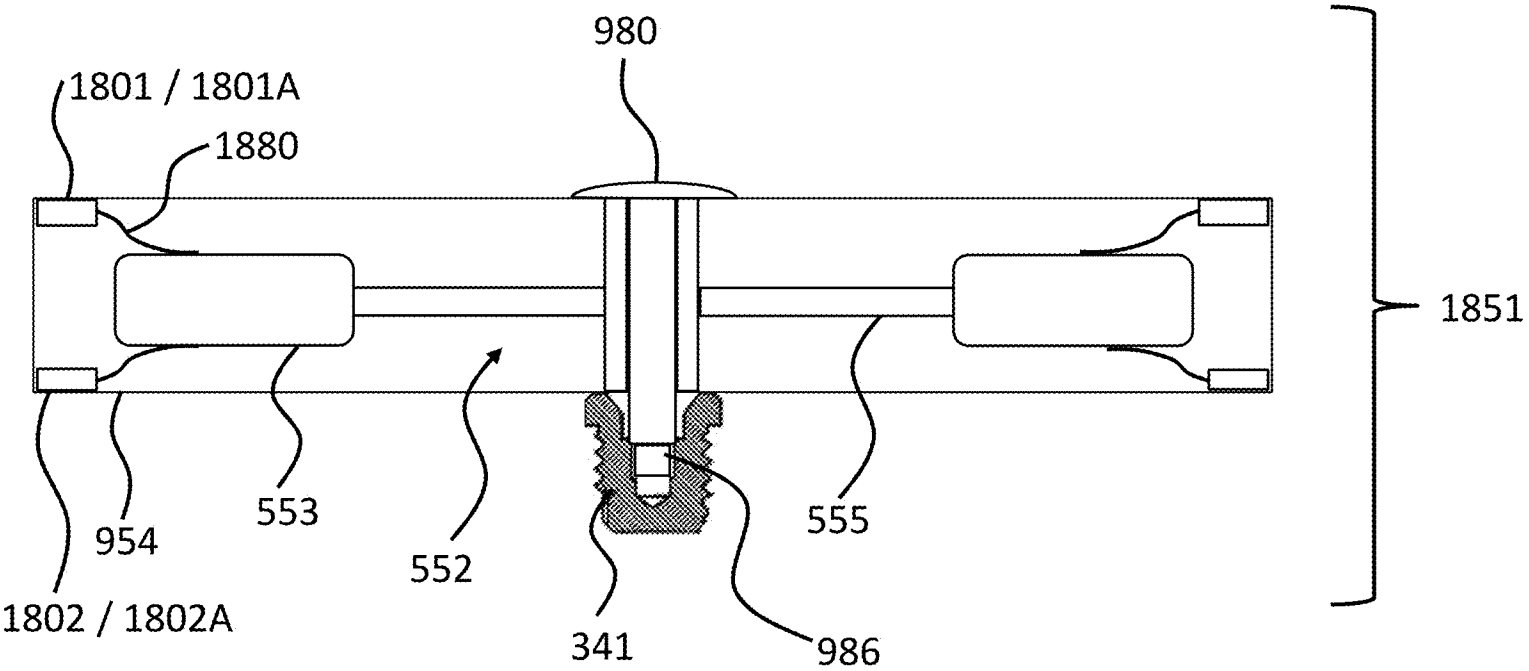
Figure 19:
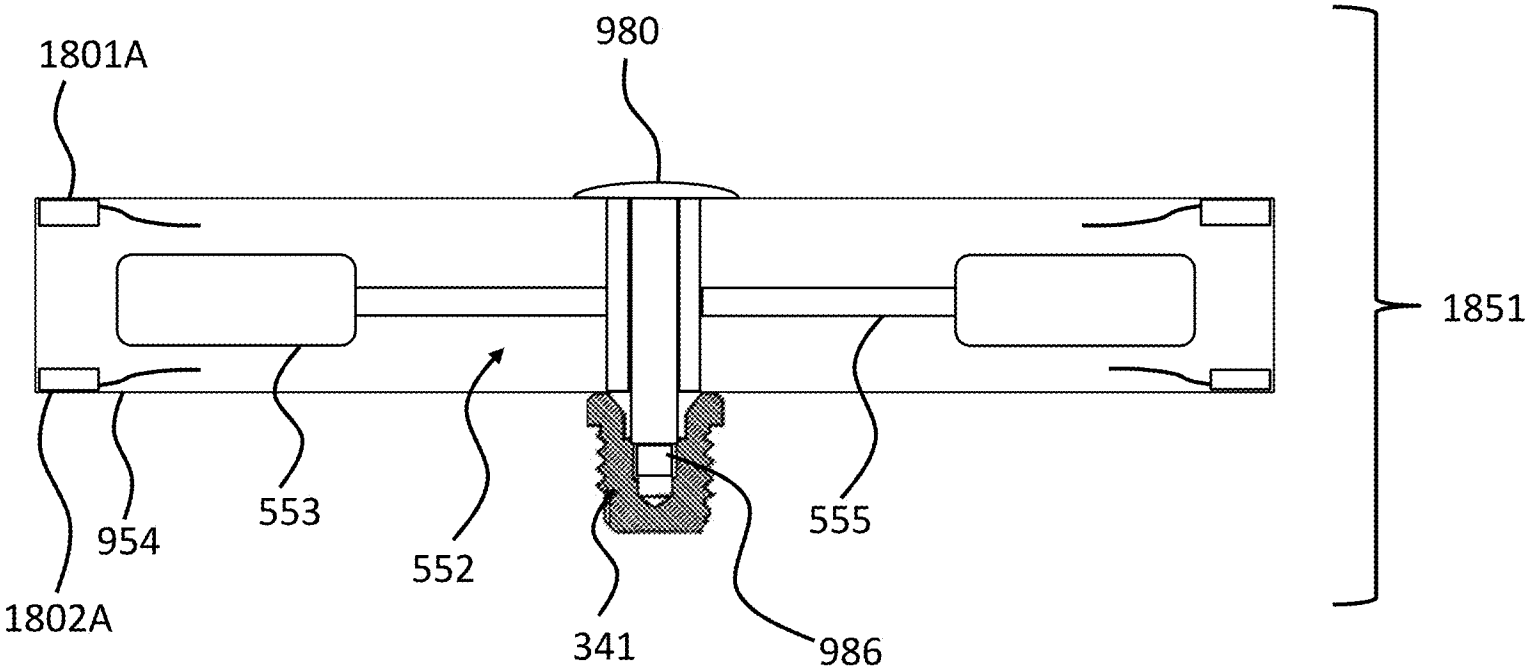

FIGS. 18 and 19 depict another exemplary embodiment of an implantable subcomponent 1851, which is configured to provide shock protection. In the embodiment depicted in FIG. 16, there exists piezoelectric apparatuses 1801 and 1802 which include respective bender components 1880, which, when energized or deenergized, depending on the embodiment, bend towards the counterweight assembly 553, as seen in FIG. 18, with the apparatus in state 1801A, and thus the subcomponent 1851 is shock-proofed, and when the apparatuses are energized or energized, again, depending on the embodiment, bend away from the counterweight assembly 553 as seen in FIG. 19, with the apparatuses in state 1802B, where the subcomponent 1851 is taken out of shock-proofing.

While the embodiments of FIGS. 18 and 19 have been described in terms of elements 1801 being piezoelectric apparatuses, in an alternate embodiment, these components can be temperature sensitive components such that, when thermal energy is applied thereto, such as to element 1880, the elements 1880 deform to the position in FIG. 19, and when thermal energy is taken away, the elements to form to the position in FIG. 18 (thus shock-proofing) subcomponent 1851. In an exemplary embodiment, an electrical current can be applied to element 1880, which, in an exemplary embodiment, is a bimetallic component, such that when element 1880 gains thermal energy, the expansion coefficients of the respective material are different, and thus element 1880 bends away from the position seen in FIG. 18, or vice versa. It is noted that this embodiment can be utilized without an electrical current. In an exemplary embodiment, heat from the electronics can impart sufficient thermal electricity into the bimetallic component of element 1880 such that the bimetallic component 1880 bends away from the position in FIG. 18 to the position in FIG. 19 (or some other position). Any device, system, and/or method that can enable movement of element 1880 from a position where such prevents the movement or otherwise limits the amount of movement that can occur with respect to the piezoelectric transducer can be utilized at least some exemplary embodiments such that such can enable the teachings detailed herein and/or variations thereof.

The components can have a shape memory, that have a "default" position as shown in FIG. 18, but, upon the impartation of energy or a force, deform to the position shown in FIG. 19. By way of example only and not by way of limitation, in an exemplary embodiment, the actuator can be used to "beat" the elements 1880 into submission over time, wherein, in a manner analogous to the bladders detailed above, upon the impartation of force from the transducer into elements 1880 and/or the impartation of the kinetic energy of the transducer into elements 1880, the elements 1880 deform to the position shown in FIG. 19. Again, consistent with the embodiments detailed above with regard to the fluid-filled bladders, the elements will continue to deform away from the piezoelectric transducer even after the piezoelectric transducer no longer contacts the elements. In an exemplary embodiment, this can be due to momentum. In an exemplary embodiment this can be due to the thermal energy that is imparted into the elements 1880 owing to the repeated application of force and removal of the force and/or the repeated application of kinetic energy into the element 1880. Also consistent with the embodiment detailed above vis-à-vis the bladders, over time, when the elements 1880 are away from contact with the piezoelectric transducer, the elements may move towards the shockproof position, but will ultimately come into contact with the moving transducer, which will impart the energy or force to deform the elements 1880 back to the state in FIG. 19.

Figure 20:
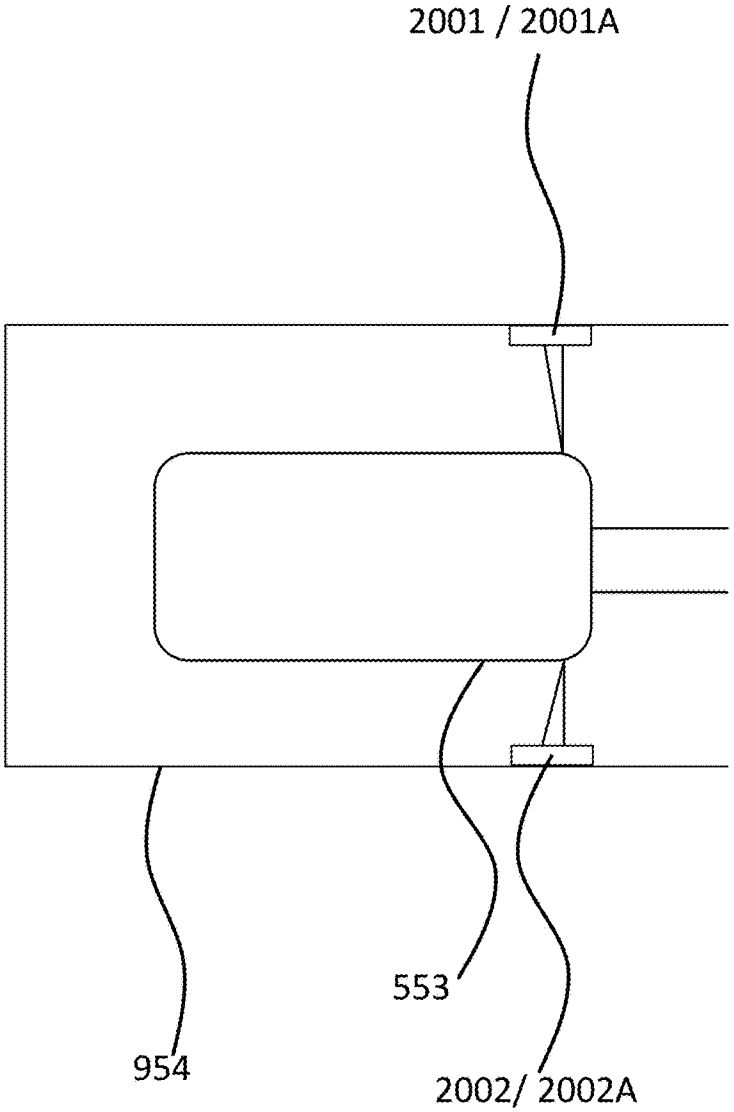
FIGS. 20-24 are various exemplary schematic diagrams of various cross-sections of various exemplary embodiments that prevent the failure mode conceptually represented in FIGS. 7 and 8.

FIG. 20 depicts an alternate exemplary embodiment of utilizing energy or force to deform a component to alternately place the implantable component into and out of the shock-proofing mode. As a preliminary matter, it is noted that during normal use, and, indeed, during extreme use of the piezoelectric transducer to evoke a bone conduction hearing percept, the swing of the seismic mass is relatively limited: in some instances 10 microns. Thus, the amount of clearance that is needed between a component that is utilized to place the implantable component into shock-proofing mode when the implantable component is out of shock-proofing mode is relatively minimal. Thus, in an exemplary embodiment, relatively small movements of the components that are utilized to place the implantable component into shock-proofing mode can be utilized. With this in mind, FIG. 20 depicts components 2001 and 2002, which correspond to bimetallic components that are configured to deform inboard and away from the seismic mass 553 when energy, such as thermal energy, or force, such as the force applied from the movements of the piezoelectric transducer, is imparted thereto. FIG. 20 depicts elements 2001 and 2002 in the un-deformed state (2001A and 2002A). Upon being subject to the energy or force in one or more of the various manners detailed herein and/or variations thereof, components 2001 and 2002 deform to the position depicted in FIG. 21, which depicts an exemplary scenario where the elements are in a deformed state 2001B and 2002B. As can be seen, the tips of elements 2001 and 2002 both pulled away (downward and upward) from counterweight 553 and also deform inboard of the implantable component. Here, the structure of the seismic mass 553 is such that the movement of the tip of the component 2001 and the component 2002 inboard moves the components to be most proximate the curved areas of the seismic mass assembly, thus resulting in an increase of clearance for the movement of the piezoelectric transducer during normal operation beyond that which would result from only the deformation of the components 2001 and 2002. That is, the structures of the piezoelectric transducer in general, and the seismic mass 553 in particular, and the components 2001 and 2002 are complementary to each other such that an increased "swing" distance is provided beyond that which would result from the mere deformation of the components 2001 and 2002. Moreover, in an exemplary embodiment, the curvature of the seismic mass assembly on the inboard portions can be utilized to further buffer or otherwise provide a safeguard against inadvertent contact between the seismic mass 553 and the components 2001 and 2002. In the event of such inadvertent contact, the curved portion can "push" the top portions of components 2001 and 2002 inboard away from the seismic mass 553, and thus preventing a sudden stop or "banging" of the seismic mass assembly.

Note also that the concept of utilizing the lateral forces imparted onto components 2001 and 2002 can also be a driver that deforms the components from the configuration of FIG. 2000 to the configuration of 2001. That is, the movement of the transducer can push the components inward (instead of pushing the component's downward) and/or the friction against the component and the seismic mass 553 can cause the components to deform inboard.

Note also that while the embodiments detailed herein have been directed towards the component that deforms or otherwise moves to varying late engage and disengage shock-proofing as being a component separate from the transducer-seismic mass assembly, in an alternate embodiment, the components can be part of the transducer-seismic mass assembly. In an exemplary embodiment, they can ride on the transducer-seismic mass assembly. Still further, in an exemplary embodiment, there can be two sets of such components—one directly connected to and/or part of the transducer-seismic mass assembly, and one directly connected to and/or part of the housing. In this way, both can work in a complementary manner to variously take the implantable component in and out of shock-proofing. Also, in an exemplary embodiment, the seismic mass 553 itself can deform upon the impartation of energy. In an exemplary embodiment, the seismic mass can contract when energy or force is applied thereto or vice versa. Thus, the two components working in tandem with each other can increase an amount of clearance that is afforded when the implantable component is taken into the non-shockproof mode.

With respect to the embodiments that include elements that contract when thermal energy is applied thereto, in an exemplary embodiment, structures sometimes referred to as "metamaterials"—composite materials whose configurations exhibit strange, often counterintuitive properties that are not normally found in nature, can be used, such as the structures developed by engineers from MIT, the University of Southern California, and elsewhere who have developed a class of heat-shrinking materials. By way of example only and not by way of limitation, the structures developed by the team, led by Nicholas X. Fang, an associate professor of mechanical engineering at MIT, corresponding to the tiny, star-shaped structures manufactured out of interconnected beams, or trusses, which, in some instances, quickly shrink when heated to certain temperatures.

Figure 22:
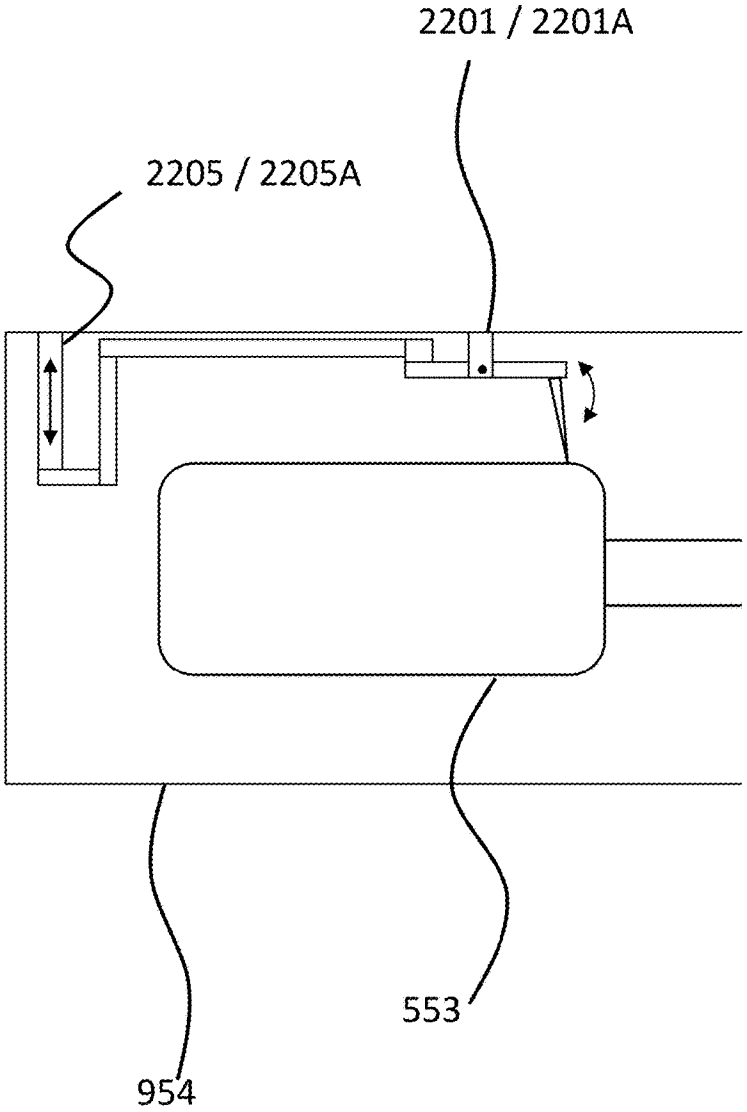
Figure 23:
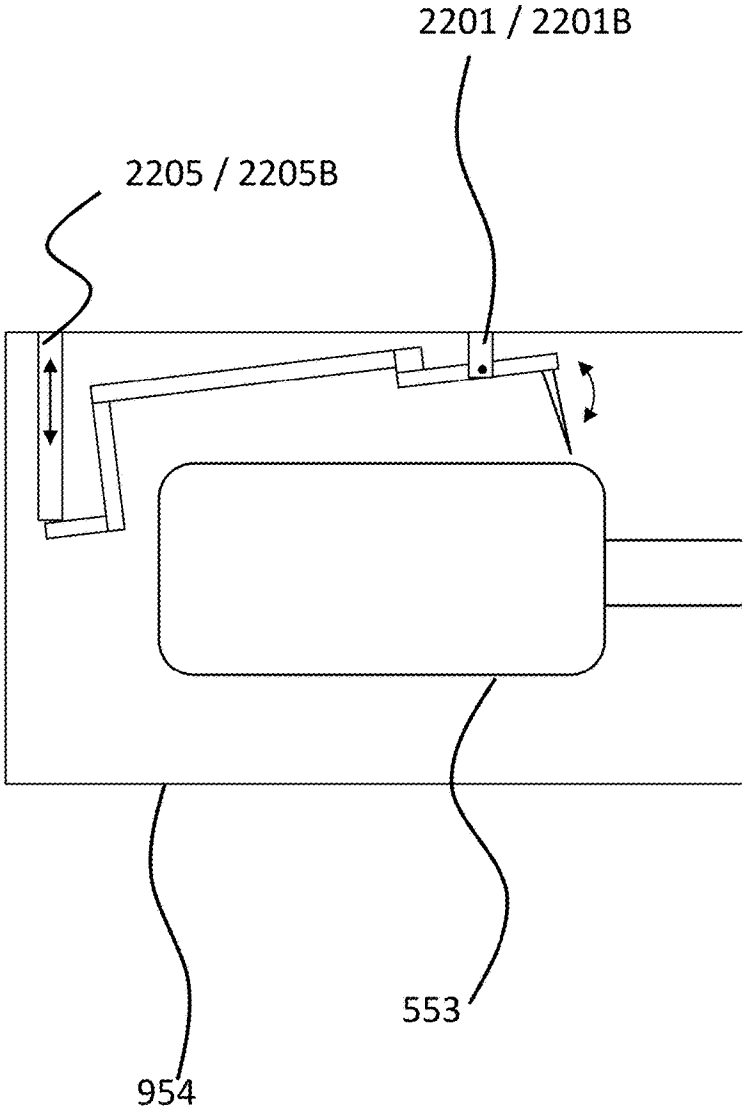

Briefly, it is noted that some exemplary embodiments are such that disclosures herein with regard to contracted states and extended states and/or positions correspond to retracted and extended states. This nuance with regard to the word "retracted" is with reference to an embodiment where a structure can extend, but retract another structure. FIGS. 22 and 23 depict such an exemplary embodiment. Here, lever assembly 2201 is seen in the extended state (2201A), but heat sensitive element 2205 is seen in the retracted state (2205A). Upon the application of thermal energy, such as by way of example only and not by way of limitation, the application of an electrical resistance charger the like through element 2205, element 2205, which can be a metal that expands when subject to an electrical charge, expands to an expanded state (2205B) as seen in FIG. 23, but lever 2201 is in a retracted state (2201B).

Figure 21:
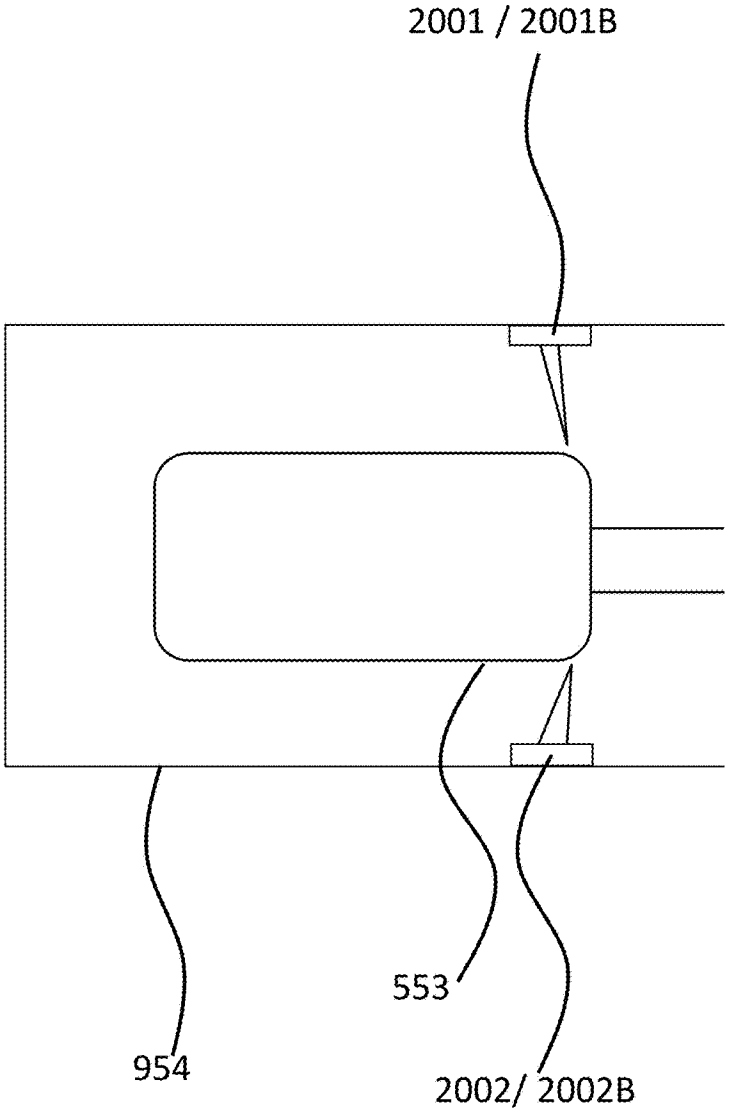
Figure 24:
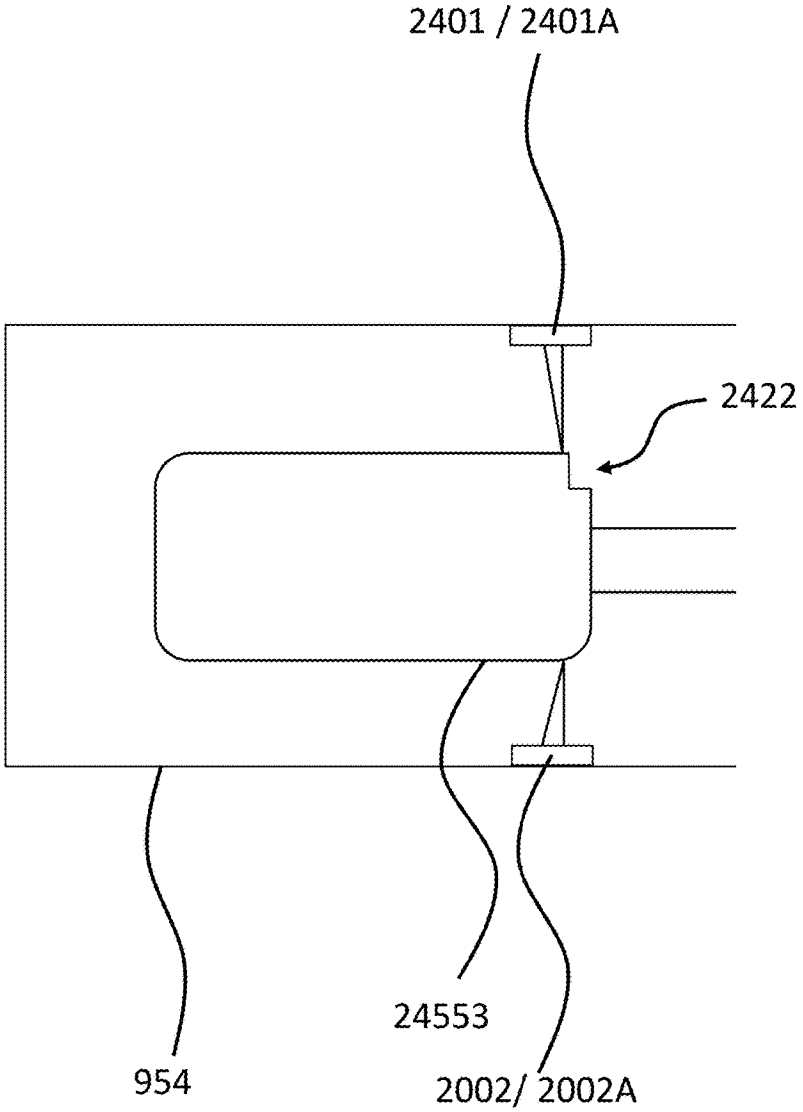

While the embodiment depicted in FIGS. 20 and 21 and the other figures depict a seismic mass that has a curved component, an alternate embodiment, the seismic mass 553 can have edges that abruptly end and fall off like a cliff. FIG. 24 depicts an exemplary embodiment where the seismic mass 24553 has such a feature on the top inboard edge, thus creating cutout 2422. In this regard, the tip of the component 2401 can contact at an inboard location of the seismic mass 553 relatively close to the inboard edges thereof (e.g., 0.1 mm), but enough to ensure that upon the implantable component experiencing an acceleration or deceleration that would otherwise damage to the piezoelectric material, the component 2401 will still remain in contact with the seismic mass 24553. Relatively limited deformation of the component 2401 and inboard (more than 0.1 mm) will thus result in a very large difference in the ability of the seismic mass to move relative to that which would be the case if the cutout 2422 was not present.

As can be seen, the components 2001 and 2002 are generally located much more inboard relative to that which is the case for the embodiments of the piezoelectric stacks detailed above with respect to FIGS. 12 and 13. In this regard, in an exemplary embodiment, because the portions of the transducer-seismic mass assembly that are inboard have less of a swing distance relative to portions of the transducer-seismic mass assembly that are outboard, there is less "clearance" that is required when the anti-shock apparatuses transition from the anti-shock mode to the normal mode of operation.

Figure 25:
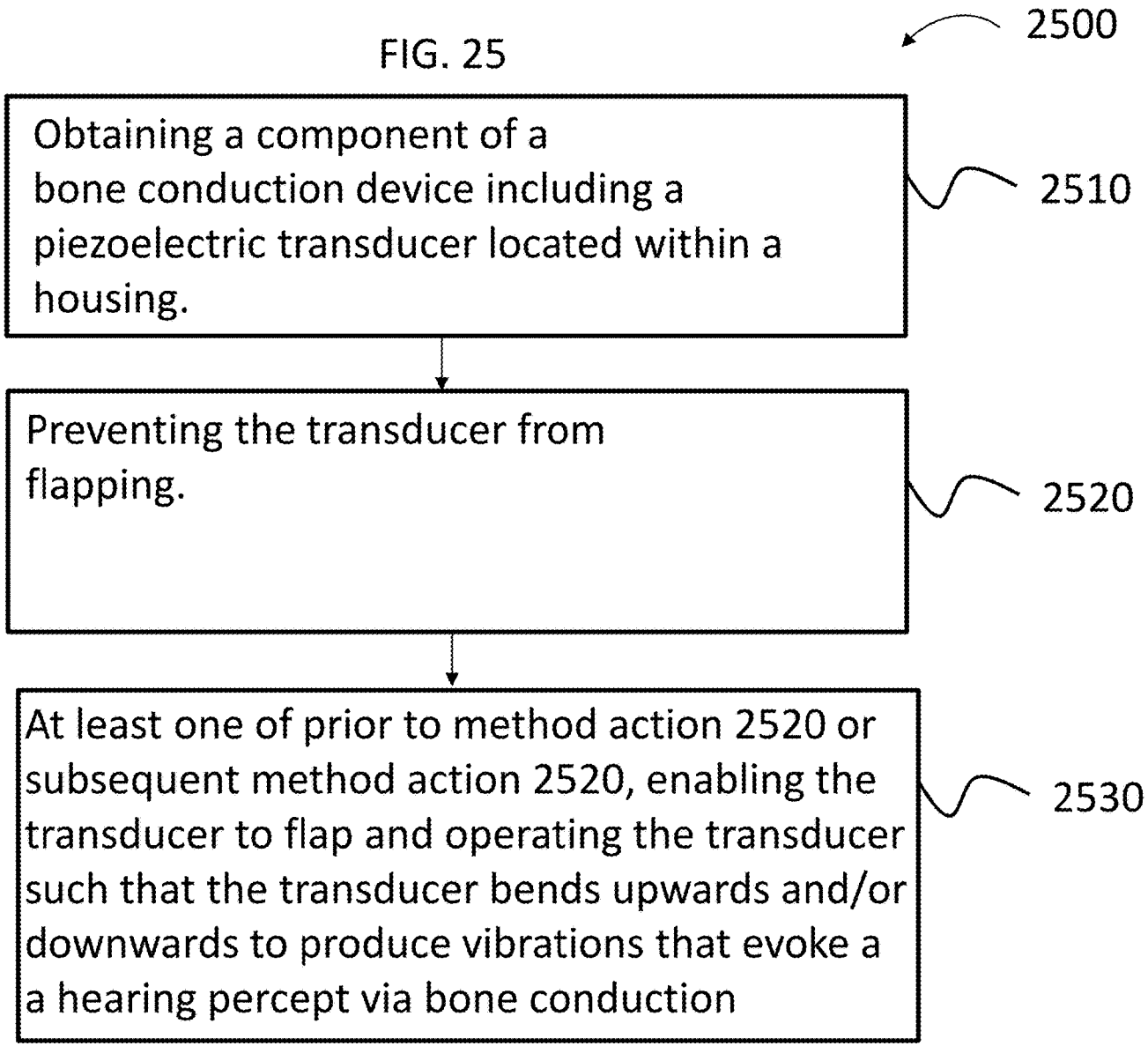
FIGS. 25-27 represent various flowcharts for exemplary methods according to some exemplary embodiments.

FIG. 25 presents an exemplary flowchart for an exemplary method, method 2500, according to an exemplary embodiment. Method 2500 includes method action 2510, which includes obtaining a component of a bone conduction device including a piezoelectric transducer located within a housing. In an exemplary embodiment, method action 2510 is executed by obtaining an implantable component of an active transcutaneous bone conduction device, the external component of a passive transcutaneous bone conduction device, or a removable component of a percutaneous bone conduction device. Method 2500 further includes method action 2520, which includes preventing the transducer from flapping. Method 2500 further includes method action 2530, which includes, at least one of subsequent to the action of preventing the transducer from flapping (method action 2520) or prior method action 2520, enabling the transducer to flap and operating the transducer such that the transducer bends upwards and/or downwards to produce vibrations that evoke a bone conduction hearing percept (method action 2530). With regard to the scenario where method action 2530 is executed after method action 2520, such can correspond to that which results from the shock-proofing being enabled for shipping and/or during implantation to guard against damage in view of the possibility of a healthcare professional or other service provider from dropping. Also, with regard to the scenario where method action 2530 is executed after method action 2520, such can correspond to that which results from the activation of the shock-proofing while the implanted component is implanted in the recipient, such as a scenario where the recipient is playing a sport or the like where it is more likely that the implant could experience a deleterious acceleration and/or deceleration. With regard to the scenario where method action 2530 is executed prior to method action 2520, such can correspond to the just noted sports scenario. In an exemplary embodiment of method 2500, the action of enabling the transducer to flap and operating the transducer to evoke the first hearing percept (method 2520) is executed after the action of preventing the transducer from flapping. In this exemplary embodiment, in at least some instances, the method further comprises, prior to the action of preventing the transducer from flapping, operating the transducer such that the transducer bends upwards and/or downwards to produce vibrations that evoke a second hearing percept via bone conduction.

In an exemplary embodiment of method 2500, the method further comprises, prior to first operating the bone conduction device to evoke a hearing percept, preventing the transducer from flapping. By way of example only and not by way of limitation, such can correspond to placing the component including the piezoelectric transducer into the shock-proofing mode for transportation and/or during implantation etc. In some embodiments of method 2500, consistent with the teachings detailed herein, the component is a component of an active transcutaneous bone conduction device, and the actions of operating the transducer and preventing the transducer from flapping (method actions 2520 and 2530) are executed while the component is implanted in a recipient.

While some embodiments are directed towards a configuration that completely prevents movement of the transducer when the transducer is prevented from flapping. In some alternate embodiments, again as noted above, the transducer is enabled to move upwards or downwards when the transducer is prevented from flapping.

In some embodiments, the transducer is prevented from moving more than about JKL micrometers in any one direction from an at-rest location when the transducer is prevented from flapping. In an exemplary embodiment, JKL is 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, or any value or range of values therebetween in about 0.1 increments.

In an exemplary embodiment, the distance from the center of the piezoelectric transducer to the outermost edge of the piezoelectric material and/or the outermost edge of the counterweights is about 2, 2.1, 2.2, 2.3, 2.4, 2.5, 2.6, 2.7, 2.8, 2.9, 3.0. 3.1, 3.2, 3.3, 3.4, 3.5, 3.6, 3.7, 3.8, 3.9 or 4 mm or any value or range of values therebetween in about 0.01 mm increments.

In an exemplary embodiment, the transducer is configured such that, during operation to evoke a hearing percept, when the component is subjected to a one G environment, the transducer bends upwards a maximum of a first value and downward a maximum of a second value, wherein the direction of movement upward and downward is parallel to the direction of gravity of the one G environment, and when the transducer is prevented from flapping, the transducer cannot move upward more than the first value and/or downward more than the second value.

Figure 26:
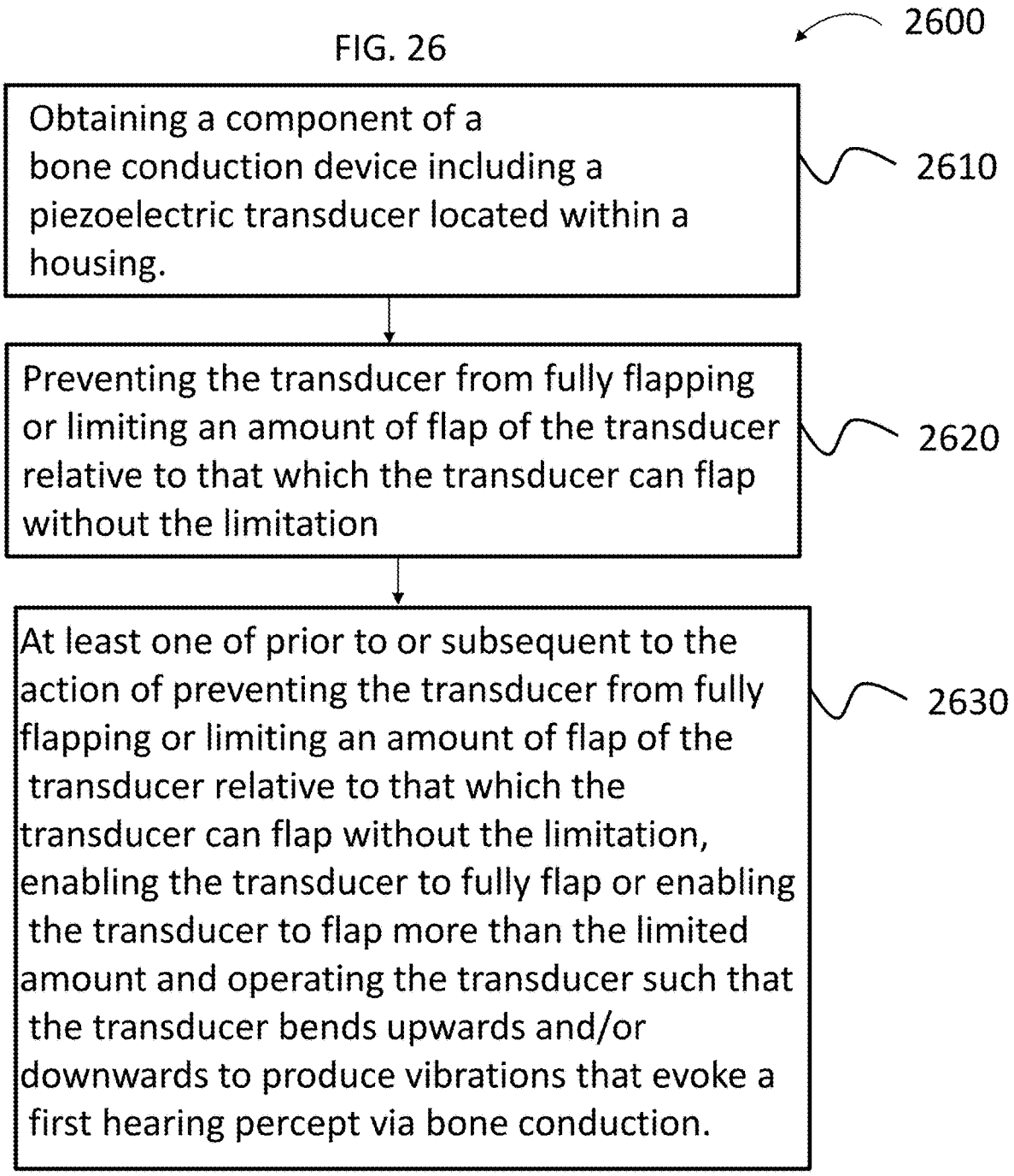

FIG. 26 is a flowchart for an exemplary method, method 2600, that comprises method action 2610, which includes obtaining a component of a bone conduction device including a piezoelectric transducer located within a housing, and method action 2620, which includes preventing the transducer from fully flapping or limiting an amount of flap of the transducer relative to that which the transducer can flap without the limitation. Method action 2630 includes the actions of at least one of prior to or subsequent to the action of preventing the transducer from fully flapping or limiting an amount of flap of the transducer relative to that which the transducer can flap without the limitation (method action 2620), enabling the transducer to fully flap or enabling the transducer to flap more than the limited amount and operating the transducer such that the transducer bends upwards and/or downwards to produce vibrations that evoke a first hearing percept via bone conduction.

In an exemplary embodiment of method 2600, the action of enabling the transducer to flap or enabling the transducer to flap more than the limited amount and operating the transducer to evoke the first hearing percept is executed after the action of preventing the transducer from fully flapping or limiting the amount of flap, and method 2600 further comprises, prior to the action of preventing the transducer from fully flapping or limiting the amount of flap, operating the transducer such that the transducer bends upwards and/or downwards to produce vibrations that evoke a second hearing percept via bone conduction. In an exemplary embodiment of method 2600, prior to first operating the bone conduction device to evoke a hearing percept, the method further includes preventing the transducer from fully flapping or limiting an amount of flap relative to that which the transducer can flap without the limitation. Also, in an exemplary embodiment of method 2600, the component is a component of an active transcutaneous bone conduction device, and the actions of operating the transducer and preventing the transducer from fully flapping or limiting an amount of flap are executed while the component is implanted in a recipient. In some exemplary embodiments of method 2600, the transducer is enabled to move at least one of upward or downward when the transducer is prevented from fully flapping or limited in its amount of flap. In some exemplary embodiments, method 2600 is such that the transducer is prevented from moving more than about JKL micrometers in any one direction from an at-rest location when the transducer is prevented from fully flapping or limited in its amount of flap.

In an exemplary embodiment of method 2600, the transducer is configured such that, during operation to evoke a hearing percept, when the component is subjected to a one G environment, the transducer bends upwards a maximum of a first value and downward a maximum of a second value, wherein the direction of movement upward and downward is parallel to the direction of gravity of the one G environment, and when the transducer is prevented from fully flapping or limited in its amount of flap, the transducer cannot move upward more than the first value and/or downward more than the second value. In an exemplary embodiment of this exemplary embodiment, the piezo material of the transducer is configured to break when subjected to flapping of a first value, and the transducer is prevented from flapping at the first value when the transducer is prevented from fully flapping or limited in its amount of flap. In some exemplary embodiments of method 2600, a fluid is controlled to prevent the transducer from flapping.

Figure 27:
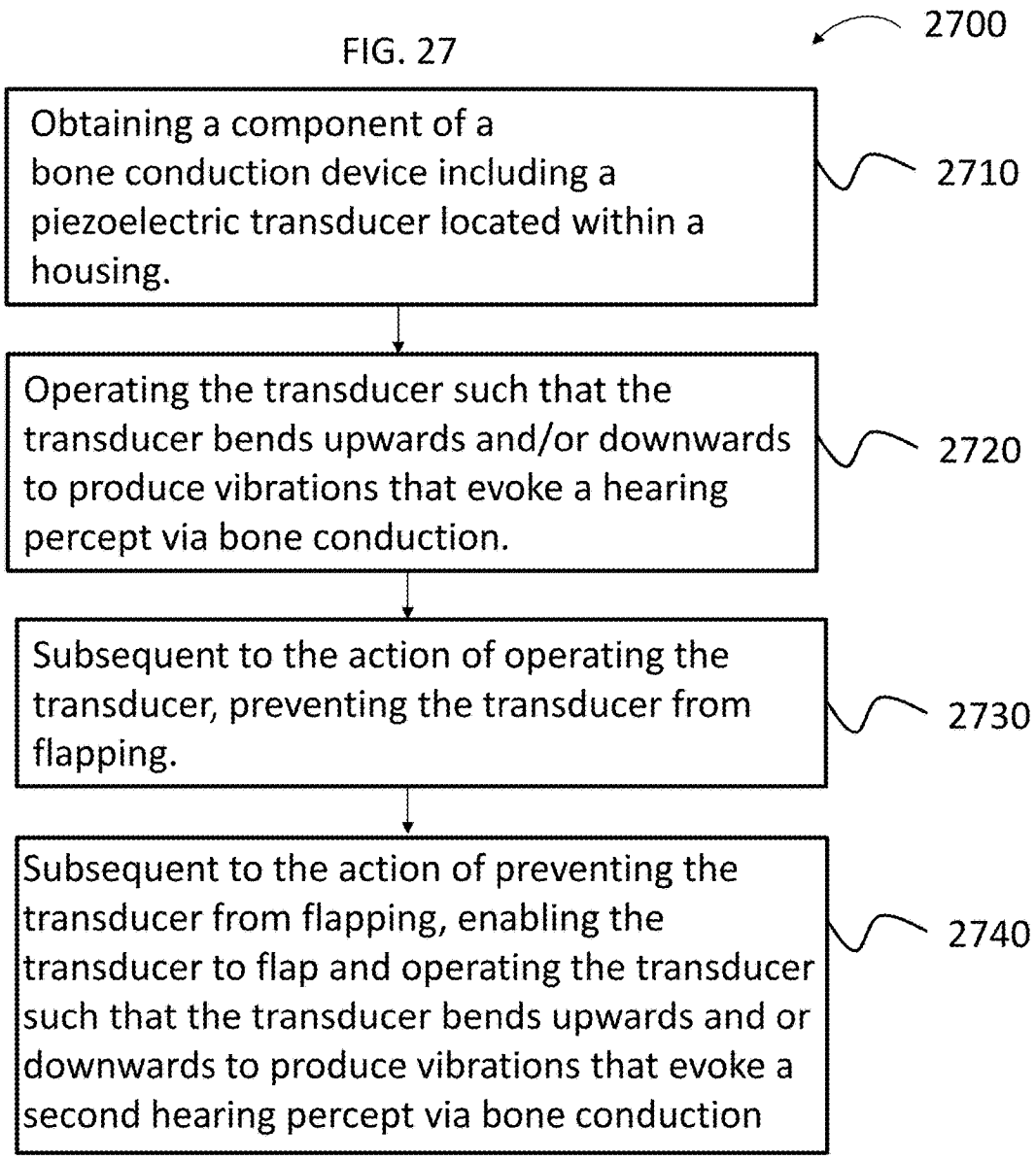

FIG. 27 presents an exemplary flowchart for an exemplary method, method 2700, according to an exemplary embodiment. Method 2700 includes method action 2710, which includes obtaining a component of a transcutaneous bone conduction device including a piezoelectric transducer located within a housing, and method action 2720, which includes operating the transducer such that the transducer bends upwards and/or downwards to produce vibrations that evoke a hearing percept via bone conduction. Method 2700 also includes method action 2730, which includes, subsequent to the action of operating the transducer, preventing the transducer from flapping. Method 2700 also includes method action 2740, which includes, subsequent to the action of preventing the transducer from flapping, enabling the transducer to flap and operating the transducer such that the transducer bends upwards and/or downwards to produce vibrations that evoke a second hearing percept via bone conduction.

Briefly, it is noted that in some embodiments, when exposed to a 10, 15, or 20 G acceleration and/or deceleration, without the shock-proofing engaged, the resulting flap moves the piezoelectric transducer at least 4, 5, 6, 7, 8, 9, 10, 11, 12, 13, 14, 15, 20, 25, 30, 35, 40, 45, or 50 times the amount that occurs during normal operation in response to a pure sine wave at 1000 Hz at 80 dB (as measured at the microphone of the external component when used therewith).

Figure 28:
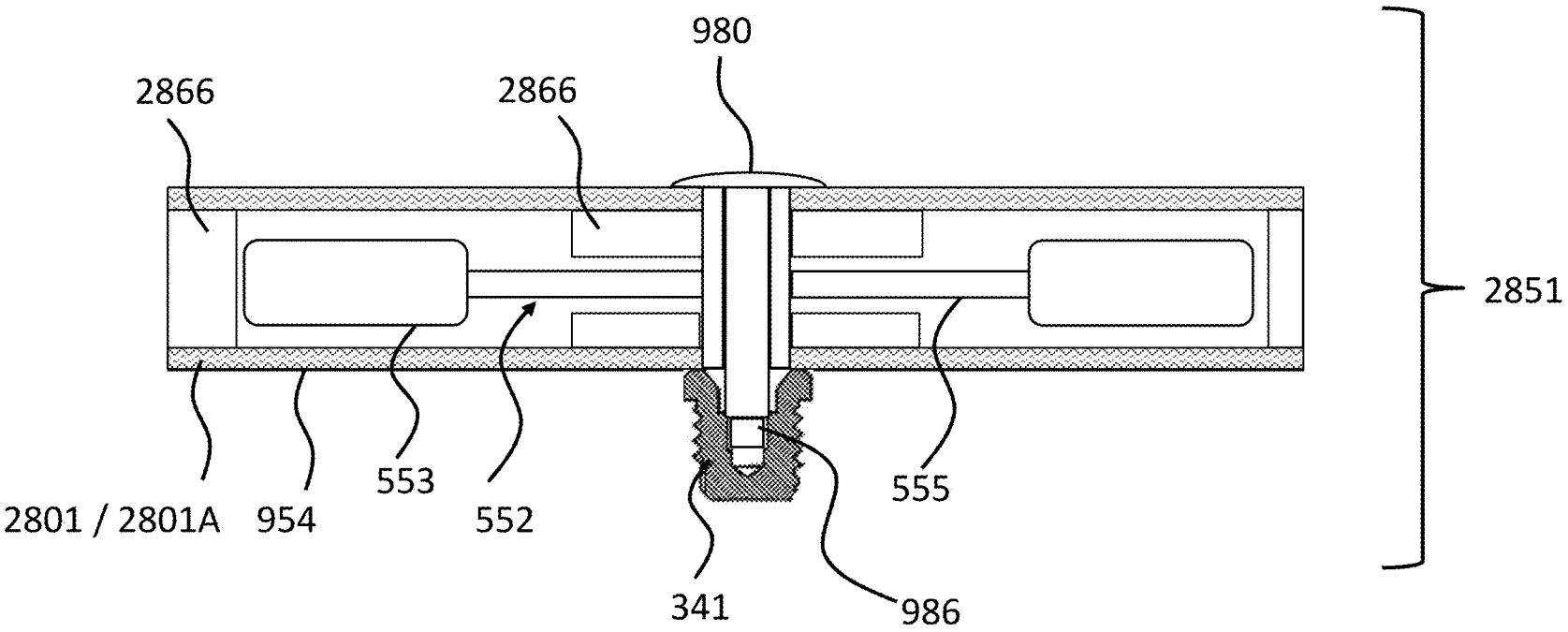
FIGS. 28 and 29 are schematic diagrams of a cross-section of an exemplary embodiment that prevents the failure mode conceptually represented in FIGS. 7 and/or 8.
Figure 29:
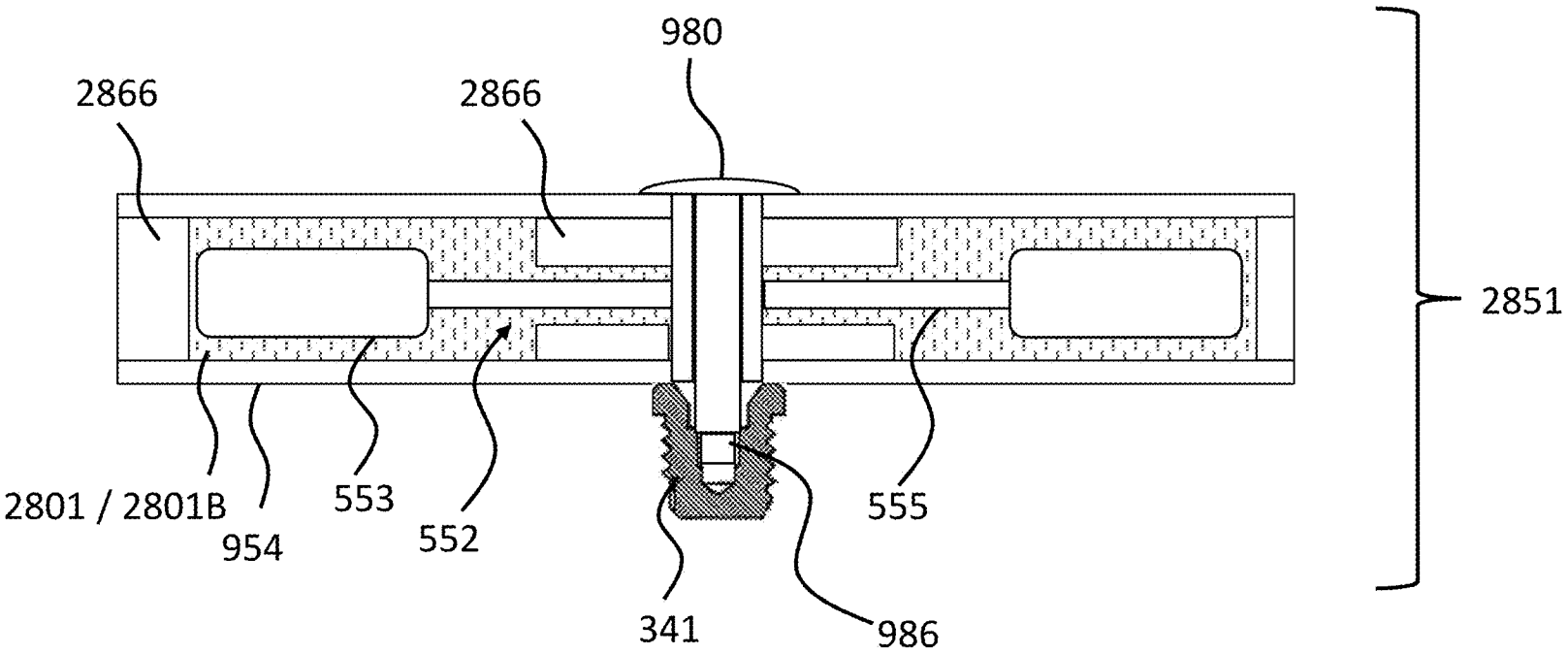

FIG. 28 depicts an another exemplary embodiment that utilizes fluid control to variously place the implantable component, here, subcomponent 2851, into an out of shock-proofing. Here, fluid 2801 is contained in reservoirs above and below the piezoelectric transducer 552, as can be seen. The fluid 2801 in the reservoirs is represented as fluid 2801A. In an exemplary embodiment, through osmosis or via a pump, the fluid pumped out of the reservoirs and into the chamber within the housing outside the reservoirs. This is seen in FIG. 29, and represented as fluid 2801B. As can be seen, spacers 2866, or "ballast" as might more appropriately be descriptive, are located in housing 954 outside the reservoirs, so as to reduce the amount of fluid that is needed to place the piezoelectric transducer 552 into the shock-proofing. Accordingly, in an exemplary embodiment, the implantable component can, in some embodiments, include an osmosis apparatus and/or a pump that moves the fluid within the housing to variably at least limit movement of the piezoelectric transducer and unlimit movement of the piezoelectric transducer.

With respect to the osmosis embodiment, in an exemplary embodiment, the interior reservoir walls (the reservoir walls facing the transducer 552) are made out of a material that permits the fluid 28012 travel therethrough by osmosis. Any device, system, and/or method that can enable fluid transfer can be utilized in at least some exemplary embodiments.

Further, it is noted that in an exemplary embodiment, material 2801 can be a material that is a fluid when located in the reservoir, but takes on a solid phase when it is outside the reservoir. By way of example only and not by way of limitation, pressure differences can be utilized to change the phase of the material 2801. Still further by way of example, an embodiment can be such that at a first temperature, the material 2801 is in a fluid state, and at a second temperature, material 2801 is in a solid-state. In an exemplary embodiment, a heat transfer device can be located in and/or outside the reservoirs, and configured to apply heat to the material 2801 to place the material into a fluid state. When in the fluid state, the material is easily moved from the reservoir into the chamber outside the reservoirs, and vice versa. In an exemplary scenario of use, thermal energy is applied to the material 2801 only when the material is to be transferred into or out of the reservoirs otherwise, the material is in the solid state. Thus, in an exemplary embodiment, thermal energy application can be a temporally limited application. This as opposed to some of the embodiments that tend to require the maintenance of temperature ranges to maintain the materials in a fluid and/or a solid-state. Accordingly, in an exemplary embodiment, the temperature of the material 2801 can be raised to the first temperature, thus transitioning the material to a fluid, and thus the fluid is pumped or otherwise transferred from the reservoir into the chamber where the transducer 552 is located, after which the material 2801 is permitted to be lowered to the second temperature (e.g., 100 degrees Fahrenheit or lower (body temperature, and thus the general temperature inside the housing 954 when implanted in the recipient)). At the second temperature, the material is in a solid form, and thus encompasses the piezoelectric transducer. The material 2801 is maintained in the solid form until there is utilitarian value with respect to enabling the transducer 552 to move or otherwise move more than that which is the case in the shock-proofing mode, and thus thermal energy is applied to the material 2801, to increase the temperature of the material to liquefy the material, at which point the material is pumped back into the reservoirs, or otherwise move back into the reservoirs, at least partially, where the material can then be permitted to cool to the second temperature, and thus solidify.

In some exemplary embodiments, the fluid that is controlled or otherwise managed, can be a compressible gas. Accordingly, some exemplary embodiments are such that any disclosure herein of a fluid corresponds to a disclosure of a compressible gas (just as any disclosure herein of a fluid corresponds to a disclosure of a liquid, which liquid can be compressible or incompressible). Thus, in an exemplary embodiment, the implantable component can be configured to increase a pressure of the fluid, thereby at least limiting movement of the piezoelectric transducer relative to that which is the case in the absence of the fluid. This can be the case with respect to the fluid being a compressible gas, or a compressible fluid.

In at least some exemplary embodiments, the transducers herein are instead EM actuators.

In view of the above, it is noted that in at least some embodiments, the teachings detailed herein can have utilitarian value with respect to enabling the "re-shock-proofing" of the implantable component at a later date, such as weeks and/or months after implantation/after the shock-proofing has been disengaged. It is also noted that in some exemplary embodiments, it is not just the mere fact that the external component is in signal communication with the implantable component that causes the implantable component to be taken out of the shock-proofing. Instead, in some exemplary embodiments, it is a dedicated specific signal that is provided from the external component to the implantable component to take the implantable component out of shock-proofing and/or to place the implantable component into shock-proofing. In this regard, in an exemplary embodiment, the external device 440 can provide a signal to the implanted receiver, which can provide a signal to the devices that output the energy and/or forces or otherwise transfer the energy and/or forces to variously place the implantable component into shock-proofing and take the implantable component out of shock-proofing.

In some embodiments, a capacitor or battery or the like can be located inside the housing of the implantable component, and in some other embodiments, such is located in a separate housing outside the housing of the implantable component. This capacitor or battery can have charge sufficient for only one or two actions sufficient to generate the energy and/or force to place the implantable component into shock-proofing or take the implantable component out of shock-proofing. In an exemplary embodiment, prior to implantation, an electrical current can be applied to a feedthrough to energize the capacitor or battery in the case of a capacitor or battery that is located in the housing of the implantable component, and can also be done with respect to such if located in a separate housing. That said, in an alternate embodiment, prior to implementation, an electrical current can be applied to the feedthrough to enable the transfer of energy and/or force, such as to take the implantable component out of shock-proofing.

It is also noted that in some embodiments, the shock proofing can be engaged and/or disengaged based on the state of a battery that is part of the implantable component or otherwise providing/used to provide power to the piezoelectric transducer, whether such battery is in the same housing as the transducer or outside such. By way of example only and not by way of limitation, in an exemplary embodiment, if the battery is outputting a signal to the electronics of the implantable component, the shock proofing could be disengaged, whereas in the absence of a signal from the battery, the shock proofing could be engaged.

It is noted that any disclosure herein of a component that is inside the housing in which the piezoelectric transducer is located also corresponds to a disclosure of an embodiment where there are two or more separate housings or two or more units (where one of the units would be the housing and the components therein, and the other unit when not necessarily include a housing, such as, by way of example only and not by way limitation, an RF coil remote from the housing), and the component is located in a housing or unit separate from the housing or unit that contains the transducer.

Note also that in some exemplary embodiments, a control signal can be sent to the implantable component to engage and/or disengage the shock-proofing, which control signal can be sent utilizing the inductance communication system that is also utilized to convey signals to initiate actuation of the transducer to create vibrations and calls a hearing percept. By way of example only and not by way of limitation, the signal transmitted to the implantable component can be transmitted at a frequency that does not initiate actuation of the transducer, either because the control unit does not output a signal to the piezoelectric transducer but instead reads the signal and reacts to engage and/or disengage the shock-proofing (e.g., owing to some form of switch or the like or other circuitry located inside the housing that diverts the current at a given frequency away from the piezoelectric material 555), or the frequency, which is transmitted ultimately to the piezoelectric transducer, does not affect the piezoelectric material. Also, in an exemplary embodiment, the frequency can affect the piezoelectric material, but can be at such a high frequency e.g., 30 kHz, the vibrations do not evoke a hearing percept because there and the ultrasonic range. In an exemplary embodiment, the signals can be applied to both the piezoelectric material and any other component that engages and/or disengages the shock-proofing, wherein the piezoelectric material 555 will deform according to operation of the transducer 552 while at the same time the shock-proofing will be engaged and/or disengaged.

To be clear, in an exemplary embodiment, the unit that applies the energy and/or force to engage and/or disengage the shock-proofing (e.g., an inductance/resistance heater controller, an actuator controller, etc.) and/or circuitry thereof can be configured so as to react to only current at a certain frequency. For example, the bone conduction device will generally not have utilitarian value with respect to frequencies above 20,000 Hz (e.g., the upper range of human hearing). Accordingly, in an exemplary embodiment, an electrical current can be provided at a frequency that operates the piezoelectric material 555 so that the actuator 552 vibrates at, for example, 22,000 Hz or 25,000 Hz or 30,000 Hz, etc. (e.g., a meaningless vibration with respect to evoking a hearing percept). However, that current can be shared by the component(s) that generates the force and/or energy that engages or disengages the shock-proofing, which only reacts to electrical current at those frequencies. That is, at frequencies of the electrical current applied to the piezoelectric material that will cause the transducer 552 to vibrate at frequencies below 20,000 Hz, the components would not engage and/or disengage the shock-proofing, or otherwise would not operate/would not respond to such current. Note also that in an exemplary embodiment, the signal applied to the implantable component from the external device could have a digital and/or an analog code embedded therein, such that the presence of a certain code enables circuitry inside the housing to activate/deactivate the shock-proofing.

In an alternate embodiment, a magnetic field or the like can be utilized to engage and/or disengage the shock-proofing. By way of example only and not by way of limitation, in an exemplary embodiment where the material is a magnetorestrictive material, the magnet of the external component can generate a magnetic field that will calls the material to react to the field so as to engage and/or disengage the shock-proofing. Note also that other configurations can be utilized that react to a magnetic field to engage and/or disengage the shock-proofing. By way of example only and not by way of limitation, in an exemplary embodiment, an alternating magnetic field or the like can be utilized to move a component inside the housing that is exposed to the fluid, which movement changes the viscosity and/or the state of the material therein, to engage and/or disengage shock-proofing. By way of example only and not by way of limitation, the magnetic field can be utilized to spin an impeller or the like, that will heat the fluid owing to friction, and thus increase or decrease the viscosity of the fluid etc. Any device, system, and/or method that can enable a magnetic field to engage and/or disengage the shock-proofing according the teachings detailed herein can be utilized in at least some exemplary embodiments.

Figure 30:
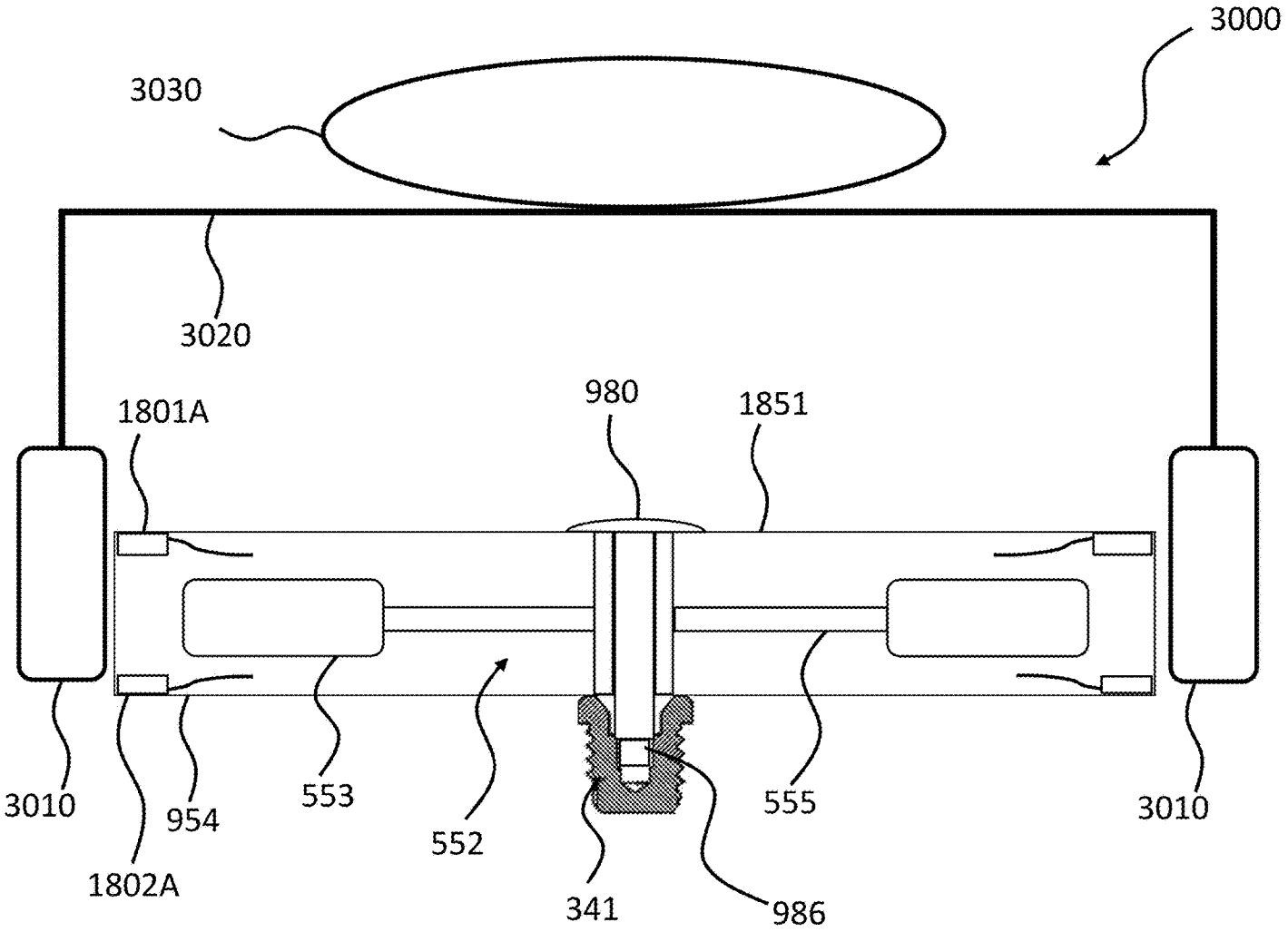
FIG. 30 depicts an exemplary tool that is utilized with some exemplary embodiments of the teachings detailed herein.

FIG. 30 depicts an exemplary tool 3000 located about component 1851 that is configured so as to impart a magnetic field on to the implantable subcomponent so as to engage and/or disengage the shock-proofing, which tool can be used prior to implantation (it is noted that the engagement and/or disengagement can be executed while maintaining the interior of the housing hermetically-sealed). Particularly, tool 3000 includes two magnets 3010 (although in other embodiments, only a single ring magnet 3010 is utilized) connected to each other by a support structure 3022 which handle 3030 is attached. Here, the tool 3000 can be placed "over" the component with the transducer, and the magnetic field can interact with the interior of the implantable component so as to engage and/or disengage the shock-proofing. In an exemplary embodiment, the tool 3000 can be moved back and forth in a somewhat rapid manner, or can be rotated relative to the implantable component, so as to generate the alternating magnetic field detailed above. That said, in some alternate embodiments, the presence of a magnetic field is sufficient to engage and/or disengage the shock-proofing. Note also that in a variation of the tool 3000, such can be utilized while the implantable component is implanted in the recipient to engage and/or disengage the shock-proofing.

The tool 3000 is but a conceptual representation of an exemplary device to transfer energy to the implant. It is noted that while the embodiment of FIG. 30 is directed towards the utilization of a magnetic field to enable and/or disable the shock-proofing, in an alternate embodiment, tool 3000 corresponds to a disclosure of a tool that is utilized to generate another type of energy (or extract another type of energy), such as heat, ultrasonic energy, microwaves, an RF field, etc. Any tool that can be configured to engage and/or disengage the shock-proofing in accordance with the teachings detailed herein and/or variations thereof can be utilized in at least some exemplary embodiments.

In at least some exemplary embodiments, thermal energy is transmitted through skin of the recipient to engage and/or disengage the shock-proofing. By way of example only and not by way of limitation, the skin can potentially tolerate a temperature of 120 degrees Fahrenheit, locally. In an exemplary embodiment, a hot water bladder can be applied to the outer skin above the implanted component, and the heat transfer from the hot water bladder will transfer through the skin and thus into the housing of the implanted component, thus raising the temperature therein, where the thermal energy transferred into the inside of the housing can be utilized to engage and/or disengage the shock-proofing. Conversely, a cold pack or the like can be placed over the skin so as to enable the transfer of thermal energy from the interior of the housing, through the skin, and to the cold pack, which transfer of thermal energy can engage and/or disengage the shock-proofing.

Note also that in an exemplary embodiment, high-frequency sound or the like can be utilized to transfer energy into the housing to engage and/or disengage the shock-proofing. Some form of microwave signal can be utilized as well to engage and/or disengage the shock-proofing.

In at least some exemplary embodiments, an external magnetic field can be utilized to impart the energy into the component(s) of the shock-proofing apparatus to transition the shock-proofing apparatus from the shock-proofing mode to the non-shock-proofing mode and vice versa. In an exemplary embodiment, an external electrical field can be utilized to impart the energy to achieve the aforementioned mode changes.

In at least some exemplary embodiments, the aforementioned external energy sources can be utilized with implants that are configured so as to maintain the shock-proofing or maintain a state where the device is no longer in the shock-proofing mode after the energy source is moved away from the implantable component and/or after the energy transferred to the implantable component has dissipated.

In at least some exemplary embodiments, the material used to place the transducer into and/or out of shock proofing is a thermal resistor/has thermal resistor properties.

It is also noted that in at least some exemplary embodiments, accelerometers the like can be utilized to engage and/or disengage the shock proofing. In an exemplary embodiment, upon an indication from an accelerometer that an acceleration of a given value is occurring, the shock proofing can be automatically engaged.

Any device, system, and/or method that can enable the transfer of energy to and/or from the housing to enable and/or disable the shock-proofing can be utilized in at least some exemplary embodiments.

It is noted that in some exemplary embodiments, the teachings detailed herein and/or variations thereof can have utilitarian value with respect to locking the seismic mass of the transducer in place, or otherwise at least restricting the seismic mass or other pertinent components from movement when such are exposed to a magnetic field of an MRI machine. In some embodiments, a magnetic field of an MRI machine can cause the seismic mass or other movable component of an electromagnetic transducer, for example, to move. Thus could cause an undesired hearing percept, which could be unacceptably loud or otherwise have a rhythm that is disruptive, at least in view of scenarios where the MRI procedure lasts for a relatively long time (some procedures can last hours, and require the patient to remain still—this distraction could have a deleterious effect on the patient's ability to remain still, etc.). In some embodiments, this movement could cause the transducer to break. Accordingly, in an exemplary embodiment utilizes the teachings detailed herein when the recipient is subjected to an MRI field to secure or otherwise prevent or limit the movement of at least some moving components of the transducer, which moving components would move in a deleterious manner when subjected to the MRI magnetic field without teachings.

Figure 31:
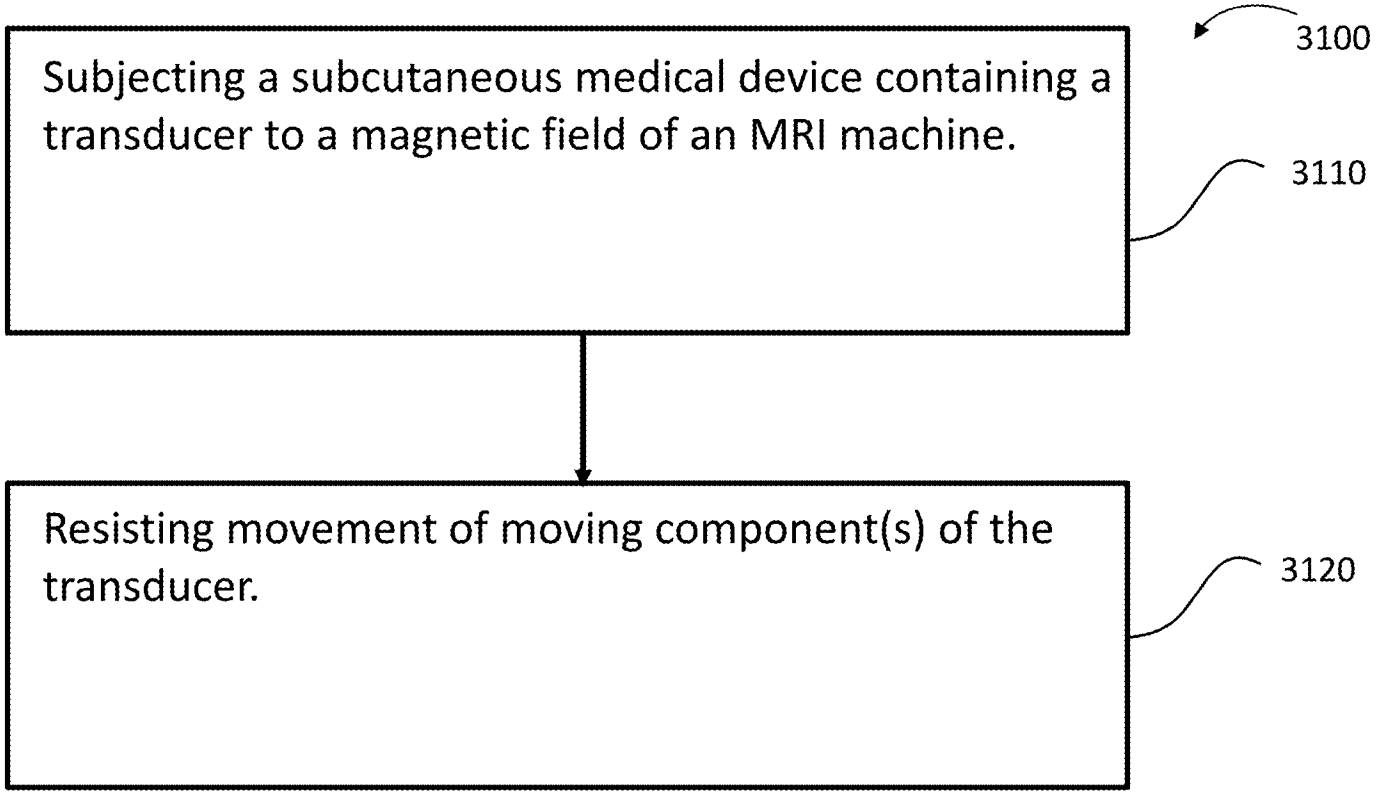
FIGS. 31 and 32 depict exemplary flowcharts for some exemplary methods.

In view of the above, it is to be understood that some exemplary embodiments include methods of resisting movement of the movable component(s) of the transducer subjected to an MRI magnetic field. In this regard, FIG. 31 depicts an exemplary algorithm 3100 for an exemplary method. Method 3100 includes method action 3110, which entails subjecting a subcutaneous medical device to a magnetic field, and thus exposing the moving parts thereof, such as the seismic mass, to the magnetic field. In some instances, without the teachings detailed herein, the seismic mass and other moving components would move when subject to the magnetic field. By way of example only and not by way of limitation, in an exemplary embodiment where the seismic mass of an electromagnetic transducer includes the permanent magnets, the seismic mass can move. This movement could be sufficient to break the transducer, where the movement could cause an output of vibrations or forces etc. that would be deleterious to the recipient.

Method 3100 further includes method action 3120, which entails the action of resisting movement of the moving component of the transducer (e.g., seismic mass of an electromagnetic transducer, which seismic mass includes a permanent magnet) utilizing one or more of the apparatuses, systems and/or method disclosed herein that temporarily limit movement of the transducer relative to that which would otherwise be the case and/or temporarily shock-proof the an assembly via energy transfer into or out of a material.

Figure 32:
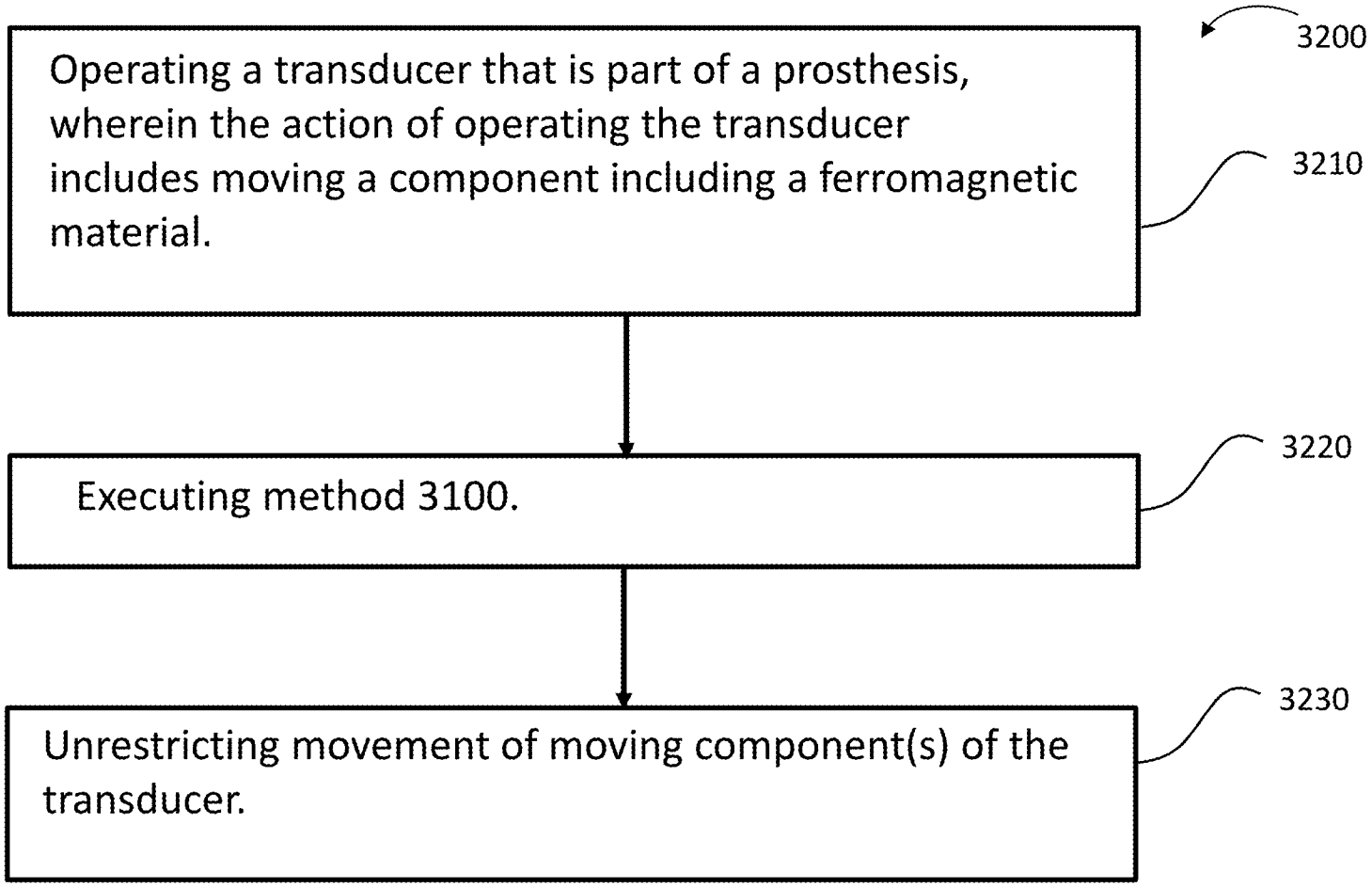

FIG. 32 depicts an exemplary algorithm for a method 3200, which includes method action 3210, which includes operating a transducer that is part of a prosthesis, wherein the action of operating the transducer includes moving a component including a ferromagnetic material. In an exemplary embodiment, the transducer is an electromagnetic actuator that is actuated in response to a captured sound captured by a microphone, wherein the signal output by the microphone is the basis of movement of the transducer. The transducer moves in a vibratory manner to output vibrations to evoke a hearing percept via bone conduction. That said, in an alternate embodiment, the transducer can be a transducer of a middle ear implant, which outputs a force in a reciprocating manner based on the signal from the microphone to move a component of the middle ear or the cochlea to evoke a hearing percept. Note also that in an exemplary embodiment, the transducer can be a transducer of a direct acoustic cochlear stimulator, which could be a component that is implanted in the cochlea or is attached to the cochlea on the outside of the cochlea.

Method 3200 includes method action 3220, which includes executing method 3100. Subsequent to the execution of method 3100, method 3200 proceeds to method action 3230, which includes on restricting movements of the moving components of the transducer. In an exemplary embodiment, method action 3230 results in the ability of the transducer to evoke a hearing percept in accordance with method action 3210. Indeed, in an exemplary embodiment, method 3200 further includes the additional action of, after method action 3230, executing method action 3210.

It is noted that in some alternate embodiments of method 3100, method action 3120 is executed using one or more of the devices, systems and/or method actions disclosed in U.S. patent application Ser. No. 15/212,450, entitled INTEGRITY MANAGEMENT OF AN IMPLANTABLE DEVICE, by Inventor Johan Gustafsson, filed on Jul. 18, 2016. It is noted that in some alternate embodiments of method 3100, method action 3120 is executed using one or more of the devices, systems and/or method actions disclosed in U.S. patent application Ser. No. 15/336,910, entitled PASSIVE INTEGRITY MANAGEMENT OF AN IMPLANTABLE DEVICE, by Inventor Tommy Bergs, filed on October, 2016.

It is noted that unless otherwise specified, any disclosure herein with respect to limiting movement of the counterweight corresponds to a disclosure of preventing movement of the counterweight and vice versa, all of which can correspond to shock-proofing the implantable component in general, and the seismic mass—transducer assembly in particular, in at least some exemplary embodiments.

In an exemplary embodiment, there is a component of a bone conduction device, comprising: a housing; and a transducer-seismic mass assembly, wherein the component is configured to automatically temporarily shock-proof the assembly via energy transfer into or out of a material. In an exemplary embodiment of this exemplary embodiment, the component is configured temporarily shock-proof the assembly while implanted inside a recipient. In an exemplary embodiment, the housing contains a fluid that has a variable viscosity, wherein the transducer-seismic mass assembly is exposed to the fluid; wherein movement of the transducer-seismic mass assembly in a vibratory manner reduces the viscosity of the fluid to a first value; lack of movement of the transducer-seismic mass assembly in the vibratory manner increases the viscosity of the fluid to a second value; and the assembly is shock-proofed when the fluid has the viscosity of the second value.

In an exemplary embodiment, there is a component of a bone conduction device, comprising: a housing; and a piezoelectric transducer, wherein the implantable component includes a fluid located therein, wherein the component is configured to control the fluid to temporarily at least limit movement of the piezoelectric transducer relative to that which is the case in the absence of the fluid. In an exemplary embodiment, the fluid is a compressible gas; and the component is configured to increase a pressure of the fluid, thereby at least limiting movement of the piezoelectric transducer relative to that which is the case in the absence of the fluid. In an exemplary embodiment, a balloon apparatus is located in the housing, and the component is configured to vary an amount of the fluid located in the balloon apparatus, thereby at least partially inflating and partially deflating a balloon of the balloon apparatus, wherein the volume of the balloon apparatus is greater when the balloon is at least partially inflated relative to that which is the case when the balloon is at least partially deflated, wherein the movement of the piezoelectric transducer is limited when the balloon apparatus is at least partially inflated.

In an exemplary embodiment, there is a method, comprising, obtaining a component of a bone conduction device including a piezoelectric transducer located within a housing, preventing the transducer from fully flapping or limiting an amount of flap of the transducer relative to that which the transducer can flap without the limitation; and at least one of prior to or subsequent to the action of preventing the transducer from fully flapping or limiting an amount of flap of the transducer relative to that which the transducer can flap without the limitation, enabling the transducer to fully flap or enabling the transducer to flap more than the limited amount and operating the transducer such that the transducer bends upwards and/or downwards to produce vibrations that evoke a first hearing percept via bone conduction. In an exemplary embodiment, there is a movable component of the transducer that moves when the transducer is operational is prevented from moving more than about 10 micrometers in any one direction from an at-rest location when the transducer is prevented from fully flapping or limited in its amount of flap. In an exemplary embodiment, a fluid is controlled to prevent the transducer from flapping.

It is noted that any disclosure of a device and/or system herein corresponds to a disclosure of a method of utilizing such device and/or system. It is further noted that any disclosure of a device and/or system herein corresponds to a disclosure of a method of manufacturing such device and/or system. It is further noted that any disclosure of a method action detailed herein corresponds to a disclosure of a device and/or system for executing that method action/a device and/or system having such functionality corresponding to the method action. It is also noted that any disclosure of a functionality of a device herein corresponds to a method including a method action corresponding to such functionality. Also, any disclosure of any manufacturing methods detailed herein corresponds to a disclosure of a device and/or system resulting from such manufacturing methods and/or a disclosure of a method of utilizing the resulting device and/or system.

Unless otherwise specified or otherwise not enabled by the art, any one or more teachings detailed herein with respect to one embodiment can be combined with one or more teachings of any other teaching detailed herein with respect to other embodiments.

While various embodiments have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A component of a prosthesis, comprising:
a housing of the prosthesis; and
a transducer, wherein
the component is configured to temporarily limit movement of the transducer, and
the component is configured to unlimit movement, after temporarily limiting movement, of the transducer.

2. The component of claim 1, wherein:
the component is an implantable component that is configured to temporarily limit movement of the transducer when RF power is being received by the implantable component.

3. The component of claim 1, wherein:
a phase transitioning material is located in the housing; and
the component is an implantable component that is configured such that when the phase transitioning material is in a first phase, the transducer is limited from moving inside the housing, and such that when the phase transitioning material is in a second phase, the transducer is enabled to move more inside the housing.

4. The component of claim 3, wherein:
the phase transitioning material is a fluid in the second phase.

5. The component of claim 4, wherein:
the phase transitioning material is a solid in the first phase.
6. The component of claim 3, wherein:
the interior of the housing is at least substantially filled with the phase transitioning material and other portions of the implantable component that are solid.
7. The component of claim 1, wherein:
the component is an implantable component that includes electronics in the housing; and
the implantable component is configured such that when power is applied to the electronics, the transducer is enabled to move inside the housing, and such that when power is not applied to the electronics, the transducer is limited from moving inside the housing.
8. The component of claim 1, wherein:
the transducer is a piezoelectric transducer;
a piezoelectric apparatus separate from the piezoelectric transducer is located in the housing; and
the component is an implantable component that is configured such that the piezoelectric apparatus limits the piezoelectric transducer from moving when in an expanded state and enables the piezoelectric transducer to move when in a contracted state.
9. The component of claim 8, wherein:
the piezoelectric apparatus is positioned such that in the expanded state, the piezoelectric apparatus extends into an actuation area of the piezoelectric transducer, and such that in the contracted state, the piezoelectric apparatus is outside the actuation area.
10. A component of a bone conduction device, comprising:
a housing; and
a transducer-seismic mass assembly, wherein
the component is configured to automatically temporarily shock-proof the assembly via energy transfer into or out of a material.
11. The component of claim 10, wherein:
the transducer-seismic mass assembly is configured to move upward and downward to generate vibrations; and
the component is configured to temporarily at least limit movement of the transducer-seismic mass assembly in at least one of the upward or downward directions, thereby temporarily shock-proofing the assembly.
12. The component of claim 10, wherein:
the transducer-seismic mass assembly is configured to move upward and downward to generate vibrations; and
the component is configured to temporarily prevent movement of the transducer-seismic mass assembly in at least one of the upward or downward directions, thereby temporarily shock-proofing the assembly.
13. The component of claim 10, wherein:
the component is configured to automatically shock-proof the assembly when the component is in an inactive state.
14. The component of claim 10, wherein:
the component includes a material that reacts to at least one of the presence or absence of an electrical current, and, if an electrical current is present, the material is in a first state, and if the electrical current is absent, the material is in a second state; and
one of:
the assembly is shock-proofed when the material is in the first state; or
the assembly is shock-proofed when the material is in the second state.
15. The component of claim 14, wherein:
the material is a phase transitioning material;
the first state is a solid phase;
the second state is a fluid phase; and
the assembly is shock-proofed when the material is in the first state.
16. A component of a bone conduction device, comprising:
a housing; and
a transducer, wherein
the component includes a fluid located therein, wherein the component is configured to control the fluid to temporarily at least limit movement of the transducer relative to that which is the case in the absence of the fluid, and
at least one of:
the fluid is a phase transitioning fluid that transitions from a fluid to a solid to at least limit movement of the transducer;
the fluid is a magnetorestrictive fluid; or
the component is configured to impart thermal energy into the fluid so as to one of temporarily at least limit movement of the transducer relative to that which is the case in the absence of the fluid or stop and/or reduce the temporarily at least limiting of the movement of the transducer relative to that which is the case in the absence of the fluid.
17. The component of claim 16, wherein:
the fluid is a phase transitioning fluid that transitions from a fluid to a solid to at least limit movement of the transducer.
18. The component of claim 16, wherein:
the fluid is a magnetorestrictive fluid.
19. The component of claim 16, wherein:
the component is configured to impart thermal energy into the fluid so as to one of temporarily at least limit movement of the transducer relative to that which is the case in the absence of the fluid or stop and/or reduce the temporarily at least limiting of the movement of the transducer relative to that which is the case in the absence of the fluid.
20. A method, comprising:
obtaining a component of a bone conduction device including a transducer located within a housing,
preventing the transducer from fully flapping or limiting an amount of flap of the transducer relative to that which the transducer can flap without the limitation; and
at least one of prior to or subsequent to the action of preventing the transducer from fully flapping or limiting an amount of flap of the transducer relative to that which the transducer can flap without the limitation, enabling the transducer to fully flap or enabling the transducer to flap more than the limited amount and operating the transducer such that the transducer bends upwards and/or downwards to produce vibrations that evoke a first hearing percept via bone conduction.
21. The method of claim 20, wherein:
the action of enabling the transducer to flap or enabling the transducer to flap more than the limited amount and operating the transducer to evoke the first hearing percept is executed after the action of preventing the transducer from fully flapping or limiting the amount of flap; and the method further comprises:

prior to the action of preventing the transducer from fully flapping or limiting the amount of flap, operating the transducer such that the transducer bends upwards and/or downwards to produce vibrations that evoke a second hearing percept via bone conduction.

22. The method of claim 20, further comprising:

prior to first operating the bone conduction device to evoke a hearing percept, preventing the transducer from fully flapping or limiting an amount of flap relative to that which the transducer can flap without the limitation.

23. The method of claim 20, wherein:

the component is a component of an active transcutaneous bone conduction device; and the actions of operating the transducer and preventing the transducer from fully flapping or limiting an amount of flap are executed while the component is implanted in a recipient.

24. The method of claim 20, wherein:

the transducer is enabled to move at least one of upward or downward when the transducer is prevented from fully flapping or limited in its amount of flap.

25. The method of claim 20, wherein:

a movable component of the transducer that moves when the transducer is operational is prevented from moving more than about 30 micrometers in any one direction from an at-rest location when the transducer is prevented from fully flapping or limited in its amount of flap.

26. The method of claim 20, wherein:

the transducer is configured such that, during operation to evoke a hearing percept, when the component is subjected to a one G environment, the transducer bends upwards a maximum of a first value and downward a maximum of a second value, wherein the direction of movement upward and downward is parallel to the direction of gravity of the one G environment; and when the transducer is prevented from fully flapping or limited in its amount of flap, the transducer cannot move upward more than the first value and/or downward more than the second value.

27. The method of claim 26, wherein:

the transducer is a piezoelectric transducer and the piezo material of the transducer is configured to break when subjected to flapping of a first value, and the transducer is prevented from flapping at the first value when the transducer is prevented from fully flapping or limited in its amount of flap.

28. The component of claim 16, wherein:

the transducer is a piezoelectric transducer; and the housing is an implantable housing of an implantable medical device.

29. The method of claim 20, further comprising:

subjecting the transducer to an MM magnetic field while the transducer is prevented from fully flapping or limiting an amount of flap of the transducer relative to that which the transducer can flap without the limitation.

30. The component of claim 10, wherein:

the component is an implantable component configured to be implanted in a human.

31. The method of claim 20, wherein:

the component of the bone conduction device is an implantable component configured to be implanted in a human and the method further comprises implanting the component in the human.

32. The component of claim 1, wherein:

the component is an implantable component that is configured to temporarily unlimit movement, after temporarily limiting movement, of the transducer while the housing is implanted in the recipient.

33. The component of claim 1, wherein:

the transducer is a piezoelectric transducer.

34. The component of claim 10, wherein:

the transducer of the transducer-seismic mass assembly is a piezoelectric transducer; and the housing is an implantable housing.

* * * * *